US010689157B2

(12) United States Patent
Morine et al.

(10) Patent No.: US 10,689,157 B2
(45) Date of Patent: Jun. 23, 2020

(54) FOOD AND BEVERAGE COOLER ASSEMBLY

(71) Applicant: OTTER PRODUCTS, LLC, Fort Collins, CO (US)

(72) Inventors: Alan V. Morine, Fort Collins, CO (US); Matthew M. Glanzer, Fort Collins, CO (US); Todd Eichinger, Fort Collins, CO (US); Cory R. Bloor, Westminster, CO (US); Jonathan B. Rayeski, Fort Collins, CO (US)

(73) Assignee: Otter Products, LLC, Fort Collins, CO (US)

( * ) Notice: Subject to any disclaimer, the term of this patent is extended or adjusted under 35 U.S.C. 154(b) by 599 days.

(21) Appl. No.: 15/494,020

(22) Filed: Apr. 21, 2017

(65) Prior Publication Data

US 2018/0186547 A1 Jul. 5, 2018

Related U.S. Application Data

(63) Continuation-in-part of application No. 15/398,468, filed on Jan. 4, 2017.

(51) Int. Cl.
*B65D 25/20* (2006.01)
*A47G 23/02* (2006.01)
(Continued)

(52) U.S. Cl.
CPC ..... *B65D 25/20* (2013.01); *A47G 23/02* (2013.01); *B65D 3/06* (2013.01); *B65D 21/0201* (2013.01);
(Continued)

(58) Field of Classification Search
CPC ..... B65D 25/20; B65D 21/0204; B65D 21/0201; B65D 81/3813; F25D 3/08; F25D 2331/804; F25D 3/06; A45C 11/20
(Continued)

(56) References Cited

U.S. PATENT DOCUMENTS 1,468,563 A 9/1923 Girard
2,627,993 A 2/1953 Hafner
(Continued)

FOREIGN PATENT DOCUMENTS

EP 3061704 A1 8/2016
WO 2004029526 A1 4/2004
(Continued)

OTHER PUBLICATIONS amazon.com, "Farberware 5190590 3-piece cutting board set," dated Jul. 23, 2011, downloaded from https ://www.amazon.com/Farberware-5190590-3-Piece-Plastic-Assorted/dp/80731KDNM P/ref=cm_cr_arp _d_product_top?e=UFT8 Mar. 11, 2019, 8 pages.
Yeti Coolers, "Tundra Cooler Divider," dated Mar. 11, 2014, downloaded from https://www.yeti.com/en_US/accessories/tundra-dividers/DV.html?cg id =accessories# Mar. 11, 2019, 9 pages.
(Continued)

*Primary Examiner* — Fenn C Mathew
*Assistant Examiner* — Jennifer Castriotta
(74) *Attorney, Agent, or Firm* — Cardinal Law Group

(57) ABSTRACT

A cooler assembly for the storage of one or more objects includes a cooler portion having a main portion and a cover portion that is removably or pivotable relative to the main portion. First and second main portion securement features are disposed on a side wall of the main portion, and the first and second main portion securement features may be identical. First and second attachment assemblies, which may include a container, have identical first and second attachment securement features, respectively, which may releaseably engage either of the first and second main portion securement features to allow the first and second attachment assemblies to be transported with and stored on the cooler portion.

20 Claims, 36 Drawing Sheets

(51) Int. Cl.

| | |
|---|---|
| ***F25D 3/08*** | (2006.01) |
| ***B65D 3/06*** | (2006.01) |
| ***B65D 81/38*** | (2006.01) |
| ***B65D 21/02*** | (2006.01) |
| *A47B 23/06* | (2006.01) |
| *A45C 11/20* | (2006.01) |

(52) U.S. Cl.
CPC ..... *B65D 21/0204* (2013.01); *B65D 81/3813* (2013.01); *F25D 3/08* (2013.01); *A45C 11/20* (2013.01); *A47B 23/06* (2013.01)

(58) Field of Classification Search
USPC ..... 220/23.4, 915, 23.83, 4.01, 4.27; 224/191, 269, 242
See application file for complete search history.

(56) References Cited

U.S. PATENT DOCUMENTS

| | | | |
|---|---|---|---|
| 3,395,550 | A | 8/1968 | Dungan |
| 3,850,398 | A | 11/1974 | Kantor |
| 3,868,829 | A | 3/1975 | Kemper |
| 3,939,986 | A | 2/1976 | Pierro |
| 4,024,731 | A | 5/1977 | Branscum |
| 4,213,310 | A | 7/1980 | Buss |
| D275,822 | S | 10/1984 | Gatland et al. |
| 4,515,421 | A | 5/1985 | Steffes |
| 4,560,128 | A | 12/1985 | Willeby et al. |
| RE32,740 | E | 8/1988 | Steffes |
| 4,841,661 | A | 6/1989 | Moore |
| 4,964,528 | A | 10/1990 | Wagoner |
| 4,988,216 | A | 1/1991 | Lyman |
| 5,052,185 | A | 10/1991 | Spahr |
| D325,323 | S | 4/1992 | Kahl |
| 5,103,884 | A | 4/1992 | Roman |
| D328,389 | S | 8/1992 | Pardo |
| D330,488 | S | 10/1992 | Daniels |
| 5,181,612 | A | 1/1993 | Liu |
| 5,285,656 | A | 2/1994 | Peters |
| D353,082 | S | 12/1994 | Keven |
| D354,419 | S | 1/1995 | Kahl et al. |
| 5,403,095 | A | 4/1995 | Melk |
| 5,605,056 | A | 2/1997 | Brown et al. |
| D387,249 | S | 12/1997 | Mogil |
| 5,816,432 | A | 10/1998 | Hammen et al. |
| 5,845,515 | A | 12/1998 | Nelson |
| 5,850,915 | A | 12/1998 | Tajima |
| D419,297 | S | 1/2000 | Richardson et al. |
| D419,767 | S | 2/2000 | Richardson et al. |
| D419,768 | S | 2/2000 | Richardson et al. |
| 6,039,202 | A | 3/2000 | Olstad et al. |
| D425,761 | S | 5/2000 | Philipson et al. |
| 6,065,873 | A | 5/2000 | Fowler |
| D435,196 | S | 12/2000 | Gregor et al. |
| 6,185,860 | B1 | 2/2001 | Thibodeaux |
| 6,193,097 | B1 | 2/2001 | Perianes |
| 6,244,458 | B1 | 6/2001 | Frysinger et al. |
| D444,683 | S | 7/2001 | Corrion |
| D451,765 | S | 12/2001 | Israel et al. |
| 6,328,179 | B1 | 12/2001 | Conrado et al. |
| D455,934 | S | 4/2002 | Culp et al. |
| 6,505,479 | B2 | 1/2003 | Defelice et al. |
| D472,384 | S | 4/2003 | Richardson |
| 6,595,687 | B2 | 7/2003 | Godshaw et al. |
| 6,751,963 | B2 | 6/2004 | Navedo et al. |
| D502,599 | S | 3/2005 | Cabana et al. |
| 6,895,778 | B1 | 5/2005 | Ackerman |
| D513,123 | S | 12/2005 | Richardson et al. |
| D514,808 | S | 2/2006 | Morine et al. |
| 6,993,931 | B1 | 2/2006 | Hamilton |
| D516,807 | S | 3/2006 | Richardson et al. |
| D527,226 | S | 8/2006 | Maldonado |
| D527,953 | S | 9/2006 | Gal |
| 7,140,507 | B2 | 11/2006 | Maldonado et al. |
| 7,296,433 | B2 | 11/2007 | Uihlein et al. |
| 7,389,608 | B1 | 6/2008 | MacKay |
| 7,415,794 | B1 * | 8/2008 | Thompson ..... A01K 97/22 206/315.11 |
| 7,682,080 | B2 | 3/2010 | Mogil |
| D635,832 | S | 4/2011 | Bergin |
| D637,044 | S | 5/2011 | Davis |
| 8,043,004 | B2 | 10/2011 | Mogil |
| 8,065,889 | B1 | 11/2011 | Silberman |
| 8,246,190 | B2 | 8/2012 | Boiteau et al. |
| D712,720 | S | 9/2014 | Seiders |
| D712,721 | S | 9/2014 | Seiders |
| D712,722 | S | 9/2014 | Seiders |
| D712,723 | S | 9/2014 | Seiders |
| D714,125 | S | 9/2014 | Seiders |
| 8,863,546 | B2 | 10/2014 | Oberweis |
| 8,910,819 | B2 | 12/2014 | Seiders |
| 8,925,752 | B2 | 1/2015 | Smith |
| D722,474 | S | 2/2015 | Seiders |
| D722,475 | S | 2/2015 | Seiders |
| D732,348 | S | 6/2015 | Seiders et al. |
| D732,349 | S | 6/2015 | Seiders et al. |
| D732,350 | S | 6/2015 | Seiders et al. |
| D732,899 | S | 6/2015 | Seiders et al. |
| 9,139,352 | B2 | 9/2015 | Seiders et al. |
| 9,187,232 | B2 | 11/2015 | Seiders |
| D752,347 | S | 3/2016 | Seiders et al. |
| 9,316,428 | B2 | 4/2016 | Mech |
| 9,389,010 | B1 | 7/2016 | Booker |
| 9,408,445 | B2 | 8/2016 | Mogil et al. |
| 9,433,200 | B2 | 9/2016 | Norman |
| 9,446,847 | B2 | 9/2016 | Richardson et al. |
| 9,500,400 | B2 | 11/2016 | Smith |
| 9,834,342 | B2 | 4/2017 | Seiders |
| D786,559 | S | 5/2017 | Seiders et al. |
| D786,560 | S | 5/2017 | Seiders et al. |
| D786,561 | S | 5/2017 | Seiders et al. |
| D786,562 | S | 5/2017 | Seiders et al. |
| D787,187 | S | 5/2017 | Seiders et al. |
| D797,454 | S | 9/2017 | Seiders et al. |
| D797,455 | S | 9/2017 | Seiders et al. |
| D798,670 | S | 10/2017 | Seiders et al. |
| D799,276 | S | 10/2017 | Seiders et al. |
| D799,277 | S | 10/2017 | Seiders et al. |
| D799,905 | S | 10/2017 | Seiders et al. |
| D801,123 | S | 10/2017 | Seiders et al. |
| 9,796,517 | B2 | 10/2017 | Seiders et al. |
| D802,373 | S | 11/2017 | Seiders et al. |
| D804,905 | S | 12/2017 | Seiders et al. |
| D805,851 | S | 12/2017 | Seiders et al. |
| D820,646 | S | 6/2018 | Yockey |
| D821,825 | S | 7/2018 | Sullivan et al. |
| 10,029,842 | B2 | 7/2018 | Seiders et al. |
| 10,092,137 | B1 | 10/2018 | Nelson et al. |
| 10,221,005 | B2 | 3/2019 | James |
| D850,865 | S | 6/2019 | Smith et al. |
| 10,351,330 | B2 | 7/2019 | Smith et al. |
| 10,392,180 | B1 | 8/2019 | Travis et al. |
| 10,443,918 | B2 | 10/2019 | Li et al. |
| 2003/0038138 | A1 | 2/2003 | Komurke |
| 2003/0141424 | A1 | 7/2003 | Thomas |
| 2004/0178208 | A1 | 9/2004 | Leba et al. |
| 2004/0238543 | A1 | 12/2004 | Askew |
| 2004/0262319 | A1 | 12/2004 | Fisher |
| 2005/0006268 | A1 | 1/2005 | Futernick |
| 2005/0133557 | A1 | 6/2005 | McKenzie et al. |
| 2005/0263527 | A1 | 12/2005 | Maldonado et al. |
| 2005/0279124 | A1 | 12/2005 | Maldonado |
| 2006/0180624 | A1 | 8/2006 | Sadow et al. |
| 2007/0137958 | A1 | 6/2007 | Hamlin |
| 2007/0278234 | A1 | 12/2007 | Mogil |
| 2008/0094853 | A1 | 4/2008 | Kim et al. |
| 2008/0260303 | A1 | 10/2008 | Lesseux et al. |
| 2009/0159471 | A1 | 6/2009 | Koppe |
| 2010/0072215 | A1 | 3/2010 | Coon |
| 2010/0287976 | A1 | 11/2010 | Roof et al. |
| 2011/0056233 | A1 | 3/2011 | Flaker et al. |
| 2011/0182532 | A1 | 7/2011 | Baltus |
| 2011/0203297 | A1 | 8/2011 | Oberweis |

(56) References Cited

U.S. PATENT DOCUMENTS

| | | | | |
|---|---|---|---|---|
| 2011/0220531 | A1 | 9/2011 | Meether et al. | |
| 2011/0289958 | A1 | 12/2011 | White et al. | |
| 2013/0264161 | A1 | 10/2013 | Thompson | |
| 2014/0013789 | A1 | 1/2014 | Conrad et al. | |
| 2015/0158539 | A1 | 6/2015 | Jensen et al. | |
| 2015/0210444 | A1 | 7/2015 | Mercado et al. | |
| 2015/0241107 | A1 | 8/2015 | Mech | |
| 2015/0369529 | A1 | 12/2015 | Monroe | |
| 2016/0101924 | A1 | 4/2016 | Mitchell et al. | |
| 2016/0257479 | A1 | 9/2016 | Seiders et al. | |
| 2016/0279840 | A1 | 9/2016 | French et al. | |
| 2016/0347507 | A1 | 12/2016 | Kendrick | |
| 2017/0001785 | A1 | 1/2017 | Ripley et al. | |
| 2017/0023289 | A1 | 1/2017 | Anderson | |
| 2017/0073146 | A1 | 3/2017 | Kuhn et al. | |
| 2017/0073147 | A1 | 3/2017 | Kuhn | |
| 2017/0233139 | A1 | 8/2017 | Averill | |
| 2017/0245486 | A1* | 8/2017 | Larson | A01K 97/10 |
| 2017/0305639 | A1 | 10/2017 | Kuhn et al. | |
| 2017/0350635 | A1 | 12/2017 | Thirumurugavel | |
| 2018/0015938 | A1 | 1/2018 | DeFrancia | |
| 2018/0141718 | A1* | 5/2018 | Ahlstrom | A45F 3/46 |
| 2018/0149400 | A1 | 5/2018 | Valencia | |
| 2018/0186550 | A1 | 7/2018 | Morine et al. | |
| 2018/0263346 | A1 | 9/2018 | Stephens | |
| 2018/0290814 | A1 | 10/2018 | Smith | |
| 2018/0346229 | A1 | 12/2018 | Guerdrum et al. | |
| 2018/0353379 | A1 | 12/2018 | Chou et al. | |
| 2019/0023480 | A1 | 1/2019 | Lin | |

FOREIGN PATENT DOCUMENTS

| | | | |
|---|---|---|---|
| WO | 2006007266 | A2 | 1/2006 |
| WO | 2006009537 | A1 | 1/2006 |
| WO | 2014105962 | A1 | 7/2014 |
| WO | 2016154105 | A1 | 9/2016 |

OTHER PUBLICATIONS

Pelican Consumer, Coolers—Hunting, Fishing, Camping, downloaded from http://www.pelican.com/us/en/products/coolers May 8, 2017, 2 pages.

RTIC, Cooler Accessories, downloaded May 8, 2017 from http://www.rticcoolers.com/shop/coolers/accessories, 14 pages.

Yeti Coolers, Tundra Cooler Divider, downloaded from www.yeti.com/tundra-dividers May 8, 2017, 4 pages.

Yeti Coolers, Tundra Ice Chests, downloaded from http://yeti.com/tundra May 8, 2017, 7 pages.

Yeti Coolers, Yeti Accessories & Parts, downloaded from http://yeti.com/accessories May 8, 2017, 5 pages.

Digital Trends, "The new Venture coolers from Otterbox . . . ", Posted May 9, 2017.(https://www.digitaltrends.com/outdoors/otterbox-venture-coolers/).

OtterBox, "Rugged Venture Coolers", Accessed Jan. 16, 2018. (https://www.otterbox.com/en-us/venture-coolers.html).

Pelican Products, "70QT Cooler", Accessed Jan. 16, 2018. (http://www.pelican.com/us/en/product/outdoor-heavy-dutycoolers/elite-cooler/cooler/70QT/).

The Cooler Box, "Cordova Coolers vs Yeti—Is This New Cooler Better Than Yeti?", Published Oct. 24, 2016.(http://thecoolerbox.com/cordova-coolers-vs-yeti/).

* cited by examiner

FOOD AND BEVERAGE COOLER ASSEMBLY

CROSS-REFERENCE TO RELATED APPLICATIONS

This application claims priority to U.S. application Ser. No. 15/398,468 filed Jan. 4, 2017, the contents of which are hereby incorporated by reference.

FIELD OF THE DISCLOSURE

This disclosure relates generally to a cooler for storing objects, such as food and/or beverages.

BACKGROUND

When participating in many leisure activities, it is often desired to bring along food or beverages for consumption before, during, and/or after the activity. Often, the food may be perishable and the ambient temperature may be high (for instance, at a beach location), so it is desired to keep the perishable food in a temperature-controlled environment to avoid spoiling. Similarly, beverages (such as canned beverages) may also be consumed, and it is desired to keep such beverages cool until consumption. Typically, a cooler may be used to transport the food and beverages while maintaining them in a temperature-controlled environment. The cooler typically has a main portion and a cover portion removably secured to the main portion, and the main portion has side walls and a bottom wall that may be insulated. Ice and/or cooling packs may be placed in an interior portion of the cooler defined by the side walls and bottom wall to keep the interior portion of the cooler at a desired temperature that is lower than the ambient temperature.

Typically, all food and beverage items are placed in the interior portion of the cooler, where they are subjected to the same bed of ice and/or cooling packs, and therefore all items are maintained at approximately the same temperature. In addition, the food and beverage items may tend to shift during transport of the cooler, making the interior portion disorganized and obscuring the type of items in the interior portion. There is therefore a need to organize items in a cooler to simplify identification of the items and maintain order in the interior portion of the cooler.

Often, items are also transported along with the cooler that are related to the activity and/or consumption of the foods and beverages in the interior portion of the cooler. For example, bottle openers, napkins, utensils, tongs, cups, radios, speakers, etc. may be transported to the leisure activity with the cooler. However, these additional items are often gathered prior to the activity and may be forgotten when departing for the activity. In addition, the items may be left in a vehicle that is remote from the leisure activity and cooler, resulting in time wasted to retrieve the items left behind. Moreover, due to the haphazard nature in which the items are transported from a vehicle to a final location for the leisure activity, items could be dropped or lost along the way. Accordingly, there is a need for a cooler assembly that provides accessories (such as containers for items) that can be removably and reliably secured to the cooler such that items can be stored with the cooler and will not be lost or misplaced prior to their use.

BRIEF SUMMARY OF THE DISCLOSURE

A cooler assembly for the storage of one or more objects includes a cooler portion, and the cooler portion has a main portion having side walls having one or more interior surfaces that cooperate to at least partially define an interior portion that is adapted to receive the one or more objects. One or more exterior surfaces of the side walls of the main portion define an exterior portion of the main portion. The cooler portion also includes a cover portion at least one of pivotably coupled to or removably secured to the main portion, and when the cover portion is in a closed position relative to the main portion, one or more interior surfaces of the cover portion cooperate to at least partially define the interior portion. The cover portion may also include a contact area that may extend along a portion of one or more exterior surfaces of the cover portion, and a label may extend over all or a portion of the contact area of the cover portion and be inmolded with the all or a portion of the contact area of the cover portion. The cooler portion additionally includes a first main portion securement feature disposed at a first location on at least one of the one or more side walls of the main portion. The cooler portion further includes a second main portion securement feature disposed at a second location on at least one of the one or more side walls of the main portion, and the first main portion securement feature is identical to the second main portion securement feature. The cooler assembly may also include a first attachment assembly, the first attachment assembly having a first attachment securement feature adapted to releaseably engage the first main portion securement feature or the second main portion securement feature to removably secure the first attachment assembly to at least one of the one or more side walls of the main portion. The cooler assembly may also include a second attachment assembly, the second attachment assembly having a second attachment securement feature adapted to releaseably engage the first main portion securement feature or the second main portion securement feature to removably secure the second attachment assembly to at least one of the one or more side walls of the main portion. The cooler assembly may further include a cover attachment portion removably secured to one or more portions of the cover portion, the cover attachment portion including a support portion extending from a first end to a second end, and a cushion portion coupled to the support portion.

DETAILED DESCRIPTION

Figure 1:
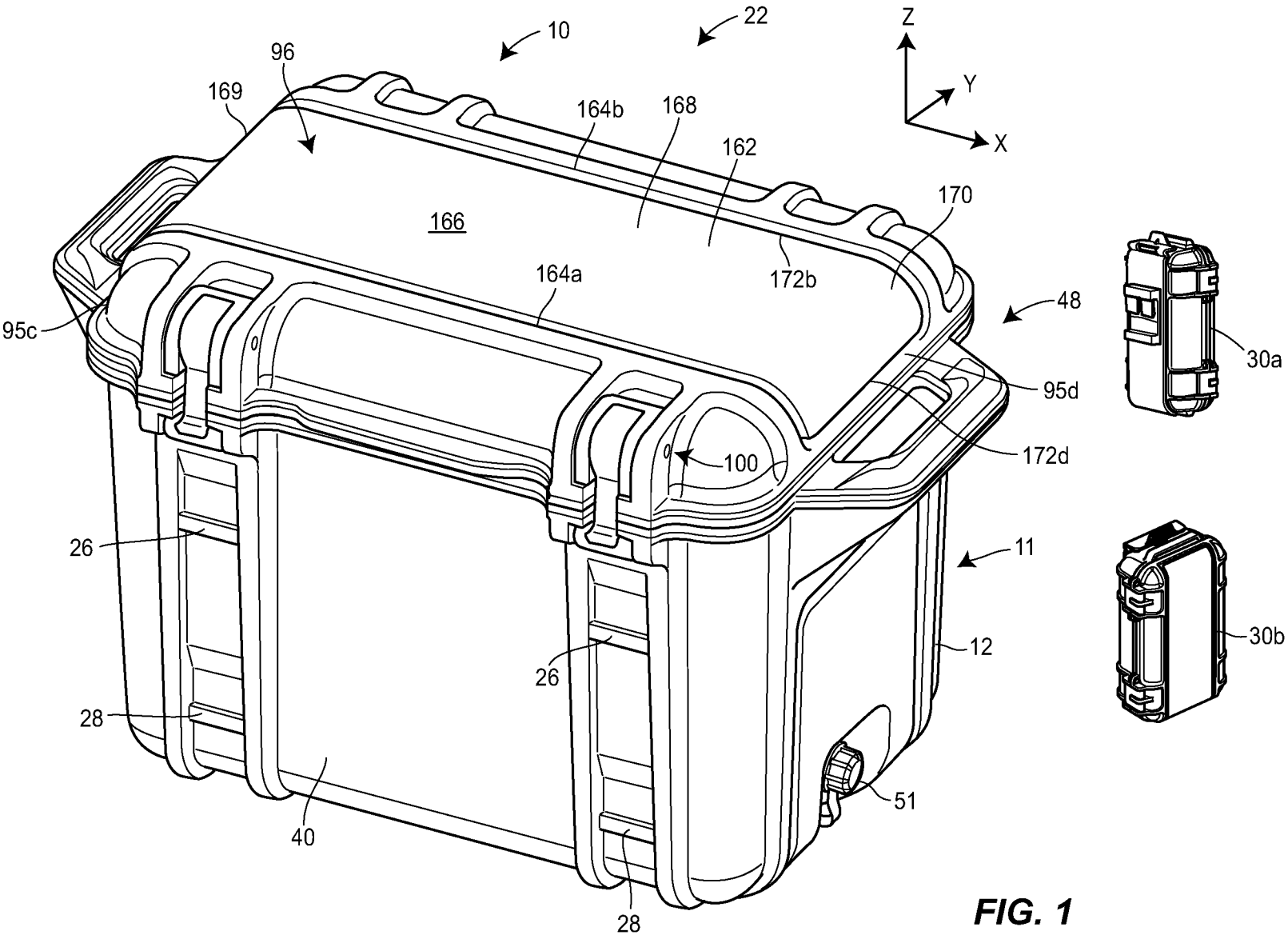
FIG. 1 is a perspective view of an embodiment of a cooler assembly.
Figure 7A:
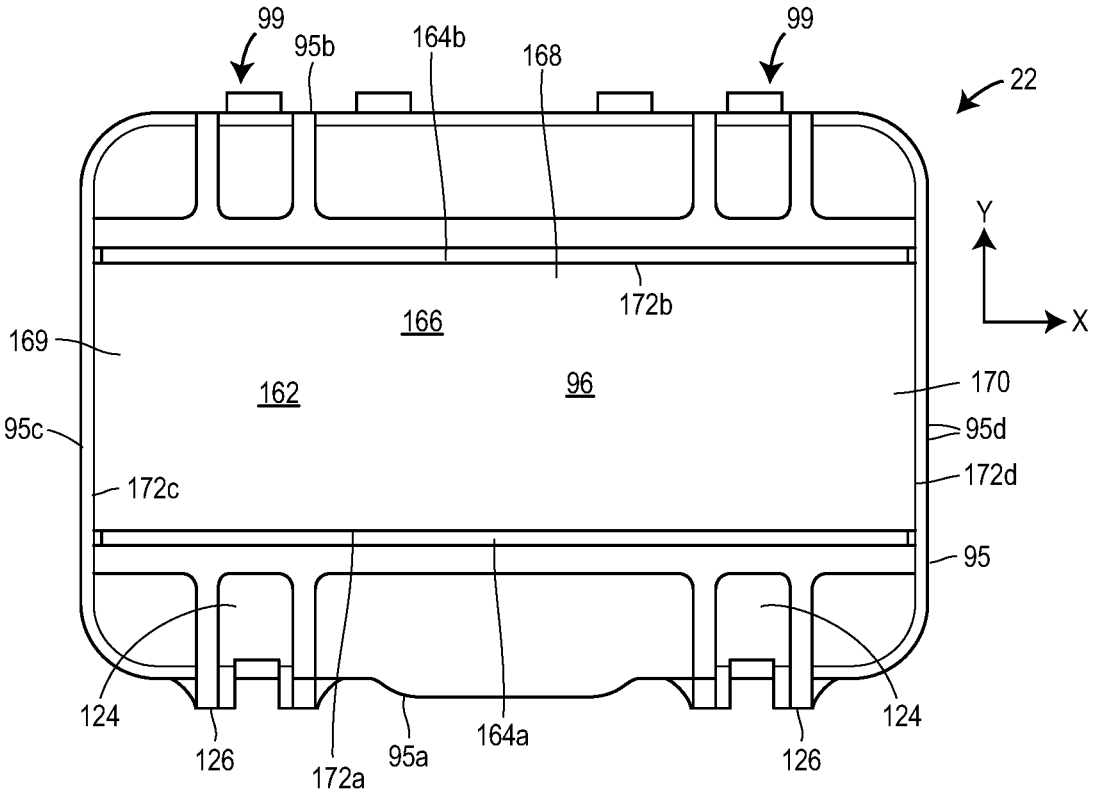
FIG. 7A is a top view of an embodiment of a cover portion of the cooler portion of the cooler assembly.

FIG. 1 illustrates a perspective view of a cooler assembly 10 that includes a cooler portion 11 having a main portion 12 and a cover portion 22. As shown in the perspective view of an embodiment of the main portion 12 illustrated in FIG. 2A, the main portion 12 may have one or more side walls 40 having one or more interior surfaces 14 that cooperate to at least partially define an interior portion 16 that is adapted to receive the one or more objects (not shown). Referring again to FIG. 1, the one or more side walls 40 of the main portion 12 may also include one or more exterior surfaces 18 that may define an exterior portion 20 of the main portion 12 or the cooler portion 11. The cover portion 22 of the cooler portion 11 may be at least one of pivotably coupled to or removably secured to the main portion 12. When the cover portion 22 is in a closed position relative to the main portion 12, as illustrated in FIG. 1, one or more interior surfaces 24 of the cover portion 22 (shown in a bottom view of an embodiment of the cover portion 22 in FIG. 7B) may cooperate to at least partially further define the interior portion 16. Referring to FIG. 7A, the cover portion 22 may also include a contact area 166 that may extend along a portion of one or more exterior surfaces 96 of the cover portion 22, and a label 162 may extend over all or a portion of the contact area 166 of the cover portion 22 and be inmolded with the all or a portion of the contact area 166 of the cover portion 22.

As illustrated in FIG. 1, the cooler portion 11 may also include a first main portion securement feature 26 disposed at a first location on at least one of the one or more side walls 40 of the main portion 12. The cooler portion 11 may additionally include a second main portion securement feature 28 that may be disposed at a second location on at least one of the one or more side walls 40 of the main portion 12, and the first main portion securement feature 26 may be identical or substantially identical to the second main portion securement feature 28.

Figure 4A:
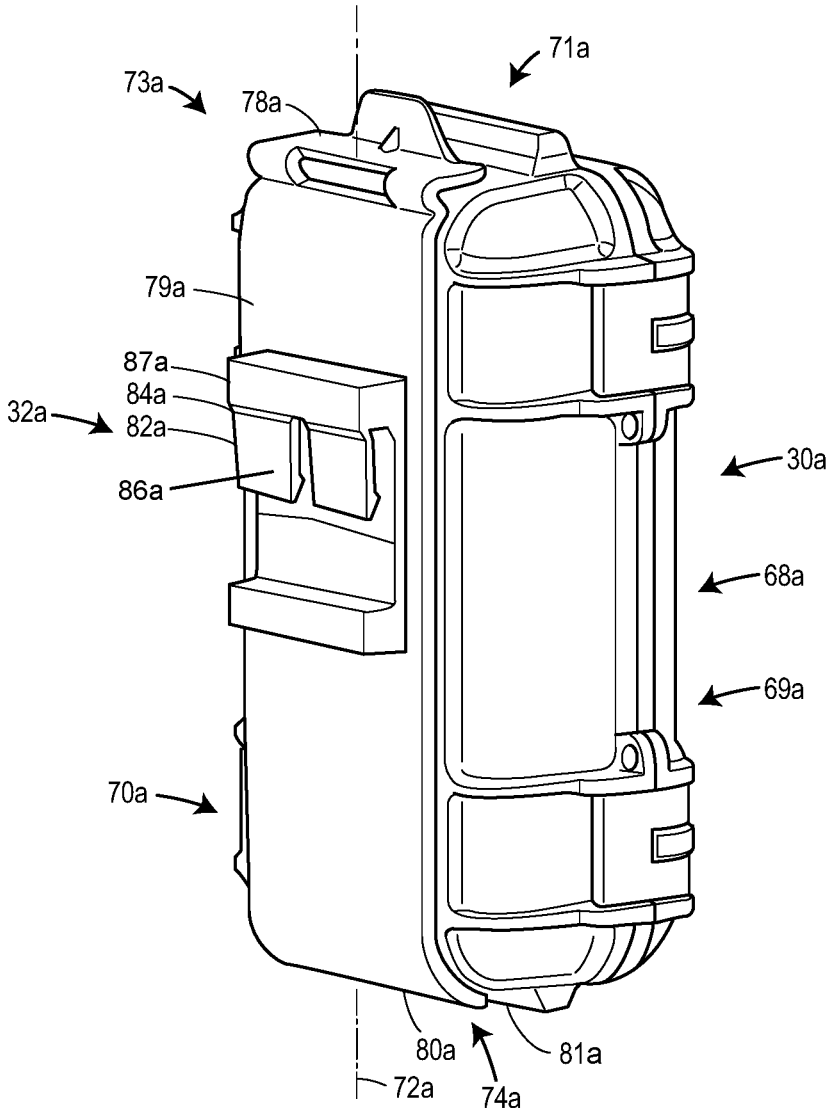
FIG. 4A is a perspective view of an embodiment of the first attachment assembly.
Figure 5:
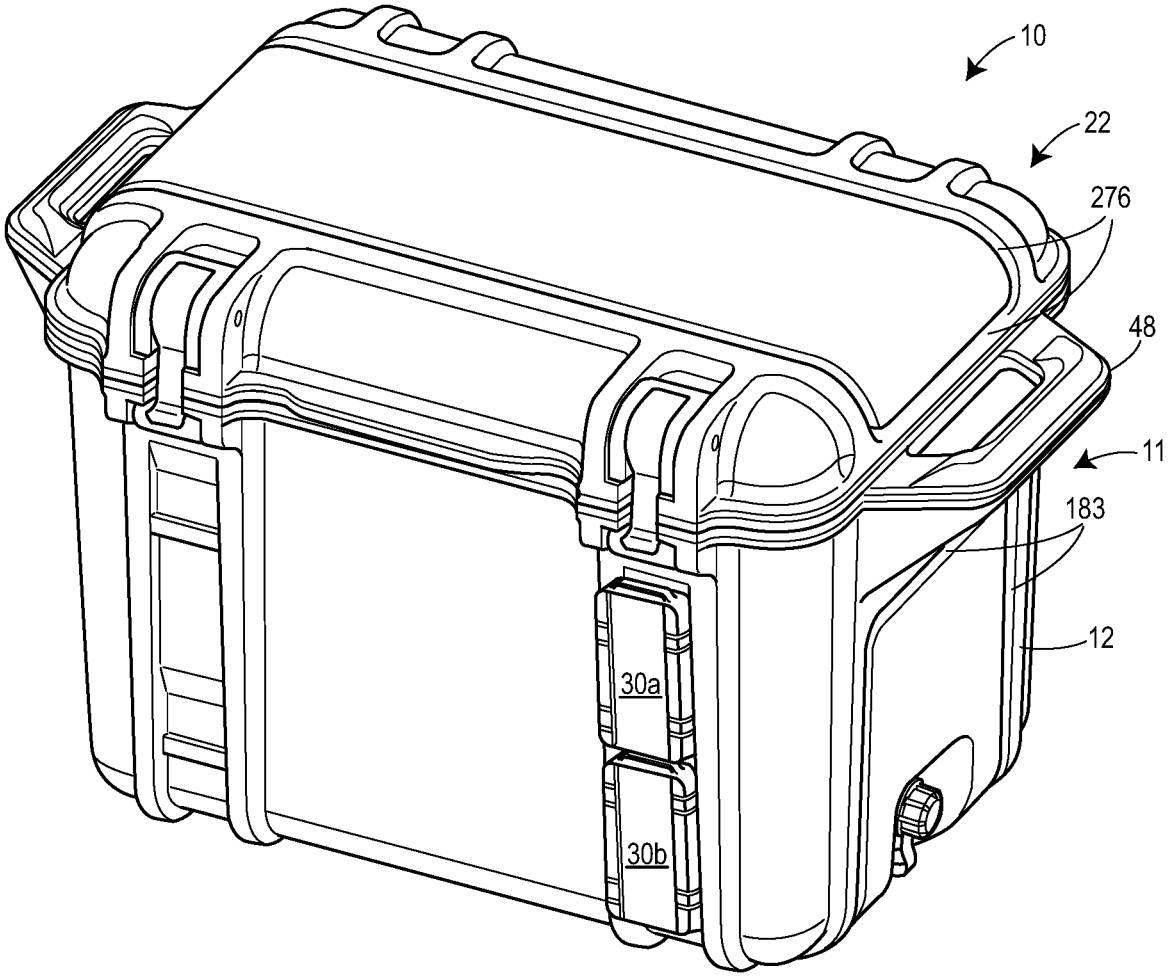
FIG. 5 is a perspective view of the cooler assembly with the first attachment assembly secured to the first main portion securement feature and the second attachment assembly secured to the second main portion securement feature.
Figure 6:
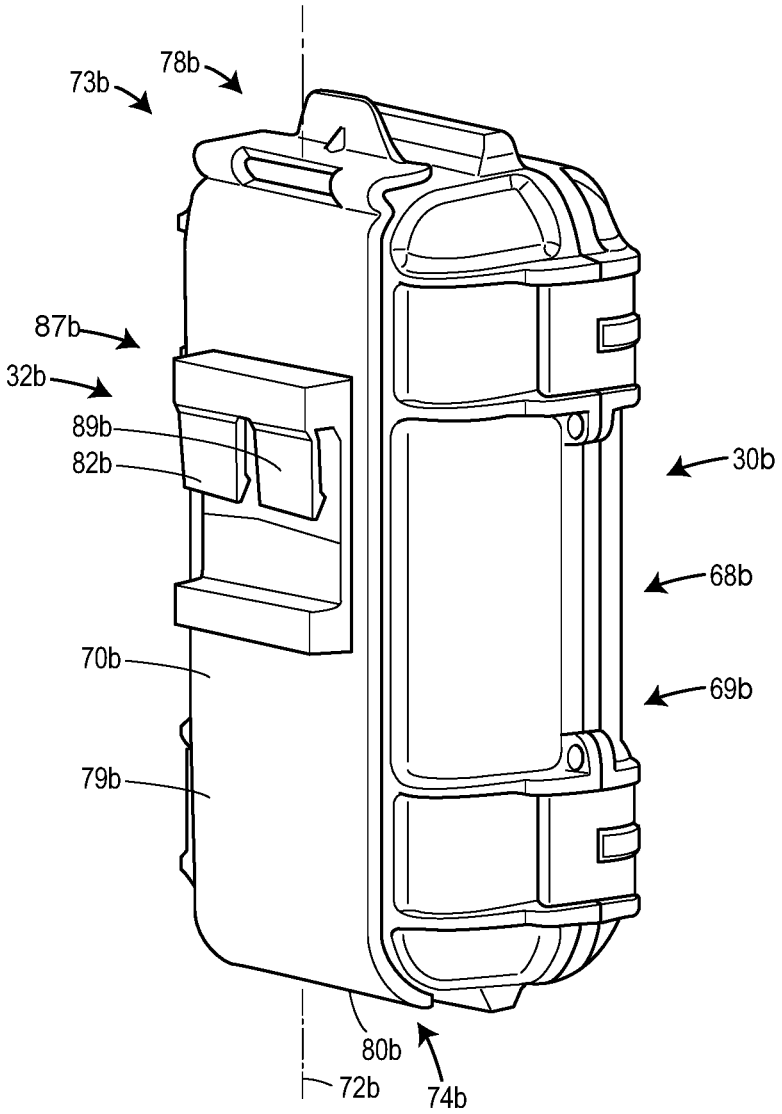
FIG. 6 is a perspective view of an embodiment of the second attachment assembly.

As illustrated in FIG. 5, which illustrates a perspective view of the cooler assembly 10, the cooler assembly 10 may further include a first attachment assembly 30*a*. As shown in FIG. 4A, which provides a perspective view of the first attachment assembly 30*a*, the first attachment assembly 30*a* has a first attachment securement feature 32*a* that releaseably engages (or is adapted to releaseably engage) the first main portion securement feature 26 or the second main portion securement feature 28 to removably secure the first attachment assembly 30*a* to one or more exterior surfaces 18 of the main portion 12 of the cooler portion 11, as illustrated in FIG. 5. Referring again to FIG. 1, the cooler assembly 10 may additionally include a second attachment assembly 30*b*. As shown in FIG. 6, which provides a perspective view of the second attachment assembly 30*b*, the second attachment assembly 30*b* may have a second attachment securement feature 32*b* that releaseably engages (or is adapted to releaseably engage) the first main portion securement feature 26 or the second main portion securement feature 28 to removably secure the second attachment assembly 30*b* to one or more exterior surfaces 18 of the main portion 12 of the cooler portion 11, as illustrated in FIG. 5. The first attachment securement feature 32*a* may be identical or substantially identical to the second attachment securement feature 32*b*.

So configured, the cooler portion 11 (and the cooler assembly 10) may be used as a conventional "cooler" to keep food and beverages stored in the interior portion 16 cool relative to a high (or moderately high) ambient temperature on the exterior portion 20. However, it is contemplated that the cooler portion 11 (and the cooler assembly 10) may have any other suitable use or application in which some measure of insulation or temperature stability is desired. For example, the cooler portion 11 (and the cooler assembly 10) may be used to keep food and beverages stored in the interior portion 16 warm or hot relative to a low or moderately low ambient temperature on the exterior portion 20. In other examples, the cooler portion 11 (and the cooler assembly 10) may be used to keep items that are not foods or beverages (such as temperature sensitive pharmaceuticals or tissues) stored in the interior portion 16 at a desired temperature (e.g., cool, warm, or hot) relative to an ambient temperature on the exterior portion 20.

Also as configured, the first attachment assembly 30*a* having the first attachment securement feature 32*a* and the second attachment assembly 30*b* having the second attachment securement feature may be removably secured to either of the first main portion securement feature 26 or the second main portion securement feature 28 to allow the first attachment assembly 30*a* and/or the second attachment assembly 30*b* to be quickly, conveniently, and reliably coupled and uncoupled to the cooler portion 11 in a manner that will be described in more detail below.

In other examples, the cooler portion 11 (and the cooler assembly 10) may be used as a storage container that is not necessarily utilized for maintaining the temperature of its contents. For example, the cooler portion 11 (and the cooler assembly 10) may be used to store one or more items to protect them from the elements, to protect them from water, to protect them from dust, to protect them from snow, to protect them from impact, to protect them from shock, to protect them from chemicals, to secure them from theft, and/or to control access to the one or more items. In these applications, the wall thickness of the cooler portion 11 may be thinner than the wall thickness of insulating embodiments. Further, in these applications, other features may be modified such as, for example, reducing or eliminating insulating materials in the walls and/or eliminating spout member 51.

Figure 2A:
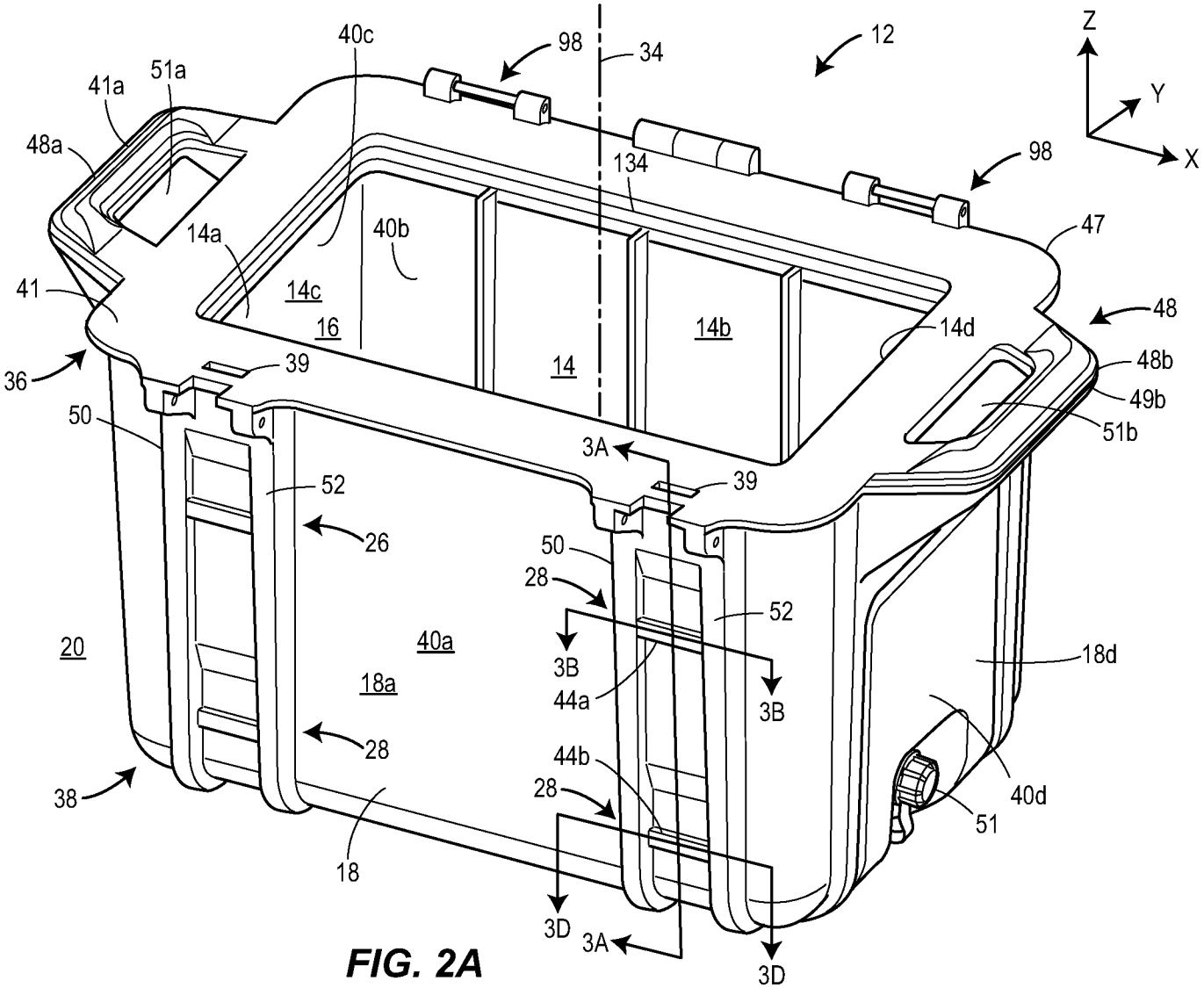
FIG. 2A is a perspective view of an embodiment of a main portion of a cooler portion of an embodiment of a cooler assembly.
Figure 2B:
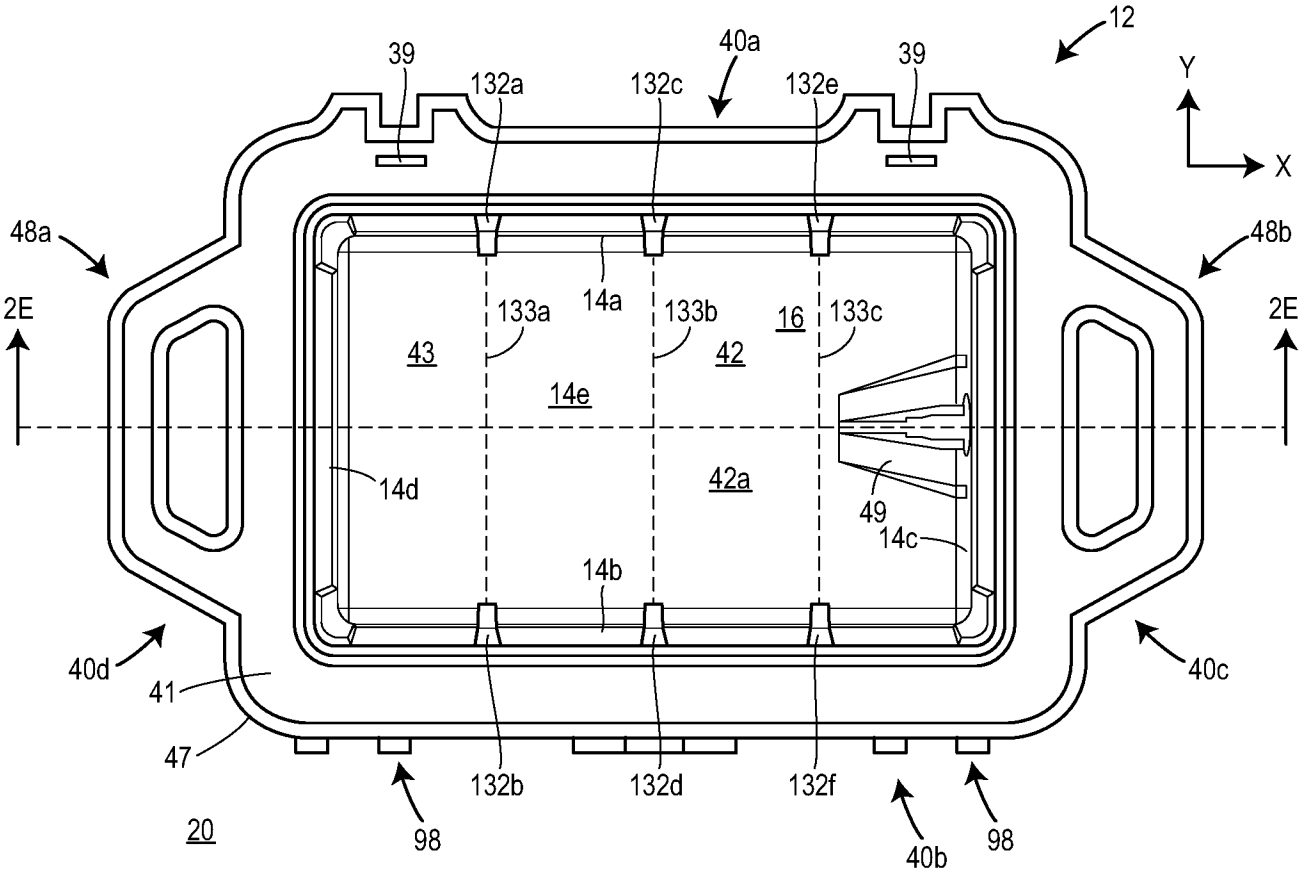
FIG. 2B is a top view of the embodiment of the main portion of FIG. 2A.

Turning to the cooler assembly 10 in more detail, and with reference to FIG. 2A, the main portion 12 of the cooler portion 11 may extend along a main portion axis 34 from a first end 36 of the main portion 12 to a second end 38 of the main portion 12. In some embodiments, the main portion axis 34 may extend in a direction parallel to the Z-axis of the reference coordinate system of FIG. 2A, and the main portion axis 34 may be disposed in a vertical orientation such that the cooler portion 11 is upright when in use. The main portion 12 may include one or more side walls 40 that may each extend in a direction generally along the main portion axis 34 from the first end 36 to the second end 38. The one or more side walls 40 may be defined by one or more of the one or more interior surfaces 14 and by one or more of the one or more exterior surfaces 18. In some embodiments, the main portion 12 may include one or more bottom walls 42 that may extend between the one or more side walls 40 at the second end 38 of the main portion 12. As illustrated in the top view of the main portion 12 illustrated in FIG. 2B, the one or more bottom walls 42 may include one or more interior surfaces 43 that may cooperate to further define the interior portion 16. In some embodiments, the one or more bottom walls 42 may extend normal (or substantially normal) to the main portion axis 34. As illustrated in FIG. 2B, a recess 49 may be defined in one or more interior surfaces 43 to channel liquids or beverages stored in the interior portion 16 through a spout member 51 (illustrated in FIG. 1).

Figure 7B:
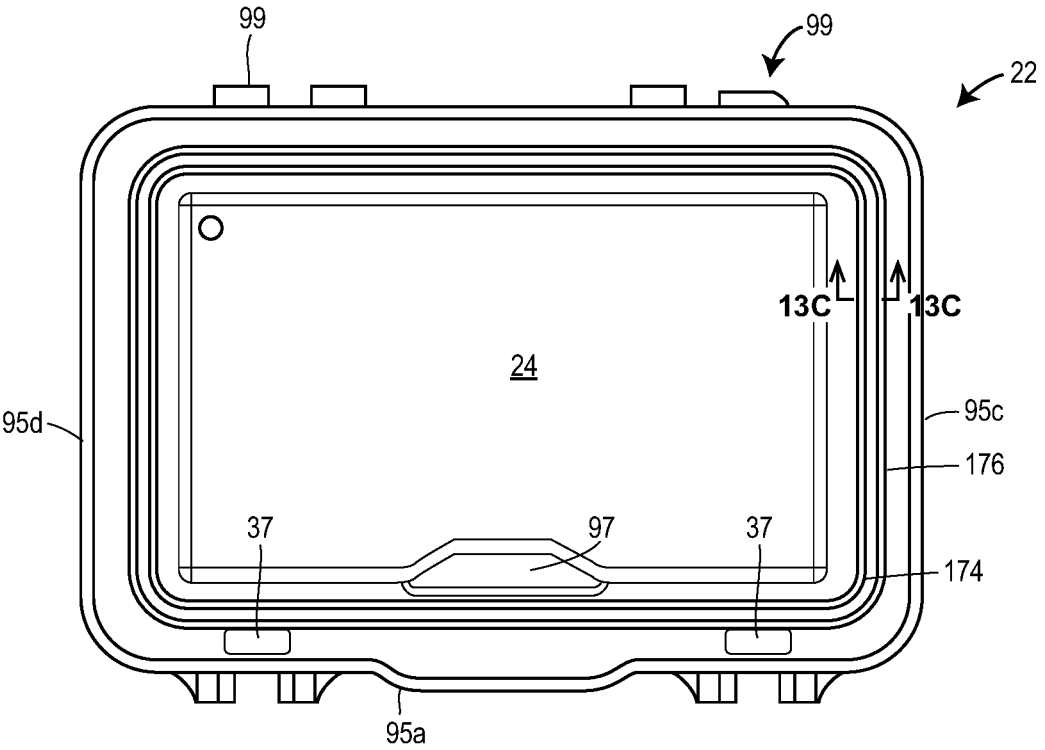
FIG. 7B is a bottom view of the embodiment of the cover portion 22 of FIG. 7A.
Figure 8:
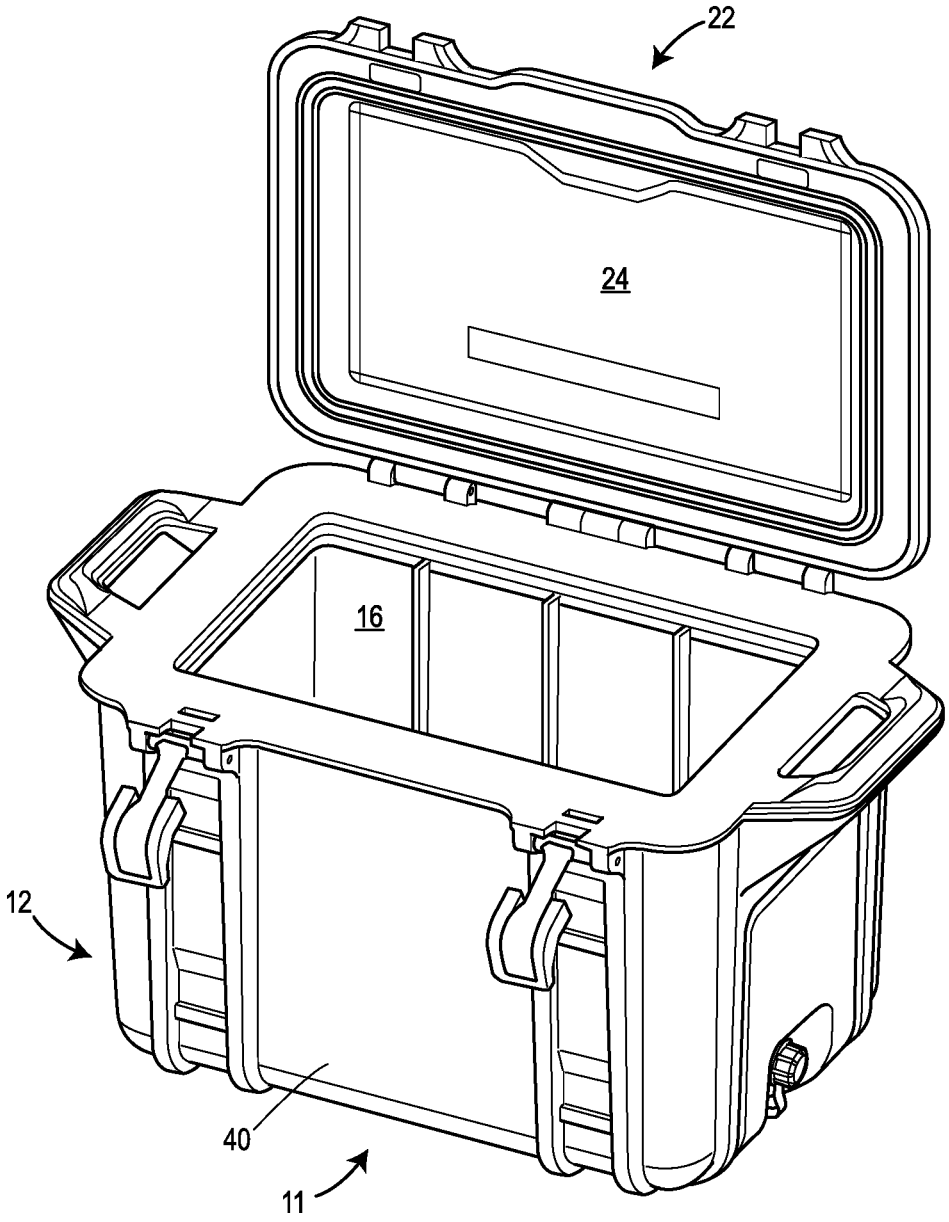
FIG. 8 is a perspective view of an embodiment of the cooler portion having the cover portion in the open position.

So configured, and as illustrated in FIG. 2A, the one or more side walls 40 and one or more bottom walls 42 may provide an open first end 36 of the main portion 12 to allow objects to be placed into the interior portion 16 when the cover portion 22 is not secured to the main portion 12 (or if the cover portion 22 is rotated into an open position if the cover portion 22 is pivotably coupled to the main portion 12, as illustrated in the embodiment of the cooler portion 11 shown in FIG. 8). As illustrated in FIG. 2A, the main portion 12 may include an upper surface 41 that may extend along the open first end 36 of the main portion 12, and the upper surface 41 may extend between the one or more interior surfaces 14 and the one or more exterior surfaces 18 of the one or more side walls 40. The upper surface 41 may have any suitable shape, and the upper surface 41 may be planar or substantially planar. The upper surface 41 may provide a surface in which a bottom portion of the cover portion 22 may engage when the cover portion 22 is in the closed position of FIG. 1. As illustrated in FIG. 2A, one or more protrusions 39 may be disposed on the upper surface 41, and each protrusion 39 is adapted to be disposed in a corresponding recess 37 in the cover portion 22 (see FIG. 7B) to maintain proper alignment of the cover portion 22 relative to the main portion 12 when the cover portion 22 is in the closed position of FIG. 1.

Figure 2D:
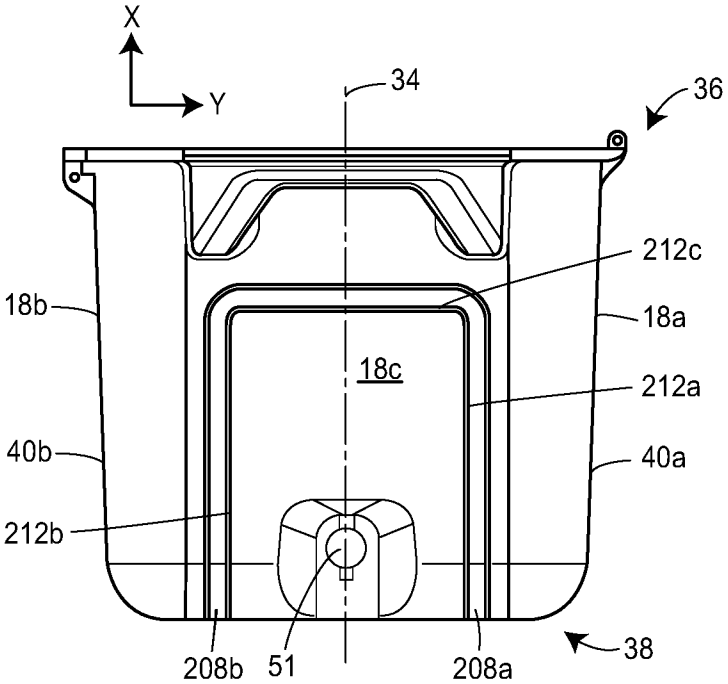
FIG. 2D is a side view of the embodiment of the main portion of FIG. 2A.

In some embodiments, the one or more side walls 40 of the main portion 12 may include four side walls 40 that may form or cooperate to form a rectangular (or generally rectangular) shape when viewed along the main portion axis 34, as illustrated in FIG. 2B. More specifically, the one or more side walls 40 may include a first side wall 40*a* and a second side wall 40*b* offset from the first side wall 40*a* in a direction parallel to the Y-axis of the reference coordinate system of FIG. 2B. The one or more side walls 40 may further include a third side wall 40*c* and a fourth side wall 40*d* offset from the third side wall 40*c* in a direction parallel to the X-axis of the reference coordinate system of FIG. 2B. The first side wall 40*a* and the second side wall 40*b* may be parallel or may converge from the first end 36 to the second end 38, as illustrated in the side view of the main portion 12 provided in FIG. 2D. The third side wall 40*c* and the fourth side wall 40*d* may be parallel or may converge from the first end 36 to the second end 38, as illustrated in the front view of the main portion 12 provided in FIG. 2C. The one or more bottom walls 42 may include a first bottom wall 42*a* that may extend in a direction generally parallel to the X-Y plane of the reference coordinate system of FIG. 2B. As illustrated in FIG. 2B, the first bottom wall 42*a* may extend from the first side wall 40*a*, the second side wall 40*b*, the third side wall 40*c*, and the fourth side wall 40*d* at the second end 38 of the main portion 12.

Figure 2C:
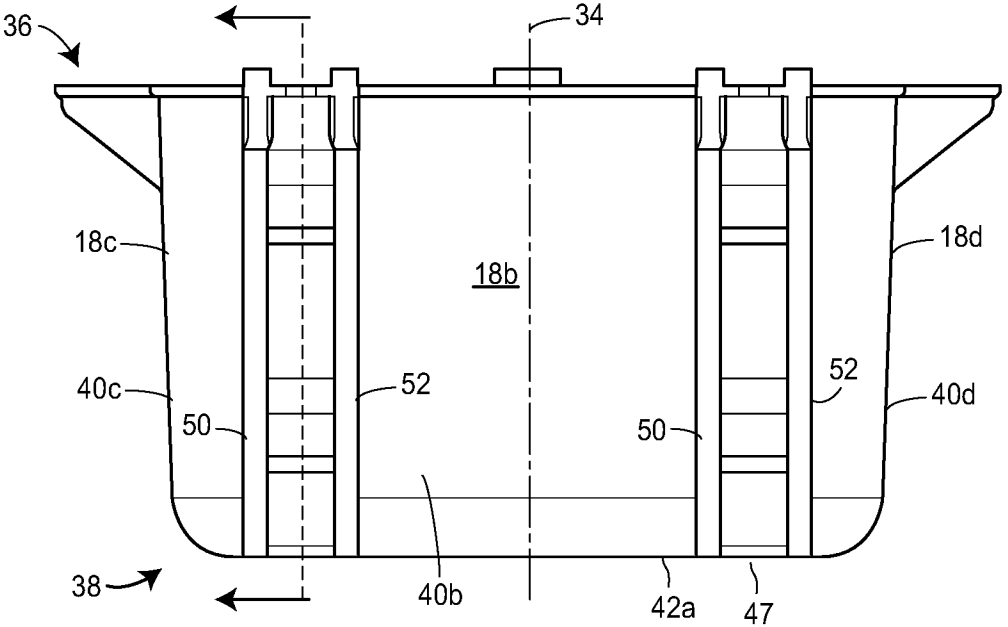
FIG. 2C is a front view of the embodiment of the main portion of FIG. 2A.

Still referring to FIG. 2B, the first side wall 40*a*, the second side wall 40*b*, the third side wall 40*c*, and the fourth side wall 40*d* may each have a corresponding first side wall interior surface 14*a*, second side wall interior surface 14*b*, third side wall interior surface 14*c*, and fourth side wall interior surface 14*d* that cooperate to define a portion of the interior portion 16. The interior portion 16 may be further defined by a first bottom wall interior surface 14*e* of the first bottom wall 42*a*. As illustrated in FIGS. 2A and 2C, the first side wall 40*a*, the second side wall 40*b*, the third side wall 40*c*, and the fourth side wall 40*d* may each have a corresponding first side wall exterior surface 18*a*, second side wall exterior surface 18*b*, third side wall exterior surface 18*c*, and fourth side wall exterior surface 18*d*, respectively, that cooperate to define a portion of the exterior portion 20 that is outside of the interior portion 16.

In further embodiments, the one or more side walls 40 may have any number of side walls 40 to cooperate to form any suitable shape or combination of shapes when viewed normal to the main portion axis 34. For example, the one or more side walls 40 may cooperate to form a circular shape (not shown), a triangular shape (not shown), an oval shape (not shown), or a polygonal shape having five or more side walls 40 (not shown). In addition, the one or more bottom walls 42 may have any suitable shape or combination of shapes, such as a partially spherical shape (not shown) or an undulating, sinusoidal shape (not shown), for example.

The one or more side walls 40 and the one or more bottom walls 42 (and the one or more interior surfaces 24 of the cover portion 22 illustrated in FIG. 7B) may be positioned and dimensioned to at least partially define an interior portion 16 having any suitable volume. For example, the interior portion 16 may define a volume of 25 quarts, 45 quarts, or 65 quarts.

Figure 2E:
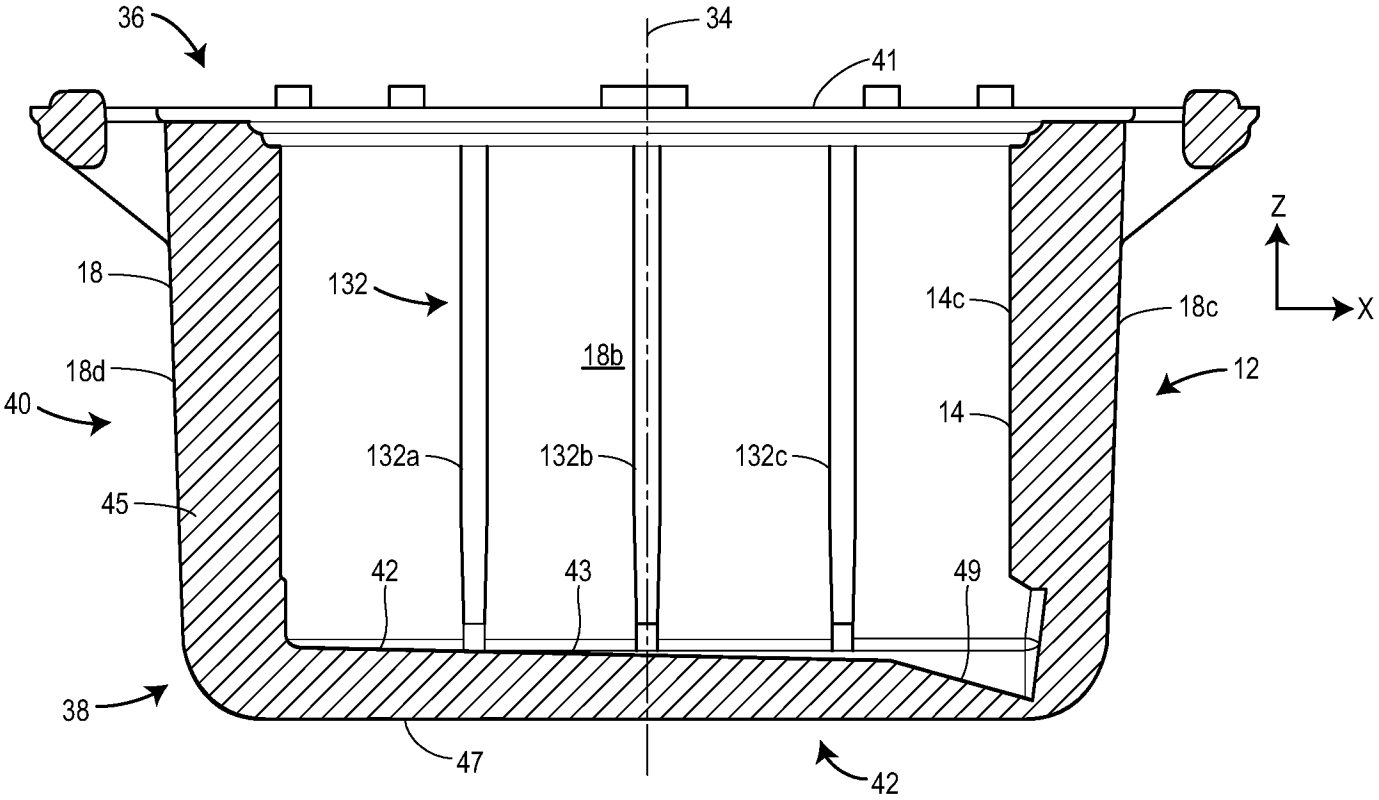
FIG. 2E is a side cross-sectional view of the embodiment of the main portion of FIG. 2A taken along section lines 2E-2E of FIG. 2B.

As illustrated in FIG. 2E, which is a side cross-sectional view of the main portion 12 along section lines 2E-2E of FIG. 2B, the one or more side walls 40 may include one or more insulation materials 45 between the one or more interior surfaces 14 and the one or more exterior surfaces 18. The one or more bottom walls 42 may also include one or more insulation materials 45 between the one or more interior surfaces 43 and one or more exterior surfaces 47 of the bottom walls 42. However, in some embodiments, the one or more side walls 40 may be solid such that no space exists between the one or more interior surfaces 14 and the one or more exterior surfaces 18. Such embodiments of the one or more side walls 40 may result when the main portion 12 (or the one or more side walls 40 of the main portion 12) are made or fabricated by an injection molding process.

The one or more insulation materials 45 may be any suitable insulating material or substance or combination of insulating materials or substances. For example, the one or more insulation materials 45 may include a foam material, an expanding foam material, a fiber material and/or a fluid material. In other examples, the one or more insulation materials 45 may include a vacuum existing or created between the one or more interior surfaces 14 and the one or more exterior surfaces 18 of any or all of the one or more side walls 40 and/or between the one or more interior surfaces 43 and one or more exterior surfaces 47 of the one or more bottom walls 42. The one or more insulation materials 45 may allow the cooler portion 11 to maintain objects disposed within the interior portion 16 (see FIG. 2A) at a temperature that is less than an ambient temperature on the exterior portion 20 of the cooler portion 11. However, the one or more insulation materials 45 may allow the cooler portion 11 may also allow the cooler portion 11 to maintain objects disposed within the interior portion 16 (see FIG. 2A) at a temperature that is greater than an ambient temperature on the exterior portion 20 of the cooler portion 11. In some embodiments, the cooler portion 11 may maintain objects disposed within the interior portion 16 (see FIG. 2A) at a temperature that is greater or less than an ambient temperature on the exterior portion 20 of the cooler portion 11 without the need for one or more insulation materials 45.

Figure 16:
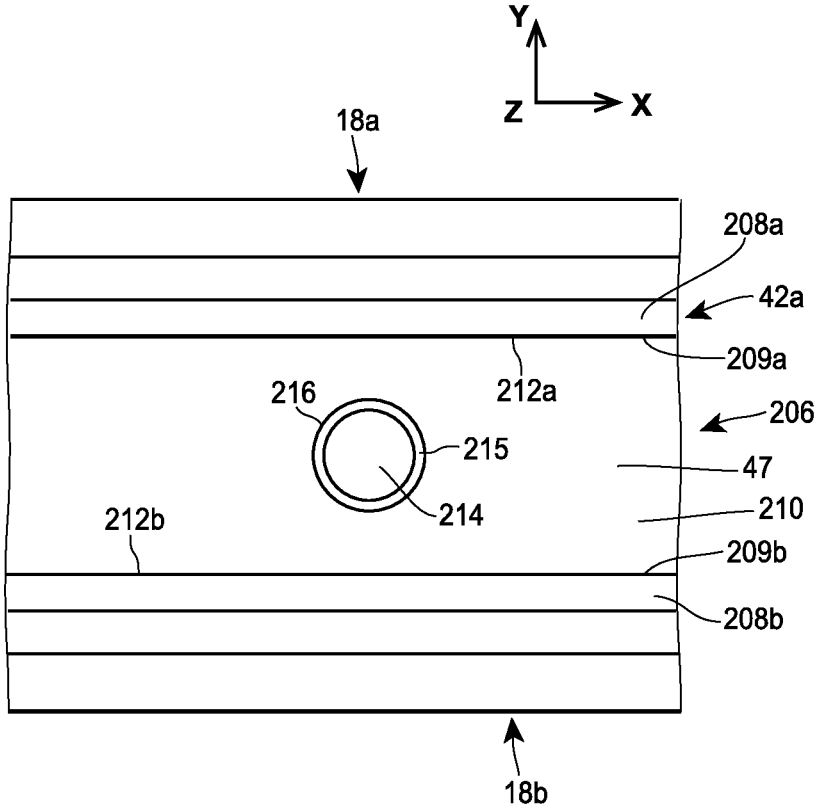
FIG. 16 is a partial view of an embodiment of a first bottom wall of the main portion.

Referring to FIG. 16, which is a partial view of the first bottom wall 42*a* of the main portion 12 (see also FIG. 2C), a bottom contact area 206 may be disposed on at least a portion of the first bottom wall 42*a* (or a portion of the exterior surface 47 of the first bottom wall 42*a*). The bottom contact area 206 may also extend along a portion of any or all of the first side wall exterior surface 18*a* (see FIG. 2D), the second side wall exterior surface 18*b* (see FIGS. 2C and 2D), the third side wall exterior surface 18*c* (see FIGS. 2C and 2D), and the fourth side wall exterior surface 18*d* (see FIG. 2D). In some embodiments, the bottom contact area 206 may extend along the first bottom wall 42*a* from the third side wall exterior surface 18*c* to the fourth side wall exterior surface 18*d*, and the contact area 206 may extend upwards along a portion of the third side wall exterior surface 18*c* and upwards along a portion of the fourth side wall exterior surface 18*d*.

The bottom contact area 206 may be disposed between a first bottom groove 208*a* and a second bottom groove 208*b* that may extend along a first lateral edge 209*a* and a second lateral edge 209*b* defining the bottom contact area 206, and the first bottom groove 208*a* and the second bottom groove 208*b* may each downwardly extend from the bottom contact area 206. The first lateral edge 209*a* and the second lateral edge 209*b* defining the bottom contact area 206 may be parallel (when viewed along the Z-axis of the Reference Coordinate System of FIG. 16) and may each extend along or generally along the X-axis of the Reference Coordinate System of FIG. 16. The first bottom groove 208*a* and the second bottom groove 208*b* may also extend along portions of the first lateral edge 209*a* and the second lateral edge 209*b* of the bottom contact area 206 that correspond to the third side wall exterior surface 18*c* and the fourth side wall exterior surface 18*d*, respectively. At least a portion of the bottom contact area 206 may be planar or substantially planar. However, because one or more of the third side wall exterior surface 18*c* and the fourth side wall exterior surface 18*d* of the main portion 12 may be at least partially contoured, at least a portion of the bottom contact area 206 may also be contoured.

A gate feature 214 may be disposed on the first bottom wall 42*a* in any suitable location, and the gate feature 214 may be disposed in or on the bottom contact area 206. The gate feature 214 may be adapted to be adjacent to a gate of a mold used to make or fabricate at least a portion of the main portion 12. The gate feature 214 may be circular to facilitate the even spread of the injected plastic away from the gate of the injection mold during molding. In some embodiments, the gate feature 214 may be surrounded by a gate groove 215 that may downwardly extend into the first bottom wall 42*a* (or the bottom contact area 206).

In some embodiments, as illustrated in FIG. 16, the main portion 12 may include a label 210 that may extend over all or a portion of the bottom contact area 206. In some embodiments, the label 210 may have a first edge 212*a* that is aligned with (i.e., parallel to) the first lateral edge 209*a* of the bottom contact area 206 and/or an inside edge of the first bottom groove 208*a*. The first edge 212*a* of the label 210 may be at or adjacent to the first lateral edge 209*a* of the bottom contact area 206 and/or an inside edge of the first bottom groove 208*a* or may be offset from the first lateral edge 209*a* of the bottom contact area 206 and/or an inside edge of the first bottom groove 208*a*. In some embodiments, the label 210 may have a second edge 212*b* that is aligned with (i.e., parallel to) the second lateral edge 209*b* of the bottom contact area 206 and/or an inside edge of the second bottom groove 208*b*. The second edge 212*b* of the label 210 may be at or adjacent to the second lateral edge 209*b* of the bottom contact area 206 and/or an inside edge of the second bottom groove 208*b* or may be offset from the second lateral edge 209*b* of the bottom contact area 206 and/or an inside edge of the second bottom groove 208*b*. In some embodiments, the label 210 may have a third edge 212*c* (illustrated in FIG. 2D) that may be disposed on or adjacent to the portion of the bottom contact area 206 disposed on the third side wall exterior surface 18*c*. The label 210 may have a fourth edge 212*d* (not shown) that may be disposed on or adjacent to the portion of the bottom contact area 206 disposed on the fourth side wall exterior surface 18*d*.

All or a portion of the label 210 may include indicia or printing, and the indicia or printing may include text, one or more logos, and/or one or more patterns. The indicia or printing may be created or provided on the label 210 in any suitable manner, such as by printing (e.g., screen printing) and/or texturing. The label 210 may be secured to the bottom contact area 206 in any suitable manner. For example, a back surface (not shown) of the label 210 may have an adhesive that secures the label 210 to all or a portion of the bottom contact area 206. In other embodiments, the label 210 may be attached to the bottom contact area 206 during molding. Specifically, the label 210 may be placed in a portion of an injection mold that corresponds to the bottom contact area 206 of the main portion 12. Because the mold feature that corresponds to the gate groove 215 is a circular projection in the mold, a cutout portion 216 of the label 210 may be placed around the circular projection corresponding to the gate groove 215 to properly locate or index the label 210 in the mold. The first edge 212*a* of the label may then be aligned with the portions of the mold that correspond to the first lateral edge 209*a* of the bottom contact area 206 and/or an inside edge of the first bottom groove 208*a* to further position the label 210. Static electricity (or an adhesive) may temporarily secure the label 210 to the mold feature corresponding to the bottom contact area 206 during the molding process to avoid shifting of the label 210 relative to the mold during the molding process. When secured during the molding process, the label 210 is durable and will not tear or separate from the main portion 12. One having ordinary skill in the art would recognize that applying the label 210 during molding also avoids the costly post-molding manufacturing step of applying an adhesive label to the main portion 12.

Figure 3A:
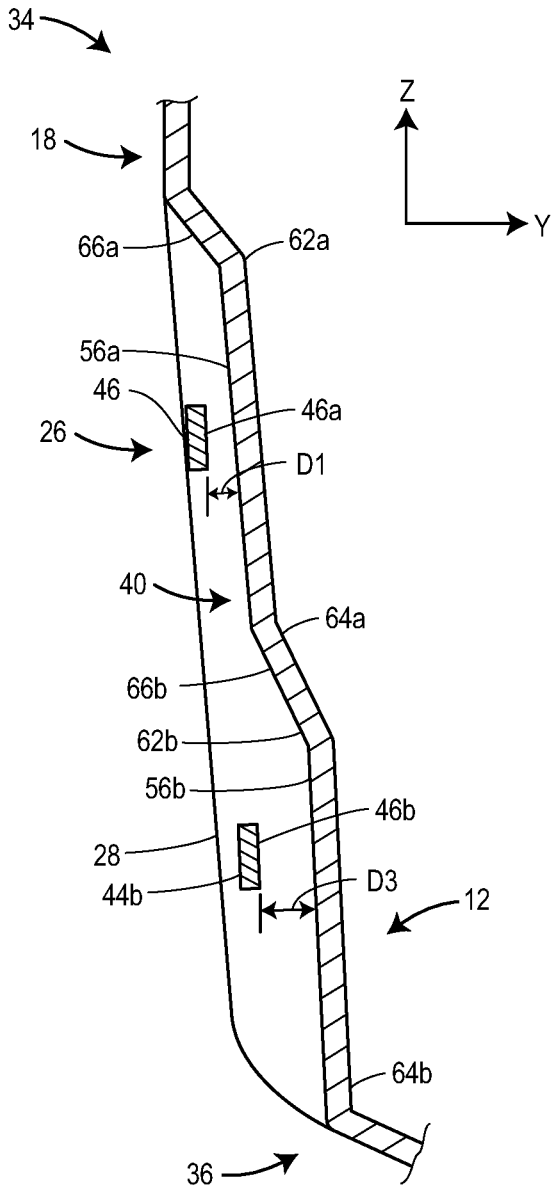
FIG. 3A is a cross-sectional view of an embodiment of a first main portion securement feature taken along line 3A-3A of FIG. 2A.

As illustrated in FIGS. 1 and 3A, the cooler portion 11 may also include a first main portion securement feature 26 disposed at a first location on at least one of the one or more side walls 40 (or one or more exterior surfaces 18) of the main portion 12. The first main portion securement feature 26 may be any feature that allows the first attachment securement feature 32*a* of the first attachment assembly 30*a* to be removably secured to the first main portion securement feature 26 of the cooler portion 11, as illustrated in FIG. 5. The first main portion securement feature 26 may also be any feature that allows the second attachment securement feature 32*b* of the second attachment assembly 30*b* to be removably secured to the first main portion securement feature 26 of the cooler portion 11, as illustrated in FIG. 5.

In some embodiments of the main portion 12, as illustrated in FIG. 2A, the first main portion securement feature 26 may include a first bar portion 44*a* that may be offset from a portion of one or more of the exterior surfaces 18 of the one or more side walls 40. The first bar portion 44*a* may have any suitable shape (or combination of shapes) that allows the first bar portion 44*a* to be releaseably engaged by the first attachment securement feature 32*a* of the first attachment assembly 30*a*. As illustrated in FIG. 3A (which illustrates a cross-sectional view of an embodiment of the first main portion securement feature 26 taken along line 3A-3A in FIG. 2A), all or a portion of the first bar portion 44*a* may have a rectangular or substantially rectangular cross-sectional shape. In other embodiments (not shown), the first bar portion 44*a* may have a cross-sectional shape that is at least partially circular. In some embodiments, the first bar portion 44*a* may have a uniform cross-sectional shape across the entire length, or the cross-sectional shape of the first bar portion 44*a* may vary across the length.

The first bar portion 44*a* may be secured to the one or more side walls 40 in any suitable manner. For example, as illustrated in FIG. 2A, the first bar portion 44*a* may be secured between a first lateral ridge 50 and a second lateral ridge 52. Each of the first lateral ridge 50 and the second lateral ridge 52 may be elongated and may extend in a direction along the main portion axis 34 from a first point at or adjacent to the first end 36 of the main portion 12 to a second point at or adjacent to the second end 38 of the main portion 12.

Figure 3B:
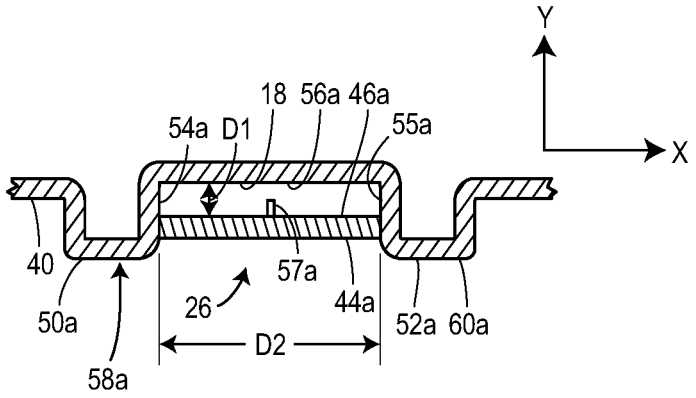
FIG. 3B is a cross-sectional view of a first lateral ridge and a second lateral ridge taken along section line 3B-3B of FIG. 2A.
Figure 3C:
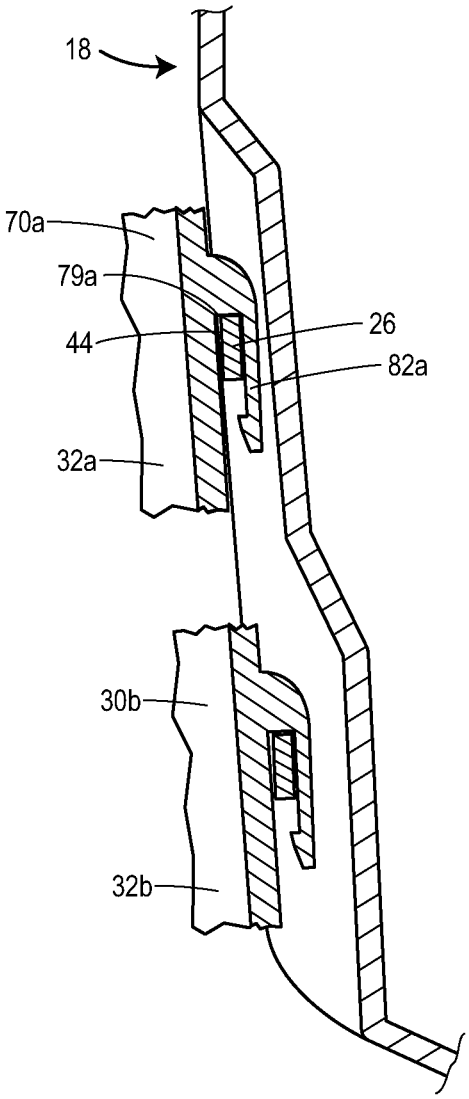
FIG. 3C is a cross-sectional view of the first lateral ridge and the second lateral ridge taken along section line 3A-3A of FIG. 2A with the first attachment securement feature secured to the first main portion securement feature and the second attachment securement feature secured to the second main portion securement feature.

Referring to FIG. 3B, which is a cross-sectional view of the first lateral ridge 50 and the second lateral ridge 52 taken along section line 3B-3B of FIG. 2A, the first lateral ridge 50 and the second lateral ridge 52 may each have a uniform cross-sectional shape between all (or substantially all) or a portion of the distance between the first point and the second point. In the embodiment of FIG. 3B, the first lateral ridge 50 and the second lateral ridge 52 each have a partially rectangular cross-sectional shape that outwardly extends from one or more of the one or side walls 40. More specifically, the first lateral ridge 50 may have an inner wall 54 and the second lateral ridge 52 may have an inner wall 55, and each inner wall 54, 55 may extend away from (e.g., in a direction normal or substantially normal to) a first channel portion 56*a* of the side walls 40 that extends between the first lateral ridge 50 and the second lateral ridge 52. A first end of the first bar portion 44*a* may be secured to a portion of the inner wall 54 of the first lateral ridge 50 and a second end of the first bar portion 44*a* may be secured to a portion of the inner wall 55 of the second lateral ridge 52. In some embodiments, the first channel portion 56*a* of the side walls 40 may be planar and may be separated or offset from the inner surface 46*a* of the first bar portion 44*a* by a first distance D1 that allows the first attachment securement feature 32*a* of the first attachment assembly 30*a* to be secured around the first bar portion 44*a*, as illustrated in FIG. 3C, which is a cross-sectional view of the first lateral ridge 50 and the second lateral ridge 52 taken along section line 3A-3A of FIG. 2A with the first attachment securement feature 32*a* secured to the first main portion securement feature 26. Similarly, the inner wall 54 of the first lateral ridge 50 may be separated from the inner wall 55 of the second lateral ridge 52 by a second distance D2 that allows the first attachment securement feature 32*a* of the first attachment assembly 30*a* to be secured around the first bar portion 44*a*, as illustrated in FIG. 3B. In some embodiments, one or more separation members 57*a* may be disposed along at least a portion of the inner surface 46*a* of the first bar portion 44*a* for embodiments in which the first attachment securement feature 32*a* of the first attachment assembly 30*a* includes two or more cantilevered arms, which will be discussed in more detail below.

The first lateral ridge 50 and the second lateral ridge 52 may each also have a front wall 58, 60 that defines an outward portion of the first lateral ridge 50 and the second lateral ridge 52, and the front walls 58, 60 may be adapted to contact and/or support a portion of the first attachment securement feature 32*a* and/or the first attachment assembly 30*a* when the first attachment securement feature 32*a* is secured to the first main portion securement feature 26. In some embodiments, the front wall 58 of the first lateral ridge 50 may be normal (or substantially normal) to the inner wall 54 of the first lateral ridge 50 and the front wall 60 of the second lateral ridge 52 may be normal (or substantially normal) to the inner wall 55 of the second lateral ridge 52.

The first bar portion 44*a* may be disposed at any suitable location along the Z-axis of the reference coordinate system of FIG. 3A between the first lateral ridge 50 and the second lateral ridge 52. For example, as provided in FIG. 3A, the bar portion may be disposed between the first end 36 of the main portion 12 and the second main portion securement feature 28 (and/or the second end 38 of the main portion 12). The first channel portion 56*a* of the side walls 40 may extend from a first end 62*a* to a second end 64*a*, and the first channel portion 56*a* of the side walls 40 may be parallel or substantially parallel to the Z-axis of the reference coordinate system of FIG. 3A. A first transition surface 66*a* of the side walls 40 may extend between the first end 62*a* of the first channel portion 56*a* and the front wall 58, 60 of one or both of the first lateral ridge 50 and the second lateral ridge 52. The first transition surface 66*a* may be planar and may form an obtuse angle (of between approximately 120° to) 160° with the first channel portion 56*a* when viewed in the cross-sectional view of FIG. 3A. However, the first transition surface 66*a* may have any suitable shape or combination of shapes to provide space to facilitate the attachment of the first attachment securement feature 32*a* of the first attachment assembly 30*a* to the first bar portion 44*a*.

As illustrated in FIGS. 1 and 3A, the cooler portion 11 may also include a second main portion securement feature 28 disposed at a second location on at least one of the one or more side walls 40 (or one or more exterior surfaces 18) of the main portion 12. The second main portion securement feature 28 may be any feature that allows the second attachment securement feature 32*b* of the second attachment assembly 30*b* to be removably secured to the second main portion securement feature 28 of the cooler portion 11, as illustrated in FIG. 5. The second main portion securement feature 28 may also be any feature that allows the first attachment securement feature 32*a* of the first attachment assembly 30*a* to be removably secured to the second main portion securement feature 28 of the cooler portion 11, as illustrated in FIG. 5.

In some embodiments, as illustrated in FIG. 2A, the second main portion securement feature 28 may include a second bar portion 44*b* that may be offset from a portion of one or more of the exterior surfaces 18 of the one or more side walls 40. The second bar portion 44*b* may have any suitable shape (or combination of shapes) that allows the second bar portion 44*b* to be releaseably engaged by the second attachment securement feature 32*b* of the second attachment assembly 30*b*. In some embodiments, the second bar portion 44*b* of the second main portion securement feature 28 may be identical or substantially identical to the first bar portion 44*a* of the first main portion securement feature 26. That is, as illustrated in FIG. 3A, all or a portion of the second bar portion 44*b* may have a rectangular or substantially rectangular cross-sectional shape. In other embodiments (not shown), the second bar portion 44*b* may have a cross-sectional shape that is at least partially circular. In some embodiments, the second bar portion 44*b* may have a uniform cross-sectional shape across the entire length, or the cross-sectional shape of the second bar portion 44*b* may vary across the length.

Figure 3D:
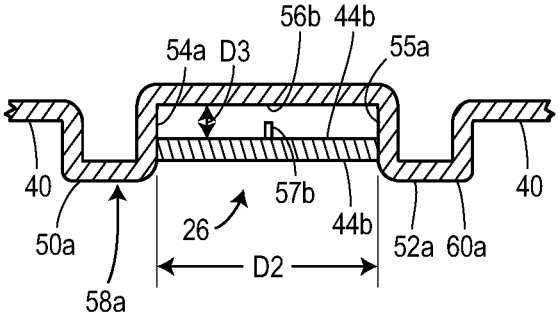
FIG. 3D is a cross-sectional view of the first lateral ridge and the second lateral ridge taken along section line 3D-3D of FIG. 2A.

As illustrated in FIG. 3A, second bar portion 44*b* may be offset from a second channel portion 56*b* of the side walls 40. Referring to FIG. 3D, which is a cross-sectional view of the first lateral ridge 50 and the second lateral ridge 52 taken along section line 3D-3D of FIG. 2A, the second channel portion 56*b* may extend between the inner wall 54 of the first lateral ridge 50 and the inner wall 55 of the second lateral ridge 52. In some embodiments, the second channel portion 56*b* may be planar or substantially planar and may be separated or offset from an inner surface 46*b* of the second bar portion 44*b* by a third distance D3 that allows the second attachment securement feature 32*b* of the second attachment assembly 30*b* to be secured around the second bar portion 44*b*, as illustrated in FIG. 3C. In some embodiments, the third distance D3 may be equal to (or approximately equal to) the first distance D1. In some embodiments, all or part of the second channel portion 56*b* may be non-planar.

The second bar portion 44*b* may be secured to the one or more side walls 40 in any suitable manner. For example, as illustrated in FIG. 2A, the second bar portion 44*b* may be secured between the first lateral ridge 50 and the second lateral ridge 52. As illustrated in FIG. 3D, a first end of the second bar portion 44*b* may be secured to a portion of the inner wall 54 of the first lateral ridge 50 and a second end of the second bar portion 44*b* may be secured to a portion of the inner wall 55 of the second lateral ridge 52.

The inner wall 54 of the first lateral ridge 50 may be separated from the inner wall 55 of the second lateral ridge 52 by any suitable distance, such as the second distance D2 (or at least the second distance D2) that allows the second attachment securement feature 32*b* of the second attachment assembly 30*b* to be secured around the second bar portion 44*b*, as illustrated in FIG. 3C. As illustrated in FIG. 3D, one or more separation members 57*b* may be disposed along at least a portion of the inner surface 46*b* of the second bar portion 44*b* for embodiments in which the second attachment securement feature 32*b* of the second attachment assembly 30*b* includes two or more cantilevered arms, which will be discussed in more detail below. The front wall 58, 60 of each of the first lateral ridge 50 and the second lateral ridge 52 may be adapted to contact and/or support a portion of the second attachment securement feature 32*b* and/or the second attachment assembly 30*b* when the second attachment securement feature 32*b* is secured to the second main portion securement feature 28.

The second bar portion 44*b* may be disposed at any suitable location along the Z-axis of the reference coordinate system of FIG. 3A between the first lateral ridge 50 and the second lateral ridge 52. For example, as provided in FIG. 3A, the second bar portion 44*b* may be disposed between the second end 38 of the main portion 12 and the first main portion securement feature 26 (and/or the first end 36 of the main portion 12).

The second channel portion 56*b* of the side walls 40 may extend from a first end 62*b* to a second end 64*b*, and the second channel portion 56*b* may be parallel or substantially parallel to the Z-axis of the reference coordinate system of FIG. 3A. The second end 64*b* of the second channel portion 56*b* may be at or adjacent to the second end 38 of the main portion 12. A second transition surface 66*b* of the side walls 40 may extend between the first end 62*b* of the second channel portion 56*b* and the second end 64*a* of the first channel portion 56*a*. The second transition surface 66*b* may be planar and may form an obtuse angle (of between approximately 120° to 160°) with the second channel portion 56*b* when viewed in the cross-sectional view of FIG. 3A. However, the second transition surface 66*b* may have any suitable shape or combination of shapes to provide space to facilitate the attachment of the second attachment securement feature 32*b* of the second attachment assembly 30*b* to the second bar portion 44*b*. In some embodiments (not shown), the first channel portion 56*a* and the second channel portion 56*b* may be coplanar and no second transition surface 66*b* may be present.

Any number of additional main portion securement features may be disposed on the main portion 12. In some embodiments, a third bar portion (not shown) and further bar portions (not shown) may be disposed between the first lateral ridge 50 and the second lateral ridge 52, and the third bar portion (and any further bar portions) may be identical to the first bar portion 44*a* and/or the second bar portion 44*b*. However, any number of main portion securement features (e.g., the first main portion securement feature 26 and/or the second main portion securement feature 28) may be disposed at any location on the main portion 12, and one or more main portion securement features may be disposed on the first side wall 40*a*, the second side wall 40*b*, the third side wall 40*c*, and/or the fourth side wall 40*d* of the main portion 12.

It should be understood that the improvements disclosed herein are not to be limited to the particular securement feature designs illustrated in FIGS. 3A-3D. The improvements disclosed herein may be implemented using one or more securement features having other designs, including one or more other types of removable attachment or engagement features. These alternate securement features may include one or more of a slot, a post, a cap, a lip, a groove, a shoulder, a mushroom head, a catch, a snap, a quick release, a bayonet mount, a hook and loop fastener, and/or a channel. These alternate securement features may utilize one or more of a snap fit, a friction fit, an interference fit, and/or may utilize gravity for engagement.

In some embodiments, more than one first lateral ridge 50 and second lateral ridge 52 may be disposed on the main portion 12. For example, as illustrated in FIG. 2A, two sets of first lateral ridges 50 and second lateral ridges 52 may be disposed on the first side wall 40*a* and as illustrated in FIG. 2C, two sets of first lateral ridges 50 and second lateral ridges 52 may be disposed on the second side wall 40*b*. In some embodiments (not shown), one or more sets of first lateral ridges 50 and second lateral ridges 52 may be disposed on the third side wall 40*c* and/or the fourth side wall 40*c*. Two or more bar portions (not shown) may extend between any or all of the sets of first lateral ridges 50 and second lateral ridges 52. Any number of bar portions may be disposed at any location on the main portion 12, and one or more bar portions may be disposed on the first side wall 40*a*, the second side wall 40*b*, the third side wall 40*c*, and/or the fourth side wall 40*d* of the main portion 12. The cover portion 22 may also include one or more first main portion securement feature 26 and/or second main portion securement feature 28. For example, the cover portion 22 may include one or more sets of first lateral ridges 50 and second lateral ridges 52 (not shown) and two or more bar portions (not shown) may extend between any or all of the sets of first lateral ridges 50 and second lateral ridges 52 on the cover portion 22.

As illustrated in FIG. 1, the cooler assembly 10 may further include a first attachment assembly 30*a* that may be adapted to be removably secured to a portion of the cooler portion 11, such as the first main portion securement feature 26 and/or the second main portion securement feature 28. The first attachment assembly 30*a* may include an accessory portion 68*a* that may be removably secured to the cooler portion 11. FIG. 4A provides an example of such an accessory portion 68*a*. Specifically, FIG. 4A provides a perspective view of a first attachment assembly 30*a* in which the accessory portion 68*a* is a container 69*a* that can be opened and closed. The container 69*a* may be adapted to contain, store, and/or transport one or more items or materials that a user may wish to transport with the cooler portion 11 but may not want to contain, store, and/or transport in the interior portion 16 of the cooler portion 11. For example, the container 69*a* may contain metal objects that may corrode if exposed to a liquid that may be disposed within the interior portion 16 of the cooler portion 11. The container 69*a* may be sealed (e.g., by a gasket) such that liquid or debris may not enter into an interior portion of the container 69*a*. In other embodiments, the container 69*a* may be sealed such that the container is waterproof and may prevent liquid from entering into the interior portion of the container 69*a* when the container 69*a* is submerged in the liquid. The container 69*a* may be secured by a closing mechanism such that the container 69*a* does not accidentally or unintentionally open when being transported with the cooler portion 11. In addition, the container 69*a* may be secured by a locking mechanism such that the user may prevent an unauthorized user from opening the container 69*a*, and such a container 69*a* may be used to store or contain valuables, such as a mobile phone or jewelry, for example.

The first attachment assembly 30*a* may include a first attachment securement feature 32*a* that may be coupled to the accessory portion 68*a*. In some embodiments, the first attachment securement feature 32*a* may be removably coupled to the accessory portion 68*a*. For example, as illustrated in FIG. 4A, the first attachment securement feature 32*a* may be disposed on a clip portion 70*a*, and the clip portion 70*a* may be removably secured to the accessory portion 68*a*.

Figure 4B:
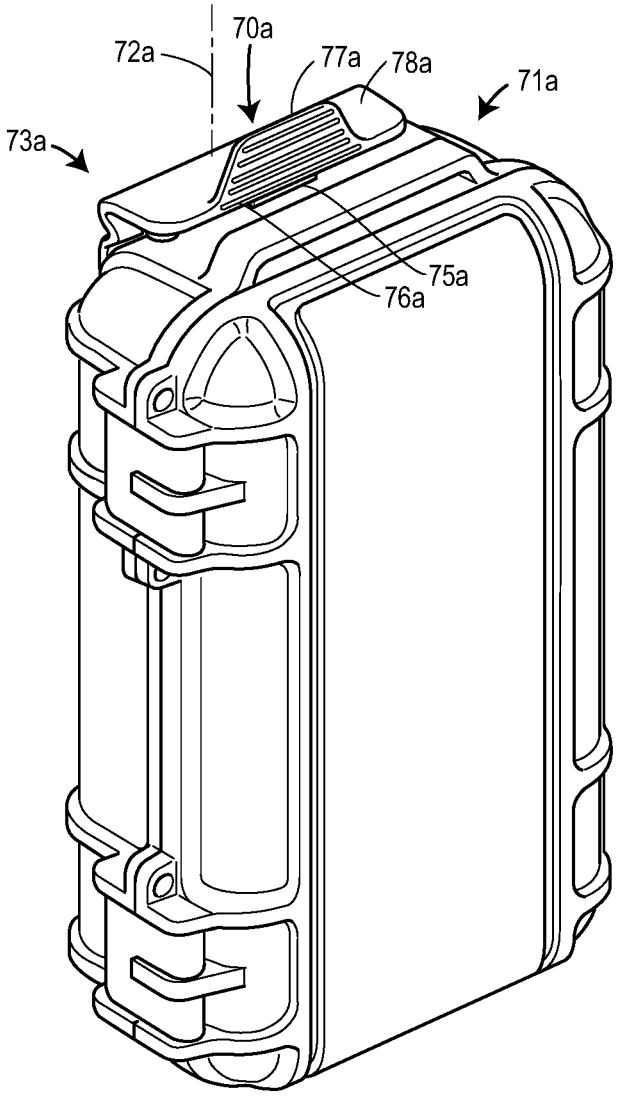
FIG. 4B is a top perspective view of the embodiment of the first attachment assembly of FIG. 4A.

The clip portion 70*a* may be removably secured to the accessory portion 68*a* in any suitable fashion. For example, as illustrated in FIG. 4A, the clip portion 70*a* may extend along a clip axis 72*a* from a first end 73*a* to a second end 74*a*. A clip body 79*a* may extend from the first end 73*a* to the second end 74*a*, and a first clip arm 78*a* may extend away from the clip body 79*a* at or adjacent to the first end 73*a*. As shown in FIG. 4B, which illustrates a top perspective view of the first attachment assembly 30*a* of FIG. 4A, the first clip arm 78*a* of the clip portion 70*a* may include a lip 75*a* disposed at or adjacent to an end portion of the first clip arm 78*a*, and the lip 75*a* may removably engage a slot 76*a* formed in or on a first end 71*a* of the accessory portion 68*a* to secure the clip portion 70*a* to the accessory portion 68*a*. Because the first clip arm 78*a* is cantilevered from the clip body 79*a*, a spring force maintains the lip 75*a* within the slot 76*a* during normal use. To remove the lip 75*a* from the slot 76*a*, a grip portion 77*a* disposed at or adjacent to the end portion of the first clip arm 78*a* may be displaced away from the slot 76*a*, and the first clip arm 78*a* may deflect away from the slot 76*a*, thereby freeing the lip 75*a*.

As illustrated in FIG. 4A, a second clip arm 80*a* may extend away from the clip body 79*a* at or adjacent to the second end 74*a*, and the second clip arm 80*a* may be removably secured to the accessory portion 68*a* in any suitable manner. For example, the second clip arm 80*a* of the clip portion 70*a* may include a lip (not shown) disposed at or adjacent to an end portion of the second clip arm 80*a*, and the lip may removably engage a slot (not shown) formed in or on a second end 81*a* of the accessory portion 68*a* to secure the clip portion 70*a* to the accessory portion 68*a*. To attach the clip portion 70*a* to the accessory portion 68*a*, the lip on the second clip arm 80*a* may be first secured to the second end 81*a* of the accessory portion 68*a* and the lip 75*a* of the first clip arm 78*a* may then be positioned in the slot 76*a* using the grip portion 77*a*.

Figure 4C:
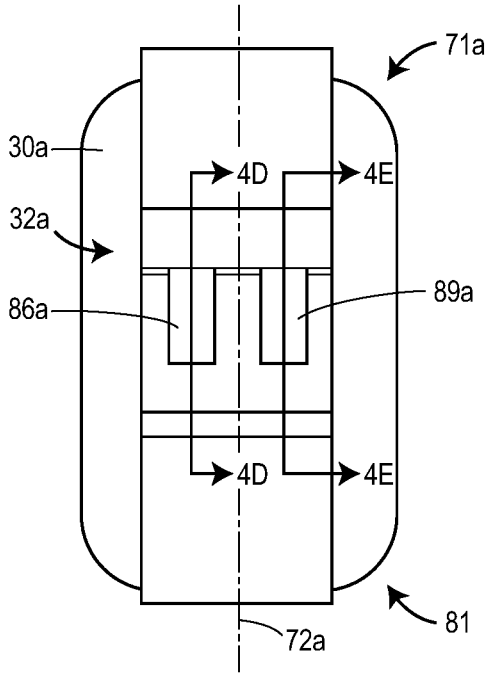
FIG. 4C is a rear view of the embodiment of the first attachment assembly of FIG. 4A.
Figure 4D:
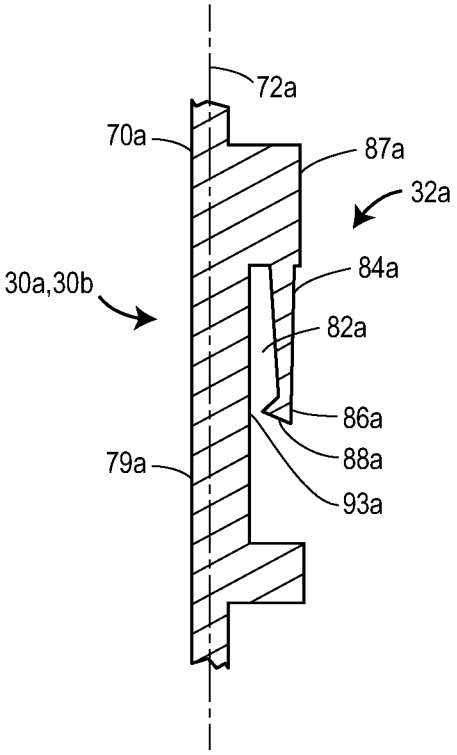
FIG. 4D is a partial sectional side view of an embodiment of a clip portion of an embodiment of the first attachment assembly taken along section line 4D-4D of FIG. 4C.

The first attachment securement feature 32*a* may be coupled to or formed on the clip portion 70*a*. Referring to FIG. 4A, the first attachment securement feature 32*a* may include at least one retaining arm (such as a first retaining arm 82*a*) adapted to releaseably engage the first bar portion 44*a* and/or the second bar portion 44*b*. As illustrated in FIG. 4C, which is a rear view of the first attachment assembly 30*a*, the first retaining arm 82*a* may extend from a first end 84*a* to a second end 86*a* in a direction parallel to the clip axis 72*a*. As illustrated in FIG. 4D, which is a partial sectional side view of the clip portion 70*a* taken along section line 4D-4D of FIG. 4C, the first retaining arm 82*a* may be cantilevered from an arm base 87*a*. That is, the first end 84*a* of the first retaining arm 82*a* may be fixed to and extend from a first portion of the arm base 87*a*, and the second end 86*a* may be a free end that may displace in a direction normal to the clip axis 72*a*. A detent 88*a* may be disposed at or adjacent to the second end 86*a* of the first retaining arm 82*a* and may inwardly extend form the first retaining arm 82*a* towards the clip body 79*a*.

Figure 4E:
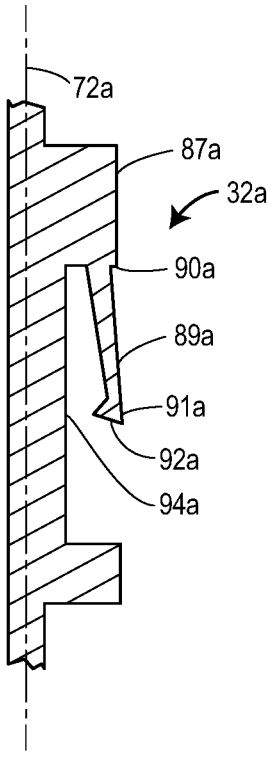
FIG. 4E is a partial sectional side view of an embodiment of a clip portion of an embodiment of the first attachment assembly taken along section line 4E-4E of FIG. 4C.

As illustrated in FIG. 4C, the first attachment securement feature 32*a* may also include a second retaining arm 89*a* that may be identical or substantially identical to the first retaining arm 82*a*. That is, the second retaining arm 89*a* may extend from a first end 90*a* to a second end 91*a* in a direction parallel to the clip axis 72*a*. As illustrated in FIG. 4E, which is a partial sectional side view of the clip portion 70*a* taken along section line 4E-4E of FIG. 4C, the second retaining arm 89*a* may be cantilevered from the arm base 87*a*. That is, the first end 90*a* of the second retaining arm 89*a* may be fixed to and extend from a second portion of the arm base 87*a*, and the second end 91*a* may be a free end that may displace in a direction normal to the clip axis 72*a*. A detent 92*a* may be disposed at or adjacent to the second end 91*a* of the second retaining arm 89*a* and may inwardly extend form the second retaining arm 89*a* towards the clip body 79*a*. Any number of additional retaining arms is also contemplated, and any of the additional retaining arms may be identical to the first retaining arm 82*a* and may extend from the arm base 87*a*.

As illustrated in FIG. 1, the cooler assembly 10 may further include the second attachment assembly 30*b* that may be adapted to be removably secured to a portion of the cooler portion 11, such as the second main portion securement feature 28 and/or the first main portion securement feature 26 (or any additional main portion securement features). The second attachment assembly 30*b* may include an accessory portion 68*b* that may be removably secured to the cooler portion 11, such as a container 69*b* that can be opened and closed as pictured FIG. 6. The accessory portion 68*b* of the second attachment assembly 30*b* may be similar or identical to the accessory portion 68*a* of the first attachment assembly 30*a*. However, the accessory portion 68*b* of the second attachment assembly 30*b* may be different in size and/or function to the accessory portion 68*a* of the first attachment assembly 30*a*.

The second attachment assembly 30*b* may include a second attachment securement feature 32*b* that may be coupled to the accessory portion 68*b*, and the second attachment securement feature 32*b* may be identical or substantially identical to the first attachment securement feature 32*a*, as illustrated in FIG. 6, which is a rear perspective view of the second attachment assembly 30*b*. Therefore, elements having reference numbers that end with a "b" in reference to the second attachment securement feature 32*b* correspond to (and are identical to) elements having reference numbers that end with an "a" in FIGS. 4A to 4E (which illustrates the first attachment assembly 30*a* having the first attachment securement feature 32*a*).

Similar to the first attachment assembly 30*a*, the second attachment assembly 30*b* may include a clip portion 70*b*. The clip portion 70*b* of the second attachment assembly 30*b* may have any suitable size or shape and may be secured to the accessory portion 68*b* of the second attachment assembly 30*b* in any suitable manner. For example, the clip portion 70*b* may extend along a clip axis 72*b* from a first end 73*b* to a second end 74*b*. A clip body 79*b* may extend from the first end 73*b* to the second end 74*b*, and a first clip arm 78*b* and a second clip arm 80*b* may be removably secured to the accessory portion 68*b* in the manner previously described regarding the first clip arm 78*a* and the second clip arm 80*a* of the clip portion 70*a* of the first attachment assembly 30*a*. The second attachment securement feature 32*b* may be coupled to or formed on the clip portion 70*b*, and the second attachment securement feature 32*b* may include at least one retaining arm (such as a first retaining arm 82*b*) adapted to releaseably engage the first bar portion 44*a* and/or the second bar portion 44*b*. The first retaining arm 82*b* may extend from a first portion of an arm base 87*b*, and a second retaining arm 89*b* may extend from a second portion of an arm base 87*b*. The first retaining arm 82*b* and the second retaining arm 89*b* of the second attachment securement feature 32*b* may be identical in shape and size to the first retaining arm 82*a* and the second retaining arm 89*a* of the first attachment securement feature 32*a*.

In use, a user may wish to attach the first attachment assembly 30*a* to the cooler portion 11 to allow the first attachment assembly 30*a* to be stored on and/or transported with the cooler portion 11. For example, a user may wish to store an article in the container 69*a* of the first attachment assembly 30*a* for use during an activity or at an event in which the cooler assembly 10 is used. To attach the first attachment assembly 30*a* to the cooler portion 11, the first attachment assembly 30*a* may be positioned such that the clip axis 72*a* is generally aligned with the main portion axis 34 of the cooler portion 11 (see FIG. 2A) and/or such that the second end 86*a* of the first retaining arm 82*a* and the second end 91*a* of the second retaining arm 89*a* are each adjacent to a top portion of the first bar portion 44*a*. In some embodiments, the first retaining arm 82*a* may be positioned on a first side of the separation member 57*a* (see FIG. 3B) of the first bar portion 44*a* and the second retaining arm 89*a* may be positioned on a second side of the separation member 57*a* of the first bar portion 44*a*.

The user may then downwardly displace the first attachment assembly 30*a* along the clip axis 72*a* towards the second end 38 of the main portion 12 of the cooler assembly 11 (see FIG. 2A). As illustrated in FIG. 4D, a distance between an apex of the detent 88*a* of the first retaining arm 82*a* and an adjacent portion 93*a* of the clip body 79*a* may be less than a width of the first bar portion 44*a* (e.g., as illustrated in FIG. 3A, the dimension of the bar portion 44*a* along the Y-axis of the reference coordinate system). Similarly, as illustrated in FIG. 4E, a distance between an apex of the detent 92*a* of the second retaining arm 89*a* and an adjacent portion 94*a* of the clip body 79*a* is less than the width of the first bar portion 44*a*. Accordingly, as the first attachment assembly 30*a* is downwardly displaced, the apex of the detent 88*a* of the first retaining arm 82*a* (illustrated in FIG. 4D) and the apex of the detent 92*a* of the second retaining arm 89*a* (illustrated in FIG. 4E) each contacts a corresponding portion of the first bar portion 44*a*. This contact displaces the second end 86*a* of the first retaining arm 82*a* (illustrated in FIG. 4D) away from the first bar portion 44*a* and towards the first channel portion 56*a* of the side wall 40 (illustrated in FIG. 3A) and also displaces the second end 91*a* of the second retaining arm 89*a* (illustrated in FIG. 4E) away from the first bar portion 44*a* and towards the first channel portion 56*a* of the side wall 40 (illustrated in FIG. 3A). In some embodiments, the distance the second end 86*a* of the first retaining arm 82*a* displaces away from the first bar portion 44*a* and towards the first channel portion 56*a* of the side wall 40 may be less than the first distance D1 (illustrated in FIG. 3A) and the distance the second end 91*a* of the second retaining arm 89*a* displaces away from the first bar portion 44*a* and towards the first channel portion 56*a* of the side wall 40 may be less than the first distance D1.

As the first attachment assembly 30*a* continues to be downwardly displaced, the apex of the detent 88*a* of the first retaining arm 82*a* and the apex of the detent 92*a* of the second retaining arm 89*a* each moves past a bottom portion of the first bar portion 44*a* and a bottom portion of the arm base 87*a* (adjacent to the first end 84*a* of the first retaining arm 82*a* and the first end 90*a* of the second retaining arm 89*a*) may come into contact with or be positioned adjacent to the top portion of the first bar portion 44*a*, as illustrated in FIG. 3C. Because the first bar portion 44*a* is disposed between the bottom portion of the arm base 87*a* and the apex of the detent 88*a* of the first retaining arm 82*a* and the apex of the detent 92*a* of the second retaining arm 89*a*, the first attachment assembly 30*a* is secured to the first bar portion 44*a* and cannot be removed unless the first attachment assembly 30*a* is upwardly displaced with enough force to outwardly displace the apex of the detent 88*a* of the first retaining arm 82*a* and the apex of the detent 92*a* of the second retaining arm 89*a* as each moves past the bottom portion of the first bar portion 44*a*. The detent 88*a* of the first retaining arm 82*a* and the detent 92*a* of the second retaining arm 89*a* may each be sized and dimensioned to achieve a desirable cantilever spring retaining force when the second end 86*a* of the first retaining arm 82*a* and the second end 91*a* of the second retaining arm 89*a* move past and/or contact top portion and/or the bottom portion of the first bar portion 44*a*. Accordingly, the first attachment assembly 30*a* may be removably secured to the cooler portion 11 in a manner that allows for easy attachment and detachment but also protects against accidental detachment during transport.

As previously explained, the first attachment assembly 30*a* may be removably secured to the first main portion securement feature 26 or the second main portion securement feature 28 (and/or any further securement feature on the main portion 12 and/or the cover portion 22). Accordingly, the first attachment assembly 30*a* may also be removably secured to the second bar portion 44*b* illustrated in FIG. 3A in a manner identical to the manner in which the first attachment assembly 30*a* is removably secured to the first bar portion 44*a*. In addition, the first attachment assembly 30*a* may be removably secured to any further bar portion of any further main portion securement features disposed on the cooler portion 11. Consequently, the first attachment assembly 30*a* (and the second attachment assembly 30*b*) is a modular accessory that can be conveniently attached to any or several locations on the cooler portion 11 for convenience to the user and to create a personalized arrangement of accessories on the cooler portion 11.

A user may also wish to attach the second attachment assembly 30*b* to the cooler portion 11 to allow the second attachment assembly 30*b* to be stored on and/or transported with the cooler portion 11. In some embodiments, the second attachment assembly 30*b* may be secured to the second main portion securement feature 28 (e.g., the second bar portion 44*b*) in the same manner in which the first attachment assembly 30*a* is secured to the first main portion securement feature 26 (e.g., the first bar portion 44*a*). That is, the second attachment assembly 30*b* may be positioned such that the clip axis 72*b* is generally aligned with the main portion axis 34 of the main portion 12 (see FIG. 2A) and/or such that the second end 86*b* of the first retaining arm 82*b* and the second end 91*b* of the second retaining arm 89*b* are each adjacent to a top portion of the second bar portion 44*b*.

The user may then downwardly displace the second attachment assembly 30*b* along the clip axis 72*b* towards the second end 38 of the main portion 12 of the cooler assembly 11 (see FIG. 2A) until the apex of the detent 88*b* of the first retaining arm 82*b* (illustrated in FIG. 4D) and the apex of the detent 92*b* of the second retaining arm 89*b* (illustrated in FIG. 4E) each locks around the second bar portion 44*b*, thereby securing the second attachment assembly 30*b* to the second bar portion 44*b*.

This contact displaces the second end 86*b* of the first retaining arm 82*b* (illustrated in FIG. 4D) away from the second bar portion 44*b* and towards the second channel portion 56*b* of the side wall 40 (illustrated in FIG. 3A) and also displaces the second end 91*b* of the second retaining arm 89*b* (illustrated in FIG. 4E) away from the second bar portion 44*a* and towards the first channel portion 56*a* of the side wall 40 (illustrated in FIG. 3A). In some embodiments, the distance the second end 86*a* of the first retaining arm 82*a* displaces away from the first bar portion 44*a* and towards the first channel portion 56*a* of the side wall 40 may be less than the first distance D1 (illustrated in FIG. 3A) and the distance the second end 91*a* of the second retaining arm 89*a* displaces away from the first bar portion 44*a* and towards the first channel portion 56*a* of the side wall 40 may be less than the first distance D1.

In other examples, one or more items may removably attach to one or more of the securement features using other methods. In one example, an item which attaches to one or more of the securement features 28 may extend, at least partially, into the first channel portion 56*a* and extend over the first bar portion 44*a*, at least partially. The item may exert a spring force to removably engage with the first bar portion 44*a* without necessarily including an arm, such as the retaining arm 89, to extend behind or to another side of the first bar portion 44*a*. In this way, an object may removably attach to the cooler assembly 10 by exerting a spring force on opposing sides of the cooler assembly 10 to removably attach the item by snapping over or "cupping over" two or more of the bar portions without necessarily including retaining arms which extend around back sides of bar portions.

As previously explained, the first attachment assembly 30*a* and the second attachment assembly 30*b* may each include an accessory portion 68*a*, 68*b*. While the accessory portions 68*a*, 68*b* have been illustrated as individual containers 69*a*, 69*b* that can open and close to store one or more articles or objects, the accessory portion 68*a* of the first attachment assembly 30*a* and the accessory portion 68*b* of the second attachment assembly 30*b* may be any item or feature that a user would desire to attach to the cooler portion 12. For example, the accessory portion 68*a* of the first attachment assembly 30*a* and/or the accessory portion 68*b* of the second attachment assembly 30*b* may be a cup holder, a condiment holder, or a holder for one or more utensils. In other embodiments, the accessory portion 68*a* of the first attachment assembly 30*a* and/or the accessory portion 68*b* of the second attachment assembly 30*b* may be an electronic device or one or more accessories for an electronic device, such as a radio, a holder for a radio, a battery, a light, a cellphone or tablet, or a holder or case for a cellphone or tablet, for example.

In addition, the accessory portion 68*a* of the first attachment assembly 30*a* and/or the accessory portion 68*b* of the second attachment assembly 30*b* may be a fishing rod holder or fishing rod securing device that allows a user to secure a fishing rod to the cooler portion 11. The accessory portion 68*a* of the first attachment assembly 30*a* and/or the accessory portion 68*b* of the second attachment assembly 30*b* may also be an umbrella holder or umbrella securing device that allows a user to secure an umbrella to the cooler portion 11 in either (or both) of a stored closed position or an open position. Further, the accessory portion 68*a* may include an interface or adapter which interchangeably receives one or more of a variety of holders or adapters including, but not limited to a cup holder, a rod holder, an umbrella holder, and/or a speaker holder. In this way, a single accessory portion 68*a* may be used with a variety of different types of holders or adapters.

In other embodiments, the accessory portion 68*a* of the first attachment assembly 30*a* and the accessory portion 68*b* of the second attachment assembly 30*b* may be the same accessory. That is, the first attachment assembly 30*a* and the second attachment assembly 30*b* may each include a common accessory portion 68*a* (not shown), and the common accessory portion 68*a* may include a first attachment securement feature 32*a* and a second attachment securement feature 32*b* that may cooperate to secure the common accessory portion 68*a* to the cooler portion 11. For example, the common accessory portion 68*a* may be a single tray, radio, or speaker that includes both a first attachment securement feature 32*a* (that is removably secured to the first main portion securement feature 26) and second attachment securement feature 32*b* (that is removably secured to the second main portion securement feature 28 or a further first main portion securement feature 26 or other main portion securement feature). In other embodiments, the common accessory portion 68*a* may be a single fishing rod holder or a single umbrella holder that includes both a first attachment securement feature 32*a* (that is removably secured to the first main portion securement feature 26) and second attachment securement feature 32*b* (that is removably secured to the second main portion securement feature 28 or a further first main portion securement feature 26 or other main portion securement feature) to provide additional rotational or lateral support for the stored fishing rod or umbrella, respectively.

In some embodiments, the accessory portion 68*a* of the first attachment assembly 30*a* and/or the accessory portion 68*b* of the second attachment assembly 30*b* (and any other accessory portion of any further attachment assembly) may be a wheel, a roller, or a set of wheels, etc. (not shown), that allow the cooler portion 11 to be more easily moved by a user. In addition, the accessory portion 68*a* of the first attachment assembly 30*a* and/or the accessory portion 68*b* of the second attachment assembly 30*b* (and any other accessory portion of any further attachment assembly) may be a cart or trolley (not shown). More particularly, the first attachment securement feature 32*a* and/or the second attachment securement feature 32*b* (and any further attachment securement feature) may be secured to a securement feature identical to the first main portion securement feature 26 of the cooler portion 11 to facilitate the transportation of the cooler portion 11. In other embodiments, the accessory portion 68*a* of the first attachment assembly 30*a* and/or the accessory portion 68*b* of the second attachment assembly 30*b* (and any other accessory portion of any further attachment assembly) may be a deck or other permanent or semi-permanent surface (not shown). In such embodiments, the first attachment securement feature 32*a* and/or the second attachment securement feature 32*b* (and any further attachment securement feature) may be secured to a securement feature identical to the first main portion securement feature 26 disposed on the cooler portion 11 to secure the cooler portion 11 to the deck or surface.

As previously discussed, the cooler portion 11 may additionally include a cover portion 22 at least one of pivotably coupled to or removably secured to the main portion 12. As illustrated in the FIG. 7A, which provides a top view of the cover portion 22, (and FIG. 7C, which provides a perspective view of the cover portion 22) the cover portion 22 may be defined by a perimeter edge 95 that may be similar or identical in shape to the open first end 36 of the main portion 12 such that when the cover portion 22 is coupled to or removably secured to the main portion 12, the cover portion 22 surrounds and covers the entire open first end 36 of the main portion 12. In embodiments in which the main portion 12 may include four side walls 40 that may cooperate to form a rectangular (or generally rectangular) shape when viewed along the main portion axis 34 (as illustrated in FIG. 2A), the cover portion 22 may include four perimeter edges 95 that may cooperate to form a rectangular (or generally rectangular) shape when viewed along the main portion axis 34 (as illustrated in FIG. 7A), and the four perimeter edges 95 may cooperate to form the same shape as or align with (when the cover portion 22 is in a closed position, as illustrated in FIG. 1) one or more perimeter edges 47 that define the outer perimeter of the upper surface 41 (as illustrated in FIG. 2B). More specifically, with reference to FIG. 7A, the cover portion 22 may include a first perimeter edge 95*a* that extends in a direction parallel to the X-axis of the reference coordinate system of FIG. 7A, and the first perimeter edge 95*a* may correspond to or align with the first side wall 40*a* of the main portion 12 when the cover portion 22 is in a closed position (as illustrated in FIG. 1). The cover portion 22 may also include a second perimeter edge 95*b* parallel to and offset from (along the Y-axis of the reference coordinate system of FIG. 7A) the first perimeter edge 95*a* that may correspond to or align with the second side wall 40*b* of the main portion 12 when the cover portion 22 is in a closed position of FIG. 1. The cover portion 22 may additionally include a third perimeter edge 95*c* and a fourth perimeter edge 95*d* that each extend between and normal to the first perimeter edge 95*a* and the second perimeter edge 95*b*, and the third perimeter edge 95*c* and the fourth perimeter edge 95*d* may correspond to or align with the third side wall 40*c* and the fourth side wall 40*d*, respectively, of the main portion 12 when the cover portion 22 is in the closed position of FIG. 1.

As previously discussed, one or more interior surfaces 24 of the cover portion 22 (shown in the bottom view of the cover portion 22 in FIG. 7B) may cooperate to at least partially further define the interior portion 16 of the cooler portion 11 when the cover portion 22 is in the closed position of FIG. 1. In addition, as illustrated in FIG. 7A, one or more exterior surfaces 96 of the cover portion 22 may cooperate to at least partially define the exterior portion 20 of the cooler portion 11 when the cover portion 22 is in the closed position of FIG. 1.

Referring to FIG. 7A, the cover portion 22 may include a first cover ridge 164*a* and a second cover ridge 164*b* that each extend along a portion of the one or more exterior surfaces 96 of the cover portion 22. A contact area 166 may extend along a portion of one or more of the exterior surfaces 96 of the cover portion 22, and the contact area 166 may extend between the first cover ridge 164*a* and the second cover ridge 164*b*. In some embodiments, the first cover ridge 164*a* and the second cover ridge 164*b* may upwardly extend from the contact area 166. In some embodiments, the first cover ridge 164*a* and the second cover ridge 164*b* may be parallel (when viewed along the Z-axis of the Reference Coordinate System of FIGS. 1 and 7A) and may each extend along or generally along the X-axis of the Reference Coordinate System of FIGS. 1 and 7A. In some embodiments, the first cover ridge 164*a* and the second cover ridge 164*b* may each extend between a first end at or adjacent to the third perimeter edge 95*c* of the cover portion 22 and a second end at or adjacent to the fourth perimeter edge 95*d* of the cover portion 22. However, the first end of one or both of the first cover ridge 164*a* and the second cover ridge 164*b* may be disposed remote from the third perimeter edge 95*c* of the cover portion 22. Also, the second end of one or both of the first cover ridge 164*a* and the second cover ridge 164*b* may be disposed remote from the fourth perimeter edge 95*d* of the cover portion 22.

At least a portion of the contact area 166 may be planar or substantially planar. However, because one or more of the exterior surfaces 96 of the cover portion 22 may be at least partially contoured, at least a portion of the contact area 166 may also be contoured. For example, in the embodiment of FIG. 1, a center portion 168 of the contact area 166 may be planar or substantially planar, and the center portion 168 may be disposed between a contoured first end portion 169 and a contoured second end portion 170. The first end portion 169 of the contact area 166 may extend along the third perimeter edge 95*c* of the cover portion 22 and the second end portion 170 of the contact area 166 may extend along the fourth perimeter edge 95*d* of the cover portion 22.

In some embodiments, as illustrated in FIGS. 1 and 7A, the cover portion 22 may include a label 162 that may extend over all or a portion of the contact area 166. In some embodiments, the label 162 may have a first edge 172*a* that is aligned with (i.e., parallel to) the first cover ridge 164*a*. In some embodiments, the first edge 172*a* may be inwardly offset from a bottom of the first cover ridge 164*a* such that a small gap exists between the first edge 172*a* and the first cover ridge 164*a*. In some embodiments, the first edge 172*a* may extend to the bottom of (or up a portion of) the first cover ridge 164*a* such that no gap exists between the first edge 172*a* and the first cover ridge 164*a*. In some embodiments, the label 162 may have a second edge 172*b* that is aligned with (i.e., parallel to) the second cover ridge 164*b*. In some embodiments, the second edge 172*b* may be inwardly offset from a bottom of the second cover ridge 164*b* such that a small gap exists between the second edge 172*b* and the second cover ridge 164*b*. In some embodiments, the second edge 172*b* may extend to the bottom of (or up a portion) the second cover ridge 164*b* such that no gap exists between the second edge 172*b* and the second cover ridge 164*b*. In some embodiments, the label 162 may have a third edge 172*c* that may be disposed at or adjacent to the contoured first end portion 169 of the contact area 166 and/or to the third perimeter edge 95*c* of the cover portion 22. The label 162 may also have a fourth edge 172*d* that may be disposed at or adjacent to the contoured second end portion 170 of the contact area 166 and/or to the fourth perimeter edge 95*d* of the cover portion 22.

All or a portion of the label 162 may include indicia or printing. The label 162 may be secured to the contact area 166 in any suitable manner. For example, a back surface (not shown) of the label 162 may have an adhesive that secures the label 162 to all or a portion of the contact area 166. In other embodiments, the label 162 may be attached or secured to the contact area 166 during molding (i.e., inmolded with all or a portion of the contact area 166 of the cover portion 22). Specifically, the label 162 may be placed in a portion of an injection mold that corresponds to the contact area 166 of the cover portion 22. Because the mold features that correspond to the first cover ridge 164*a* and the second cover ridge 164*b* would be recessed relative to the portion of the mold that corresponds to the contact area 166, the label 162 may be easily placed on the projecting mold feature corresponding to the contact area 166 for easy positioning. Static electricity (or an adhesive) may temporarily secure the label 162 to the projecting mold feature corresponding to the contact area 166 during the molding process to avoid shifting of the label 162 relative to the mold. When secured during the molding process, the label 162 is durable and will not easily tear or separate from the cover portion 22. One having ordinary skill in the art would recognize that applying the label 162 during molding also avoids the costly post-molding manufacturing step of applying an adhesive label 162 to the cover portion 22.

Figure 14A:
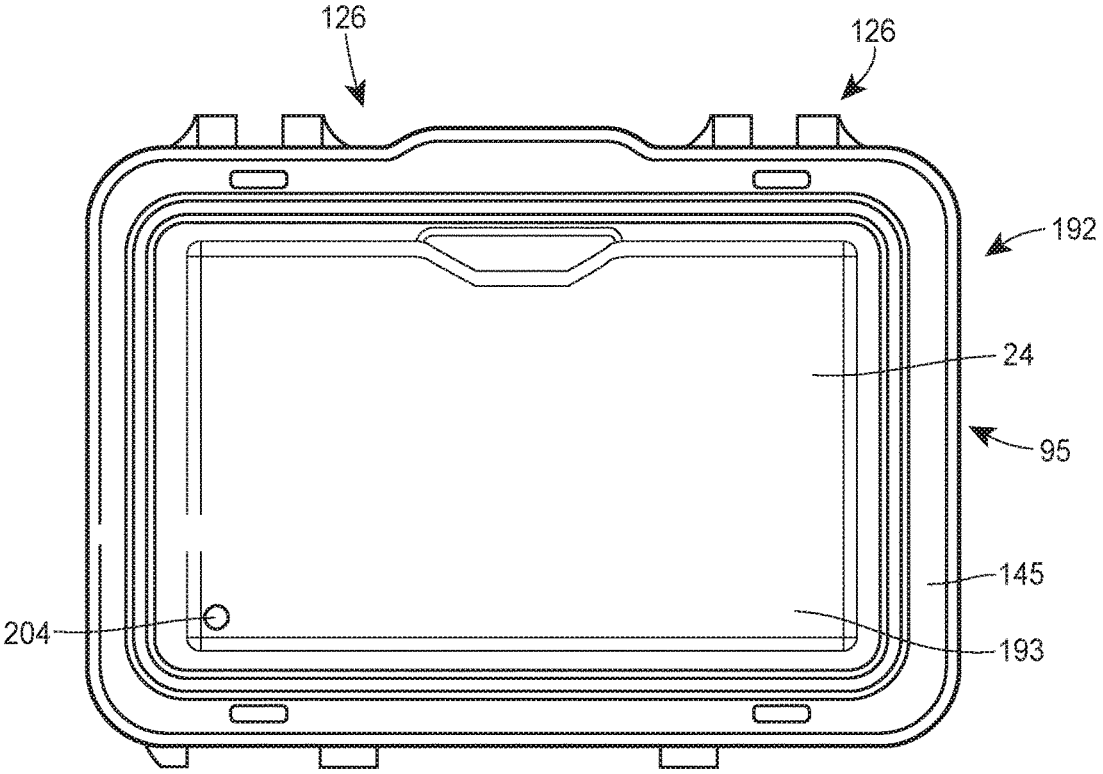
FIG. 14A is a plan view of a first side of an embodiment of a bottom cover component of the cover portion.

As illustrated in FIG. 7B, a seal 174 may be removably disposed on a surface 145 (shown in FIG. 14A) of the cover portion 22, and the seal 174 may be inwardly disposed from the perimeter edge 95 of the cover portion 22. In some embodiments, the seal 174 may be disposed or removably secured within in a feature formed in the surface 145 of the cover portion 22, such as a channel 176. The seal 174 may sealingly engage a portion of the upper surface 41 (see FIG. 2A) of the main portion 12 when the cover portion 22 is in the closed position of FIG. 1 such that thermal sealing is improved and to reduce or prevent the ingress of fluids into (or egress of fluids out of) the interior portion 16 of the cooler portion 11. Alternatively (or in addition), the seal 174 may be disposed along the upper surface 41 (see FIG. 2A) of the main portion 12 to sealingly engage a portion of the surface 145 (see FIG. 14A) of the cover portion 22.

In some embodiments, at least a portion of the seal 174 may be disposed in the channel 176 that extends along the surface 145 of the cover portion 22. The channel 176 may be inwardly disposed from the perimeter edge 95 of the cover portion 22 such that the channel 176 forms a continuous perimeter that corresponds in position to (and aligns with) a corresponding portion of the upper surface 41 (see FIG. 2A) of the main portion 12 when the cover portion 22 is in the closed position of FIG. 1.

Figure 13A:
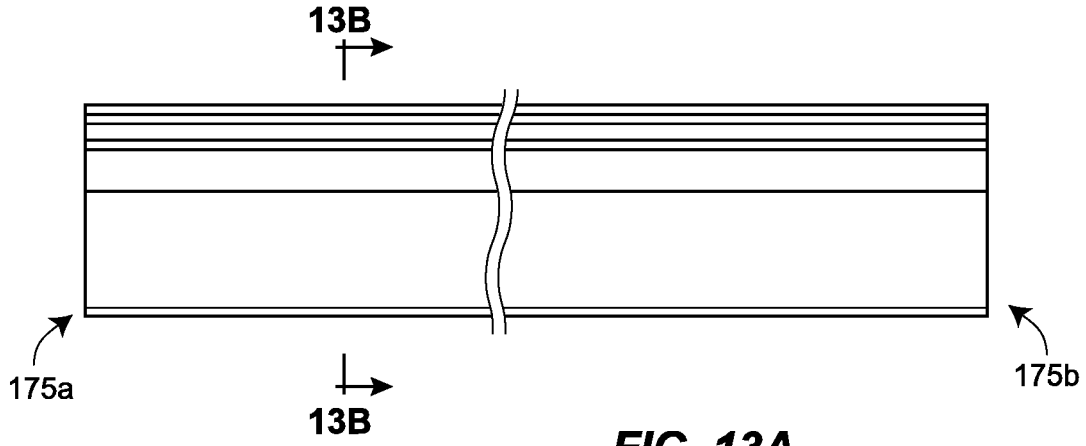
FIG. 13A is a partial side view of an embodiment of a seal adapted to be removably coupled to the cover portion.

In some embodiments, the seal 174 may be elongated and may extend from a first end 175*a* to a second end 175*b* when the seal 174 is positioned along a straight longitudinal axis, as illustrated in the partial view of FIG. 13A. In some embodiments, the seal 174 may be made from a flexible material (such as silicone) and may be flexible to allow the second end 175*b* of the seal 174 to be in contact with or adjacent to the first end 175*a* of the seal 174 when at least a portion of the seal 17 is disposed in the channel 176.

Figure 13B:
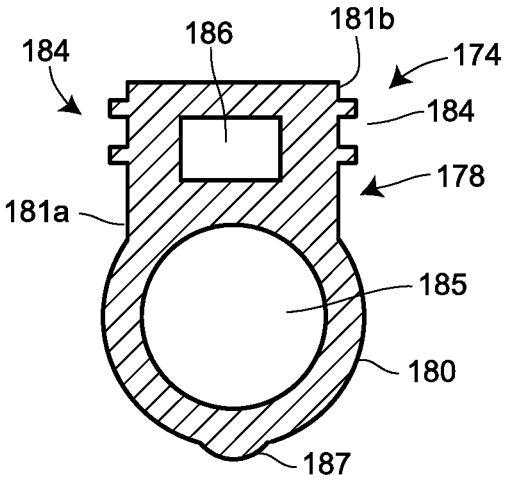
FIG. 13B is a cross-sectional view of the embodiment of the seal of FIG. 13A taken along section line 13B-13B of FIG. 13A.

In some embodiments, the seal 174 may have a mating portion 178 and a body portion 180, as illustrated in the cross-sectional view of the seal 174 of FIG. 13B. At least a portion of the mating portion 178 may be received in the channel 176 to retain the seal 174 within the channel 176, as illustrated in the cross-sectional view of the channel 176 of FIG. 13C (which is a cross-sectional portion of FIG. 7B). The mating portion 178 may have a cross-sectional shape that may generally correspond to the cross-sectional shape of the channel 176. For example, if the channel 176 has a cross-sectional shape that corresponds or generally corresponds to a square or a rectangle, the mating portion 178 of the seal 174 may have a cross-sectional shape that corresponds or generally corresponds to the corresponding square or rectangle. In some embodiments, the mating portion 178 may include lateral side walls 181*a* and 181*b* that may be offset from corresponding lateral side walls 182*a*, 182*b* of the channel 176. Each of the lateral side walls 181*a* and 181*b* of the mating portion 178 may include at least one rib 184 that extends from the lateral side walls 181*a* and 181*b* of the mating portion 178 to the corresponding lateral side walls 182*a*, 182*b* of the channel 176 such that an end portion of each rib 184 contacts the corresponding lateral side walls 182*a*, 182*b* of the channel 176. Each rib 184 may have a sufficient length to frictionally engage the corresponding lateral side walls 182*a*, 182*b* of the channel 176 to retain the mating portion 178 of the seal 174 in the channel 176. In some embodiments, each rib 184 extends (e.g., continuously extends) from the first end 175*a* to the second end 175*b* of the seal 174. In some embodiments, each of the lateral side walls 181*a* and 181*b* of the mating portion 178 may include two ribs 184, but any number of ribs 184 may be disposed on any of the lateral side walls 181*a* and 181*b* of the mating portion 178. So configured, the seal 178 may be removably retained in the channel 176 such that the seal 174 can be removed for cleaning or may be easily replaced if the seal 174 becomes damaged. In other embodiments, the mating portion 178 (with or without one or more of the ribs 184) may be retained in the channel 176 in any suitable manner, including by an adhesive and/or by one or more mechanical fasteners, for example.

The body portion 180 of the seal 174 may extend from an end of the mating portion 178, and the body portion 180 may have any suitable shape to sealingly engage the corresponding portion of the upper surface 41 (see FIG. 2A) of the main portion 12 when the cover portion 22 is in the closed position of FIG. 1. In some embodiments, the body portion 180 may have a circular cross-sectional shape, and the body portion 180 may have an aperture 185 (e.g., a circular aperture) disposed through the center of the circle. The aperture 185 may allow the body portion 180 to collapse or deform when pressure is applied during sealing. The aperture 185 may also improve the flexibility of the body portion of the seal 174, and the mating portion 178 may also include a similar aperture 186. A diameter of the body portion 180 may be greater than a distance between the lateral side walls 181*a* and 181*b* of the mating portion 178 and/or a distance between the lateral side walls 182*a*, 182*b* of the channel 176, and a ratio of the diameter of the body portion 180 and the distance between the lateral side walls 181*a* and 181*b* may be between 1.1 and 2, for example. In some embodiments, a protrusion 187 may be disposed at a portion of the body portion 180 opposite the mating portion 178, and the protrusion 187 may be positioned to contact and engage the corresponding portion of the upper surface 41 (see FIG. 2A) of the main portion 12 when the when the cover portion 22 is in the closed position of FIG. 1.

Figure 13C:
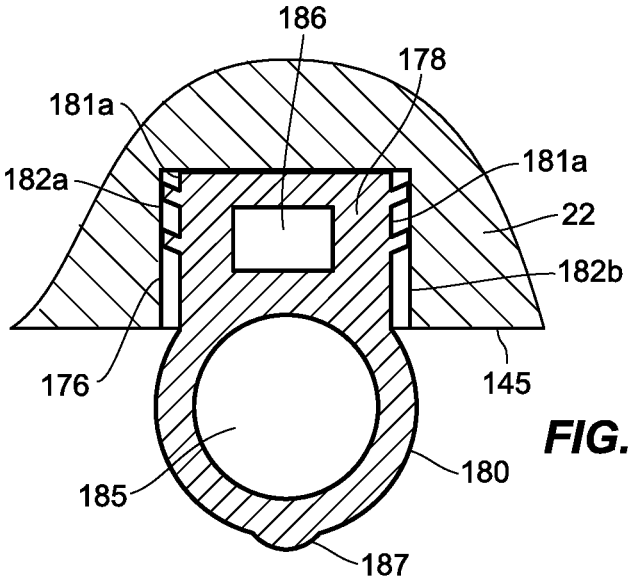
FIG. 13C is a cross-sectional view of the embodiment of the seal of FIG. 13B disposed within a channel of the cover portion.

The channel 176 may have any suitable cross-sectional shape to receive a portion of the seal 174 to retain the seal 174 in the channel 176 during use. For example, the channel 176 may have a U-shape, a V-shape, a rectangular shape (as illustrated in FIG. 13C), a square shape, or any combination of linear and curved shapes or segments. In addition, the mating portion 178 and/or the body portion 180 of the seal 174 may have a constant cross-sectional shape from the first end 175*a* to the second end 175*b*. In other embodiments, the mating portion 178 and/or the body portion 180 of the seal 174 may have a variable cross-sectional shape from the first end 175*a* to the second end 175*b*.

As illustrated in FIG. 7B, a light 97 may be provided in the cover portion 22 in or on at least one of the one or more interior surfaces 24 of the cover portion 22. For example, the light 97 may be a battery operated or solar operated light that may be disposed in a pocket formed in the one or more interior surfaces 24 of the cover portion 22. In some embodiments, the light may be permanently disposed in the cover portion 22 or may be removably from the cover portion 22. In some embodiments, the light 97 may be connected to one or more sensors such that the light is activated when the cover portion 22 is displaced from a closed position (as illustrated in FIG. 1) to an open position (as illustrated in FIG. 8), for example. The light 97 may have any suitable shape or configuration, such as the general shape of a trapezoid, as illustrated in FIG. 7B. In other embodiments, the light 97 may have a round or rectangular shape, for example. The light 97 may include one or more LEDs and/or any other suitable source of light. In some embodiments, more than one light 97 may be used.

In some embodiments, and in a manner similar to that of the main portion 12, the cover portion 22 may include one or more insulation materials (not shown) between the one or more interior surfaces 24 and the one or more exterior surfaces 96 of the cover portion. The one or more insulation materials may be any of the insulation materials 45 discussed in relation to the main portion 12. In some embodiments, the one or more insulation materials of the cover portion 22 may be the same as the one or more insulation materials 45 of the main portion 12. In other embodiments, the one or more insulation materials of the cover portion 22 may be different from the one or more insulation materials 45 of the main portion 12. In some embodiments, the cover portion 22 may be solid such that no space exists between the one or more interior surfaces 24 and the one or more exterior surfaces 96. Such embodiments of the cover portion 22 may result when the cover portion 22 is made or fabricated by an injection molding process.

The cover portion 22 may include any suitable number of components. In some embodiments, the cover portion 22 may include a single component part, and the one or more interior surfaces 24 of the cover portion 22 may be disposed on a first side of the single component part of the cover portion 22 and the one or more exterior surfaces 96 of the cover portion 22 may be disposed on a second side of the single component part of the cover portion 22.

Figure 7C:
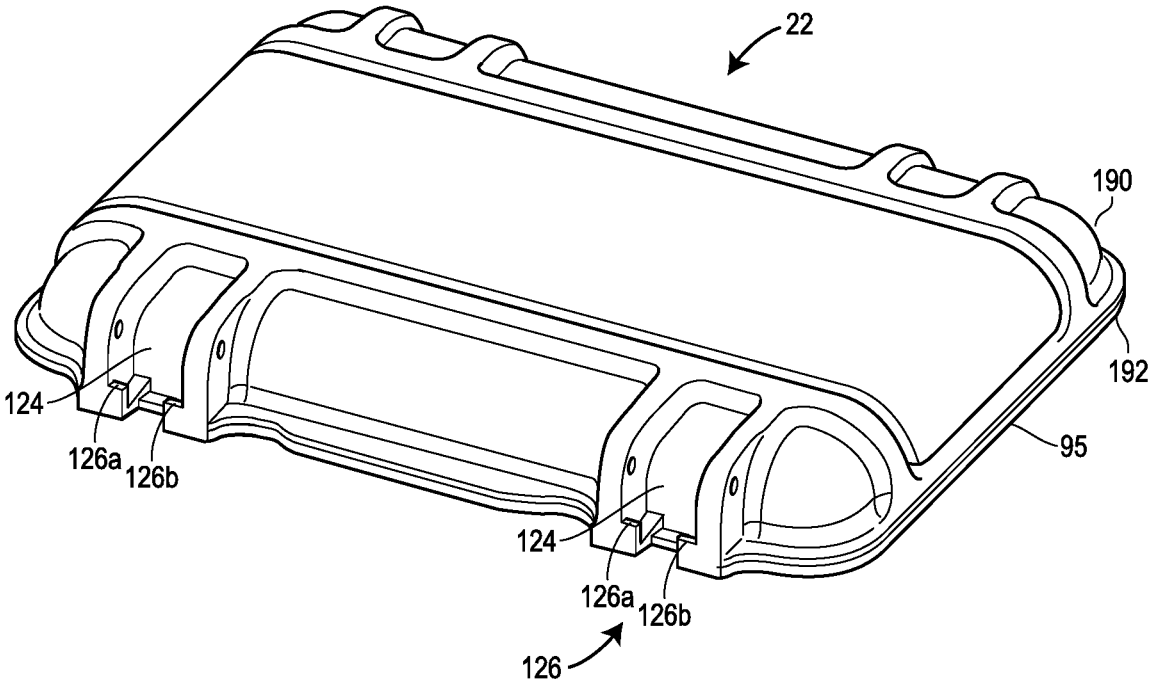
FIG. 7C is a perspective view of the embodiment of the cover portion 22 of FIG. 7A.

In other embodiments, the cover portion 22 may include two or more components that cooperate to form or define the cover portion 22. For example, as illustrated in FIG. 7C, the cover portion 22 may be made from a top cover component 190 that is coupled to a bottom cover component 192 to form the cover portion 22. In some embodiments, such as the plan view of the bottom cover component 192 in FIG. 14A, the bottom cover component 192 may be a plastic part (e.g., an injection molded plastic part) that has a first side 193 that includes the one or more interior surfaces 24 and the surface 145 of the cover portion 22. The first side 193 of the bottom cover component 192 may include indicia, such as one or more logo, that may be a textured portion of the material comprising the first side 193 of the bottom cover component 192. In other embodiments, the indicia may be printed on or adhered to the first side 193 of the bottom cover component 192. The bottom cover component 192 may include a second side 194 opposite the first side 193, as illustrated in the perspective view of the bottom cover component 192 illustrated in FIG. 14B.

Figure 14B:
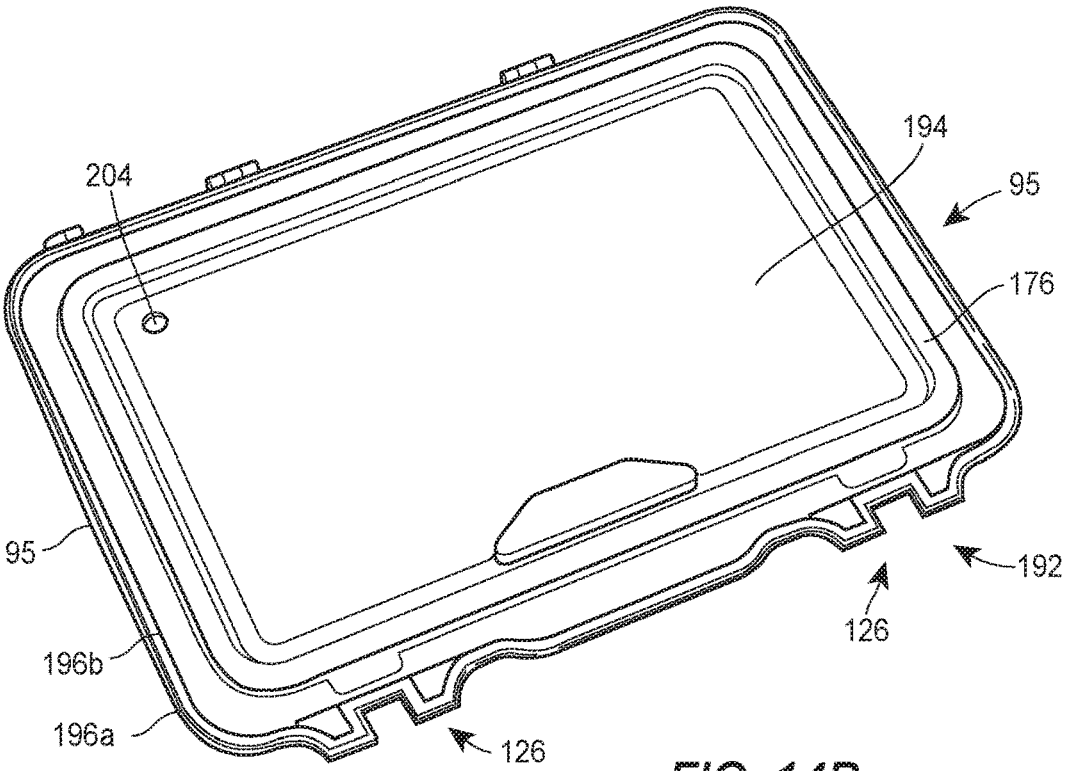
FIG. 14B is a perspective view of a second side of the bottom cover component of the cover portion.
Figure 14C:
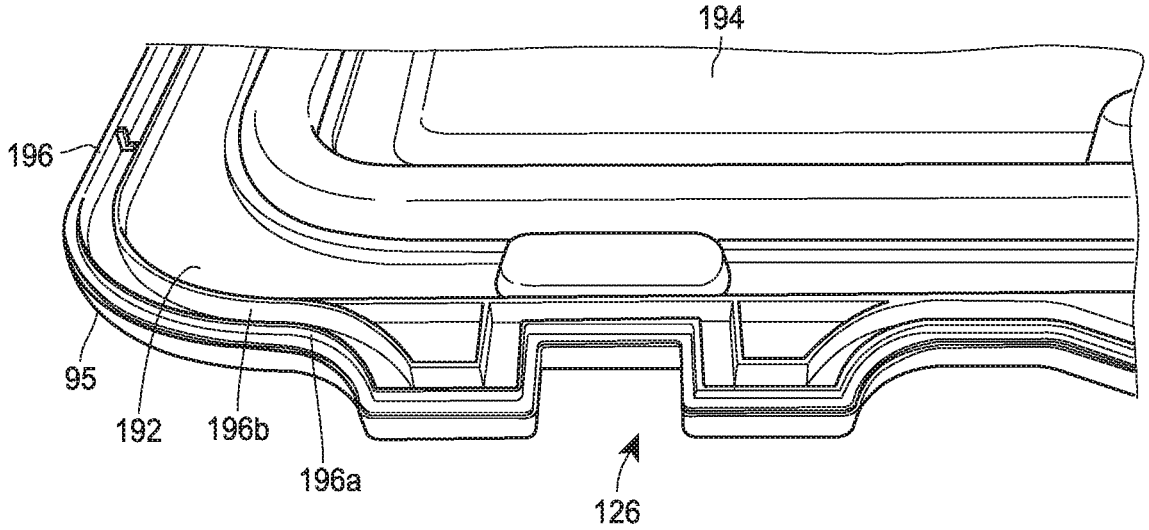
FIG. 14C is a detail view of a corner of the second side of the bottom cover component of FIG. 14B.

One or more portions of the perimeter edge 95 (e.g., a bottom portion of the perimeter edge 95) of the cover portion 22 may be defined in or by the bottom cover component 192. An outer bottom component perimeter wall 196*a* may extend upwards (or away) from the second side 194 of the bottom cover component 192 and may be slightly inwardly offset from the bottom portion of the perimeter edge 95, as illustrated in a detailed view of corner of the second side of the bottom cover component 192 provided in FIG. 14C. An inner bottom component perimeter wall 196*b* may extend upwards (or away) from the second side 194 of the bottom cover component 192 and may be inwardly offset from the outer bottom component perimeter wall 196*a*, as illustrated in FIG. 14C. One or both of the outer bottom component perimeter wall 196*a* or the inner bottom component perimeter wall 196*b* may extend along the entire bottom portion of the perimeter edge 95 that corresponds to the bottom cover component 192 or may extend along one or more portions of the bottom portion of the perimeter edge 95 that corresponds to the bottom cover component 192.

Figure 15A:
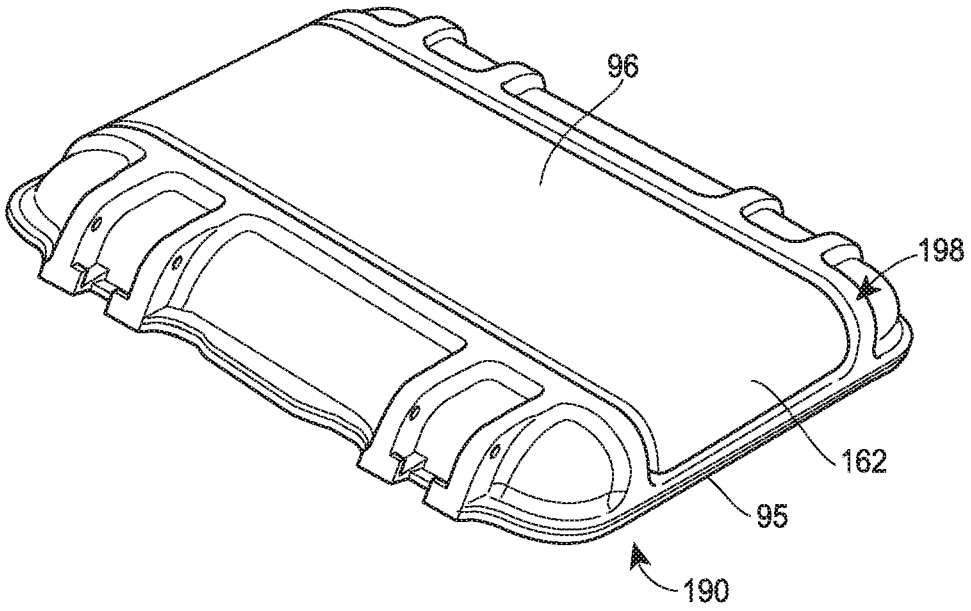
FIG. 15A is a perspective view of a first side of an embodiment of a top cover component of the cover portion.
Figure 15B:
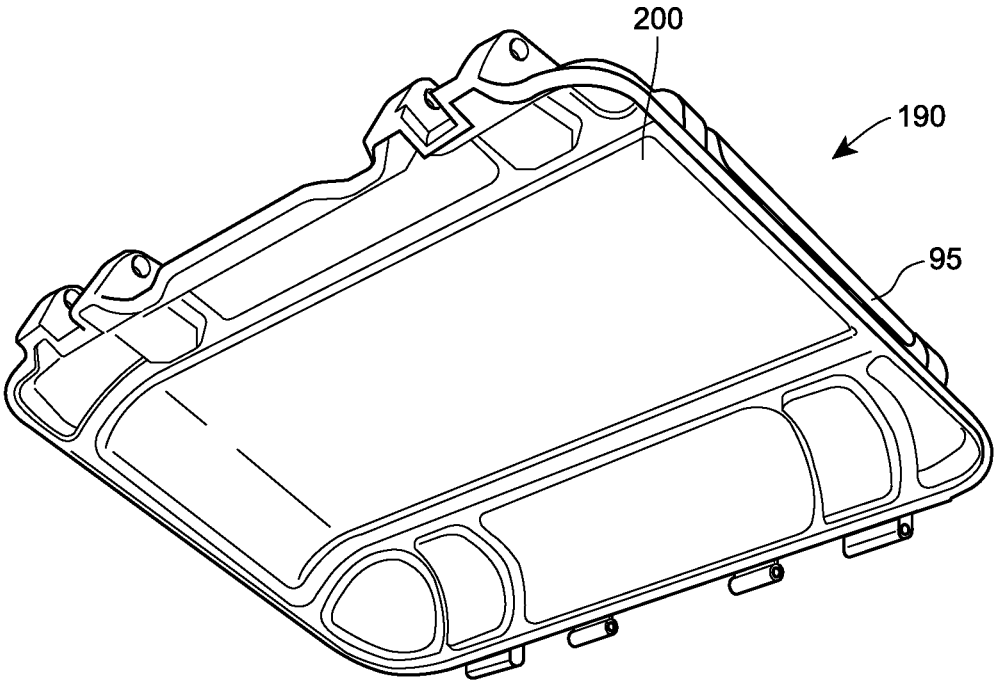
FIG. 15B is a perspective view of a second side of the top cover component of the cover portion.

In some embodiments, such as the perspective view of the top cover component 190 in FIG. 15A, the top cover component 190 may be a plastic part (e.g., an injection molded plastic part) that has a first side 198 that includes the one or more exterior surfaces 96 of the cover portion 22. The top cover component 190 may include a second side 200 opposite the first side 198, as illustrated in the perspective view of the top cover component 190 illustrated in FIG. 15B.

Figure 15C:
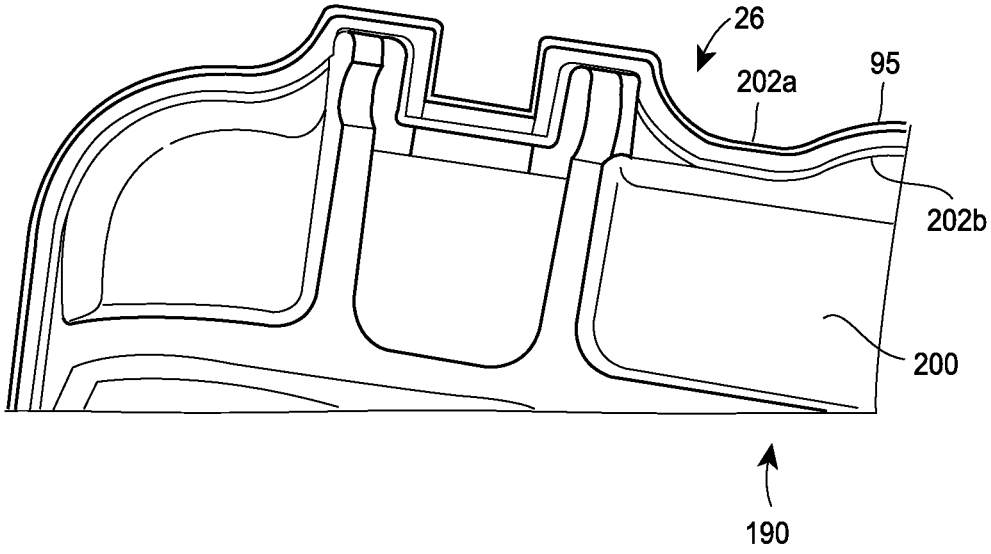
FIG. 15C is a detail view of a corner of the second side of the top cover component of FIG. 15B.

One or more portions of the perimeter edge 95 (e.g., a top portion of the perimeter edge 95) of the cover portion 22 may be defined in or by the top cover component 190. An outer top component perimeter wall 202*a* may extend upwards (or away) from the second side 200 of the top cover component 190 and may extend along the top portion of the perimeter edge 95, as illustrated in a detailed view of corner of the second side 200 of the top cover component 190 provided in FIG. 15C. An inner top component perimeter wall 202*b* may extend upwards (or away) from the second side 200 of the top cover component 190 and may be inwardly offset from the outer top component perimeter wall 202*a*, as illustrated in FIG. 15C. One or both of the outer top component perimeter wall 202*a* or the inner top component perimeter wall 202*b* may extend along the entire top portion of the perimeter edge 95 that corresponds to the top cover component 190 or may extend along one or more portions of the top portion of the perimeter edge 95 that corresponds to the top cover component 190.

The top cover component 190 may be secured to the bottom cover component 192 in any suitable manner. For example, the top cover component 190 may be secured to the bottom cover component 192 using an adhesive. That is, an adhesive may be placed or applied between the outer top component perimeter wall 202*a* and the inner top component perimeter wall 202*b* of the top cover component 190. The second side 200 of the top cover component 190 may then be aligned with and may face the second side 194 of the bottom cover component 192, and the portion of the top cover component 190 that corresponds to the top portion of the perimeter edge 95 of the cover portion 22 may be aligned with the portion of the bottom cover component 192 that corresponds to the bottom portion of the perimeter edge 95 of the cover portion 22. As the top cover component 190 and the bottom cover component 192 converge, one or both of the outer bottom component perimeter wall 196*a* and the inner bottom component perimeter wall 196*b* of the bottom cover component 192 may be disposed or inserted between the outer top component perimeter wall 202*a* and the inner top component perimeter wall 202*b* of the top cover component 190. The adhesive bonds to one or both of the outer bottom component perimeter wall 196*a* and the inner bottom component perimeter wall 196*b* that are disposed between the outer top component perimeter wall 202*a* and the inner top component perimeter wall 202*b* of the top cover component 190.

In other embodiments, the adhesive may be placed or applied between the outer bottom component perimeter wall 196*a* and the inner bottom component perimeter wall 196*b* of the bottom cover component 192, and one or both of the outer top component perimeter wall 202*a* and the inner top component perimeter wall 202*b* of the top cover component 190 may be disposed or inserted between the outer bottom component perimeter wall 196*a* and the inner bottom component perimeter wall 196*b* of the bottom cover component 192. The adhesive bonds to one or both of the outer top component perimeter wall 202*a* and the inner top component perimeter wall 202*b* of the top cover component 190 that are disposed between the outer bottom component perimeter wall 196*a* and the inner bottom component perimeter wall 196*b* of the bottom cover component 192. The adhesive may be any suitable adhesive, such as, for example, an epoxy, a solvent cement, cyanoacrylate, a contact adhesive, and/or polyurethane.

In other embodiments, the top cover component 190 may be fastened by one or more mechanical fasteners or internal snap features to the bottom cover component 192. In some embodiments, the top cover component 190 may be ultrasonically welded to the bottom cover component 192.

With the top cover component 190 secured to the bottom cover component 192, the second side 200 of the top cover component 190 may be offset from the second side 194 of the bottom cover component 192 to form an interior cover volume that may be filled with one or more insulation materials previously described. In some embodiments, the insulation material may be a foam insulation material that may be inserted or injected through an aperture formed in one or both of the top cover component 190. For example, as illustrated in FIG. 14B, the bottom cover component 192 may include an aperture 204 to receive the foam insulation material. In some embodiments, one or both of the second side 200 of the top cover component 190 and the second side 194 of the bottom cover component 192 may be flame treated to improve adhesion with the foam insulation material and/or the adhesive. In some embodiments, a cap (not shown) may close the aperture 204 following the insertion of the foam insulation material.

The top cover component 190 and the bottom cover component 192 may be made from any suitable material. For example, because the foam insulation material may harden and become rigid or semi-rigid upon drying, one or both of the top cover component 190 and the bottom cover component 192 may be made from or comprise a light-weight plastic material, such as polypropylene. The use of the foam insulation material and the polypropylene material allows the part to have a lighter weight than typical covers that are molded using heavier plastics, such as high-density polyethylene.

In some embodiments, the cover portion 22 may be pivotably or rotatably coupled to the main portion 12 in any suitable manner such that the cover portion 22 may pivot relative to the main portion 12 between a closed position illustrated in FIG. 1 to an open position illustrated in FIG. 8. For example, the cover portion 22 may be pivotably or rotatably coupled to the main portion 12 by a hinge. More specifically, as illustrated in FIG. 2A, the main portion 12 may include one or more hollow hinge members 98 that may be disposed at the first end 36 of the main portion 12. The one or more hollow hinge members 98 of the main portion 12 may coaxially align with one or more hollow hinge members 99 of the cover portion 22 that may be disposed adjacent to the perimeter edge 95 of the cover portion 22, and a hinge pin (not shown) may be disposed within the one or more hollow hinge members 98, 99 to rotatably couple the cover portion 22 to the main portion 12. As illustrated in FIG. 2A, the one or more hollow hinge members 98 of the main portion 12 may include at least two pairs of hinge members 98 disposed at a top portion of the second side wall 40*b*. As shown in FIGS. 7A and 7B, the one or more hollow hinge members 99 of the cover portion 22 may include a pair of single hinge members 99, and each hinge member 99 of the cover portion 22 is disposed between each pair of hinge members 98 of the main portion 12 to prevent lateral displacement of the cover portion 22 relative to the main portion 12. The hinge pins may be permanently disposed within the hollow hinge members 98, 99 to permanently couple the cover portion 22 to the main portion 12. Alternatively, the hinge pins may be removable from the hollow hinge members 98, 99 to allow the cover portion 22 to be removed from the main portion 12.

As illustrated in FIG. 1, the cover portion 22 may be releaseably secured to the main portion 12 by one or more closure members 100. In some embodiments, two closure members 100 may releaseably secure the cover portion 22 to the main portion 12. Each closure member 100 may have a closed position (illustrated in FIGS. 1 and 9) in which the closure member 100 secures the cover portion 22 to the main portion 12 and an open position (not shown) in which the closure member 100 is not engaged to one of the cover portion 22 or the main portion 12 to such that the closure member 100 does not secure the cover portion 22 to the main portion 12.

Figure 9:
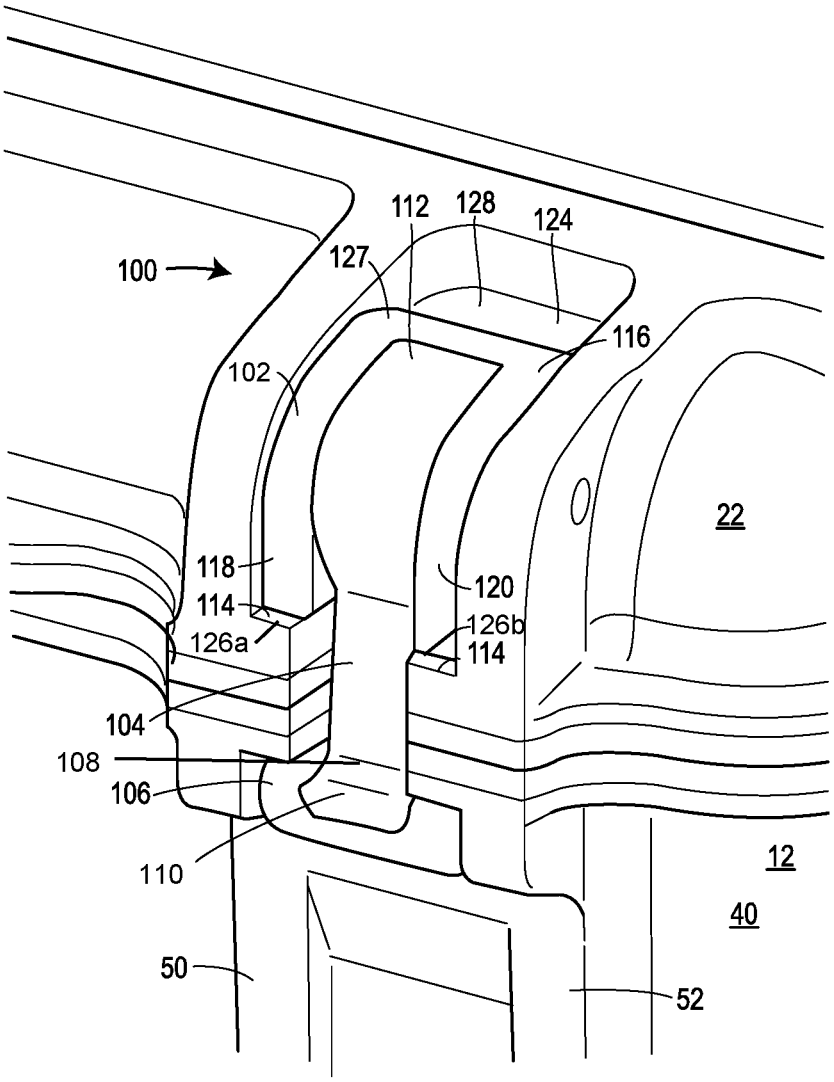
FIG. 9 is a detail of an embodiment of a closure member.

As illustrated in FIG. 9, which is a detail of the closure member 100 illustrated in FIG. 1, each closure member 100 may include a latch member 102, a connection member 104, and a support member 106. The support member 106 may be elongated and may be at least partially disposed in a support recess 108 formed in the main portion 12. The support recess 108 may be disposed between the first lateral ridge 50 and the second lateral ridge 52 of the main portion 12 at or adjacent to the first end 36 of the main portion 12. The support member 106 may be coupled to the main portion 12 in any suitable manner. For example, the support member 106 may be rotatably coupled to the main portion 12 such that the support member 106 may rotate about its longitudinal axis. In some embodiments, a first end of the support member 106 may be rotatably coupled to a first portion of the main portion 12 and a second end of the support member 106 may be rotatably coupled to a first portion of the main portion 12. In some embodiments, the support member 106 may be removably coupled to the main portion 12 such that the closure member 100 may be removed from the main portion 12. In other embodiments, the support member 106 may be permanently coupled to the main portion 12.

The connection member 104 may be coupled to both the support member 106 and the latch member 102. More specifically, the connection member 104 may be elongated, and a first portion 110 of the connection member 104 may be coupled to the support member 106 and have a second portion 112 of the connection member 104 may be coupled to the latch member 102. The first portion 110 of the connection member 104 may be disposed at or adjacent to a first end of the connection member 104 and/or the second portion 112 of the connection member 104 may be disposed at or adjacent to a second end of the connection member 104. In some embodiments, the first portion 110 of the connection member 104 may be rotatably coupled to the support member 106 such that the first portion 110 of the connection member 104 may rotate about a portion of the support member 106. The connection member 104 may be made from a resilient material that may deform or stretch when a force is applied to the first portion 110 in a direction opposite from the second portion 112. In other embodiments, the connection member 104 may be made from a rigid material that may not significantly deform when a force is applied to the first portion 110 in a direction opposite from the second portion 112.

Still referring to FIG. 9, the latch member 102 of the closure member 100 may be elongated, and the latch member 102 may extend from a first end 114 to a second end 116. The first end 114 of the latch member 102 may be adapted to engage one or more portions of the cover portion 22, and the second portion 112 of the connection member may be coupled to a portion of the latch member 102 that may be at or adjacent to the second end 116 of the latch member 102. In some embodiments, the second portion 112 of the connection member 104 may be coupled to a portion of the latch member 102 that may be between the first end 114 and the second end 116 of the latch member 102. In some embodiments, the latch member 102 may have a first arm portion 118 and a second arm portion 120 that each extend from opposite ends of a top portion 127. The top portion 127 may extend along the second end 116 of the latch member 102, and each of the first arm portion 118 and second arm portion 120 extends from the top portion 127 to the first end 114 of the latch member 102. In some embodiments, the first arm portion 118 and a second arm portion 120 may surround or be disposed on opposite sides of the second portion 112 of the connection member 104, and the second end of the connection member 104 may be disposed adjacent to the top portion 127 of the latch member 102.

When the closure member 100 is in the closed position of FIG. 9, the latch member 102 may be at least partially disposed within a latch recess 124 disposed on the cover portion 22. The first end 114 of the latch member 102 may engage a first lip portion 126*a* and/or a second lip portion 126*b* disposed in or adjacent to the latch recess 124 adjacent to the first end 114 of the latch member 102. The first lip portion 126*a* and/or a second lip portion 126*b* is also visible in the perspective view of the cover portion 22 provided in FIG. 7C. In some embodiments, and as illustrated in FIG. 9, an end of the first arm portion 118 of the latch member 102 may engage the first lip portion 126*a* and an end of the second arm portion 120 of the latch member 102 may engage the second lip portion 126*b* when the closure member 100 is in the closed position. In some embodiments, the end of the first arm portion 118 of the latch member 102 and the end of the second arm portion 120 of the latch member 102 may each be rounded and/or may have a reduced thickness to allow the latch member 102 to rotate about a portion of the latch recess 124 at the first lip portion 126*a* and the second lip portion 126*b*. So positioned, the latch member 102 may act as a cam to bias the latch member 102 into a position in which the closure member 100 is in the closed position, and a curved cross-sectional shape of the latch member (when viewed along the axis of the support member, which may be parallel to the X-axis of the reference coordinate system of FIG. 1) and/or a resilient force provided by the connection member 104 may contribute to the latch member 102 being biased into a position in which the closure member 100 is in the closed position. To open the closure member 100, a user may grasp the top portion 127 of the latch member 102 and rotate the top portion 127 away from the cover portion 22 (e.g., away from a bottom surface 128 of the latch recess 124) while the end of the first arm portion 118 of the latch member 102 engages the first lip portion 126*a* and the end of the second arm portion 118 of the latch member 102 engages the second lip portion 126*b*. Once the tension on the cam-shaped latch member 102 is relived (due to a relaxing in tension of the connection member 104, for example), the latch member 102 can be removed from the latch recess 124 to disengage the latch member 102 (and the main portion 12) from the cover portion 22.

To secure the cover portion 22 to the main portion, a user may position the end of the first arm portion 118 of the latch member 102 to engage the first lip portion 126*a* and the end of the second arm portion 118 of the latch member 102 to engage the second lip portion 126*b*. The user may then grasp the top portion 127 of the latch member 102 and rotate the top portion 127 towards the cover portion 22 (e.g., towards from a bottom surface 128 of the latch recess 124) while the end of the first arm portion 118 of the latch member 102 engages the first lip portion 126*a* and the end of the second arm portion 120 of the latch member 102 engages the second lip portion 126*b*. Rotation of the latch member 102 may continue until the top portion 127 of the latch member 102 is disposed in the position illustrated in FIG. 9 in which the top portion 127 is adjacent to the bottom surface 128 of the latch recess 124. Due to the rotation of the cam-shaped latch member 102, the connection member 104 may be lengthened and may provide a force to bias the latch member 102 into a position in which the closure member 100 is in the closed position. As described, the cam-shaped latch member 102 of the closure member 100 provides an easy to engage/disengage coupling device the reliably secures the cover portion 22 to the main portion 12 of the cooler portion 11.

As illustrated in FIGS. 1 and 2A, the cooler portion 11 may include one or more handle portions 48. The one or more handle portions 48 may be coupled to any portion of the main portion 12 or the cover portion 22 to allow a user to lift or move the cooler portion 11. As shown in FIG. 2A, the main portion 12 may include a first handle portion 48*a* and a second handle portion 48*b*, and each of the first handle portion 48*a* and the second handle portion 48*b* may be disposed at or adjacent to the first end 36 of the main portion 12. The first handle portion 48*a* may be disposed at a top portion of the third side wall 40*c* and the second handle portion 48*b* may be disposed at a top portion of the fourth side wall 40*d*. Each of the first handle portion 48*a* and the second handle portion 48*b* may extend in a direction along the X-Y plane of the reference coordinate system of FIG. 2B. Referring again to FIG. 2A, each of the first handle portion 48*a* and the second handle portion 48*b* may include a perimeter portion 49*a*, 49*b* that forms an aperture 51*a*, 51*b* adapted to receive part of a user's hand. Each perimeter portion 49*a*, 49*b* may be rounded or contoured for the user's comfort when the user grasps the corresponding first handle portion 48*a* and the second handle portion 48*b*.

One or more top-mounted accessories may also be removably attached to the top portion 22 in a manner similar to that discussed with respect to FIGS. 4A and 4B. Potential top-mounted accessories attachable to the top portion 22 may include a seat, a padded cushion, a decorative insert, a panel with graphics, a storage container, a storage pouch, a table, a cutting board, a holder for one or more electronic devices, a non-skid surface, a food preparation surface, and/or an interface for attaching other accessories, such as a frame for attaching a cooking device. Similar to FIGS. 4A and 4B, the top-mounted accessory may include a clip portion, similar to clip portion 70*a*, that removably secures to the top portion 22 using a spring force. For example, the top-mounted accessory clip portion may have one or more ends that removably engage a slot 276 formed in or on the top portion 22 (see FIG. 5). A spring force maintains the clip portion of the top-mounted accessory in place during normal use. Beneficially, the top-mounted accessory may be easily removed when not in use and/or may be exchanged with other top-mounted accessories as desired.

Figure 20A:
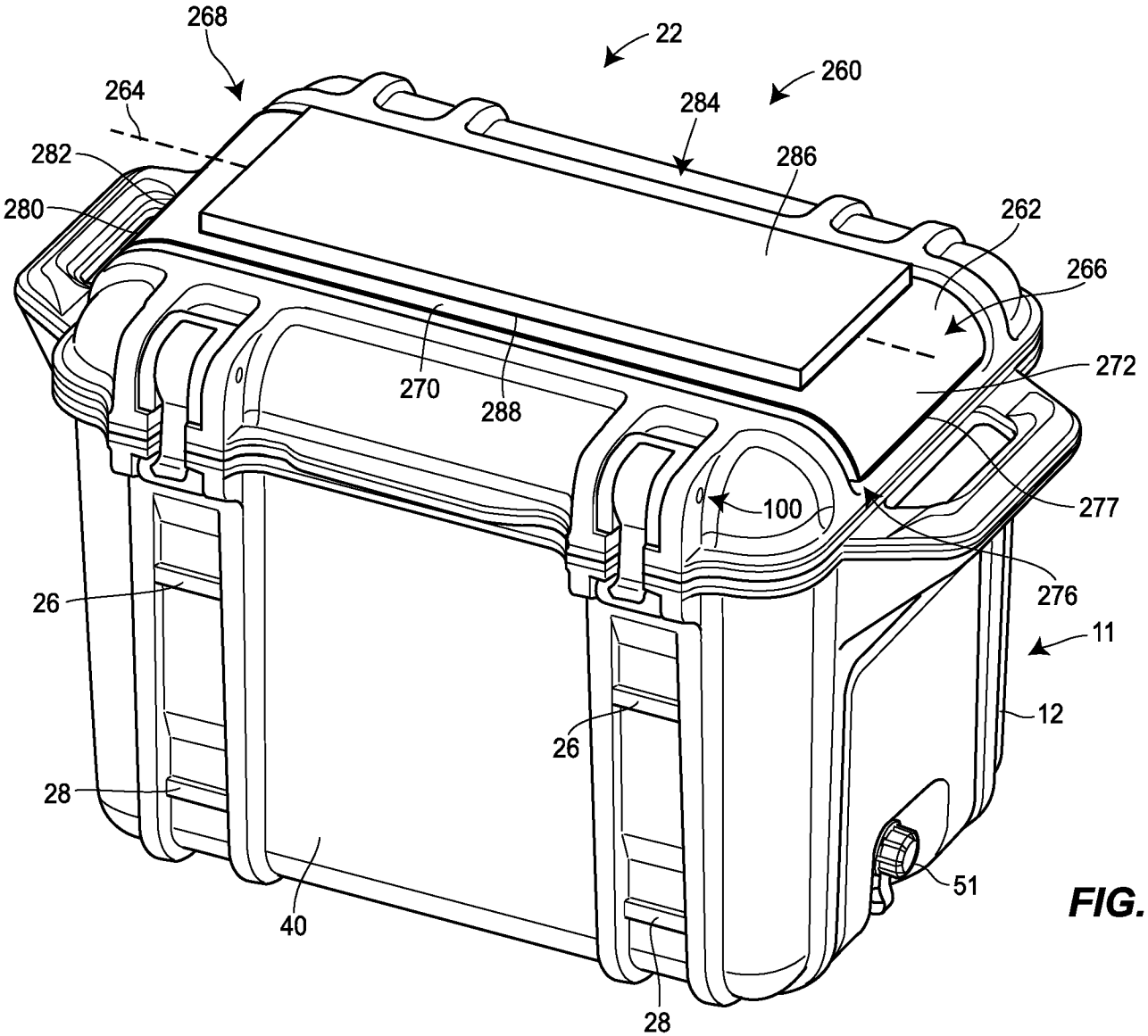
FIG. 20A is a perspective view of an embodiment of a cover attachment portion secured to the cover portion.

More particularly, and with reference to FIG. 20A, the cooler assembly 10 may include a cover attachment portion 260 that may be removably secured to one or more portions of the cover portion 22 or the main portion 12 in any suitable manner. The cover attachment portion 260 may include a support portion 262 that may extend along a support axis 264 from a first end 266 to a second end 268, and the support portion 262 may be removably secured to one or more portions of the cover portion 22 in any suitable manner. A support body 270 may extend from a first point at or adjacent to the first end 266 of the support portion 262 to a second point at or adjacent to the second end 268 of the support portion 262. The support portion 262 may also include a first body arm 272 and a second body arm 273. The first body arm 272 may extend away from the support body 270 at or adjacent to the first end 266 and the second body arm 273 may extend away from the support body 270 at or adjacent to the second end 268. The support portion 262 may be made or fabricated as a single, unitary part or may be an assembly of two or more parts. In addition, the support portion 262 may be made or fabricated from any suitable material, such as a plastic material.

Figure 20B:
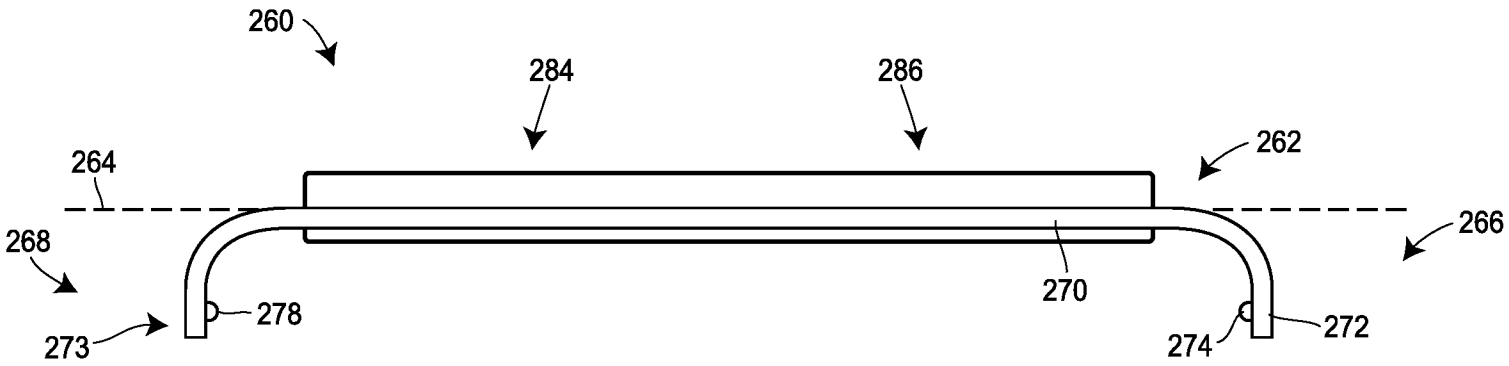
FIG. 20B is a side view of the embodiment of the cover attachment portion of FIG. 20A.

As shown in FIG. 20B, which illustrates a side view of the cover attachment portion 260, the first body arm 272 may include a first lip 274 disposed at or adjacent to an end portion of the first body arm 272, and the first lip 274 may removably engage (or be adapted to removably engage) a first portion 277 of the cover portion (or main portion 12) to at least partially secure the support portion 262 (and the cover attachment portion 260) to the cover portion 22 (or the main portion 12). In some embodiments, the first lip 274 may removably engage a first slot 276 formed in or on the first portion 277 of the cover portion 22 (or the main portion 12) to at least partially secure the support portion 262 (and the cover attachment portion 260) to the cover portion 22 (or the main portion 12). Because the first body arm 272 is cantilevered from the support body 270, a spring force maintains the first lip 274 within the first slot 276 during normal use. To remove the first lip 274 from the first slot 276, the first body arm 272 may displaced away from the first slot 276 to free the first lip 274. In some embodiments, a grip portion (not shown) may be disposed at or adjacent to the end portion of the first body arm 272, and the grip portion may be a tab that may facilitate the removal of the first lip 274 from the first slot 276 of the cover portion 22.

Still referring to FIG. 20B, the second body arm 273 may include a second lip 278 disposed at or adjacent to an end portion of the second body arm 273, and the second lip 278 may removably engage (or be adapted to removably engage) a second portion 282 of the cover portion 22 to at least partially secure the support portion 262 (and the cover attachment portion 260) to the cover portion 22 (or the main portion 12). In some embodiments, the second lip 278 may removably engage a second slot 280 formed in or on the second portion 282 of the cover portion 22 (or the main portion 12) to at least partially secure the support portion 262 (and the cover attachment portion 260) to the cover portion 22 (or the main portion 12). In some embodiments (not shown), the first slot 276 may extend from the first portion 277 of the cover portion 22 (or main portion 12) to the second portion 282 of the cover portion 22 (or main portion 12), and the first lip 274 may removably engage a first portion of the first slot 276 formed in or on the first portion 277 of the cover portion 22 (or main portion 12) and the second lip 278 may removably engage a second portion of the first slot 276 that is formed on the second portion 282 of the cover portion 22 (or main portion 12). Because the second body arm 273 is cantilevered from the support body 270, a spring force maintains the second lip 278 within the second slot 280 during normal use. To remove the second lip 278 from the second slot 280, the second body arm 273 may displaced away from the second slot 280 to free the second lip 278. In some embodiments, a grip portion (not shown) may be disposed at or adjacent to the end portion of the second body arm 273, and the grip portion may be a tab that may facilitate the removal of the second lip 278 from the second slot 280 of the cover portion 22.

The cover attachment portion 260 may also include an accessory portion 284 that may be coupled to or formed with the support portion 262. For example, the accessory portion 284 may be a cushion portion 286 that may be secured to the support portion 262 such that a top portion of the support portion 262 is disposed above or offset from a top surface of the support body 270 of the support portion 262. In some embodiments, the cushion portion 286 may be dimensioned and configured to seat one or more adults when the cover attachment portion 260 is coupled to the cover portion 22. In some embodiments, the support body 270 may include an aperture 288 for the cushion portion 286, and the cushion portion may be secured to a bottom surface of the support body 270. In other embodiments, the support body 270 may not have an aperture and the cushion portion 286 may be secured to or disposed on a top surface of the support body 270. The cushion portion 286 may have any suitable shape or thickness and may be made from any suitable material or combination of materials. For example, the cushion portion 286 and the aperture 288 may have a rectangular shape. So configured, with the cover attachment portion 260 secured to the cover portion 22 or the main portion 12, a user may use the cooler portion 11 as a seat.

In other embodiments (not shown), the accessory portion 284 may not be a cushion portion 286 (or may partially include a cushion portion 286), but may be any other feature or combination of features that can be coupled to the cover portion 22. For example, the accessory portion 284 may be (or include) a cutting board, a table top, a rack for a rifle, a support for a fishing tackle box, or a support for a speaker or other electronic device, or any other feature of combination of features disclosed above.

Further, one or more accessories correspond to the first attachment assembly 30*a* and/or the second attachment assembly 30*b* and may be removably attached to a side of the main portion 12. Potential side-mounted accessories may include a storage container, a storage pouch, a table, a cutting board, a cup holder, a fishing rod holder, a holder for one or more electronic devices, a non-skid surface, a food preparation surface, and/or an interface for attaching other accessories. A side-mounted accessory may contact or engage one or more of the handle portion 48, the main portion 12, and a slot 183 (illustrated in FIG. 5). In one specific example, a removable table accessory rests on top of the handle portion 48 and includes one or more arms that extend through the hole of the handle portion 48 down the side of the cooler portion 11 for support. The table accessory arm(s) may each include a lip or finger that extends into the slot 183 in order to keep the table accessory better held in place while in use.

More particularly, the first attachment assembly 30*a* may be an accessory clip 218 (illustrated in the front perspective view of FIG. 17A) that has a first attachment securement feature 219 that may be identical or substantially identical to the first attachment securement feature 32*a* previously described, and the first attachment securement feature 219 releaseably engages (or is adapted to releaseably engage) the first main portion securement feature 26 or the second main portion securement feature 28 to removably secure the accessory clip 218 to one or more exterior surfaces 18 of the main portion 12 of the cooler portion 11. In addition, the accessory clip 218 may also include a first accessory clip securement feature 220 that may be identical to the first main portion securement feature 26 previously described, and when the first attachment securement feature 219 of the accessory clip 218 releaseably engages the first main portion securement feature 26 (or the second main portion securement feature 28) of the main portion 12, a second attachment assembly 30*b* that may have a second attachment securement feature 32*b* may releaseably engage the first accessory clip securement feature 220 to removably secure the second attachment assembly 30*b* to the accessory clip 218.

Figure 17A:
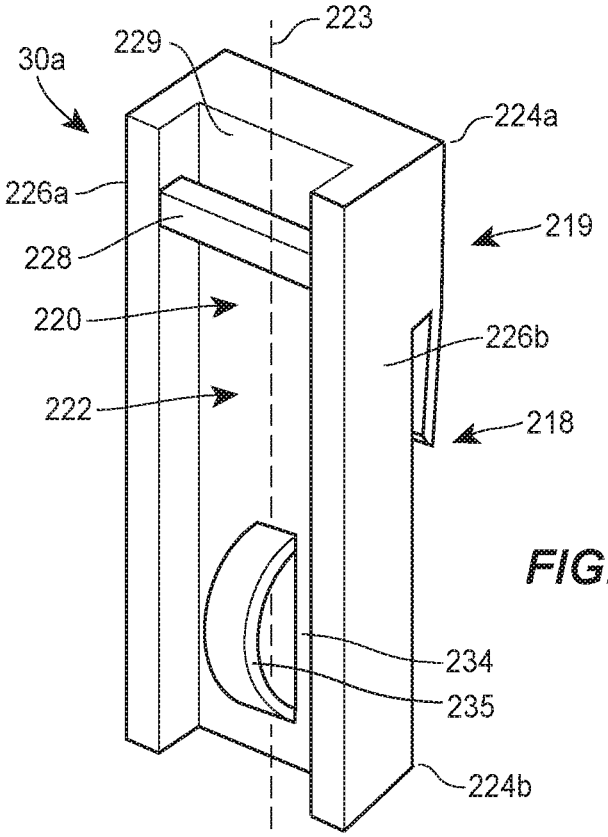
FIG. 17A is a front perspective view of an embodiment of an accessory clip.

As illustrated in FIG. 17A, the accessory clip 218 may include an accessory clip body 222 that may extend along a longitudinal axis 223 from a first end 224*a* to a second end 224*b*. The accessory clip body 222 may be planar or substantially planar, or a portion of the accessory clip body 222 at or adjacent to the first end 224*a* may be planar or substantially planar. A first lateral ridge 226*a* and a second lateral ridge 226*b* may extend from opposite lateral ends of the accessory clip body 222, and the first lateral ridge 226*a* and the second lateral ridge 226*b* may extend along the longitudinal axis 223. The first lateral ridge 226*a* and/or the second lateral ridge 226*b* may extend from the first end 224*a* to the second end 224*b* of the accessory clip body 222 or may extend over one or more portions of one or both of the opposite lateral ends of the accessory clip body 222. In other embodiments, the accessory clip body 222 does not have the first lateral ridge 226*a* and the second lateral ridge 226*b*.

Figure 17B:
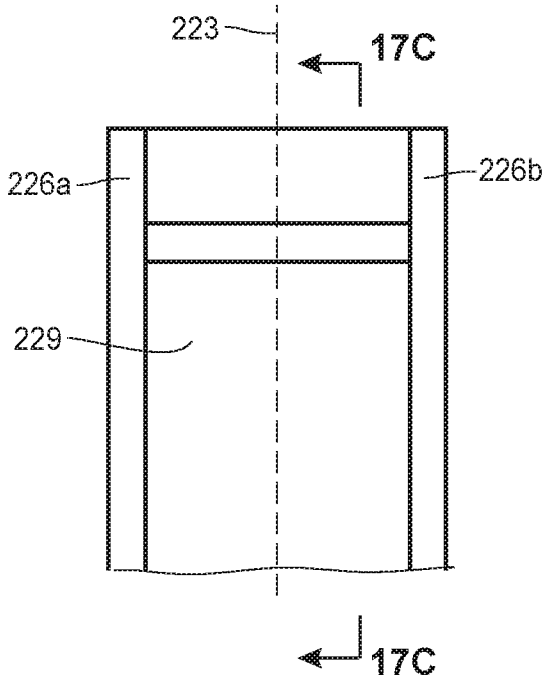
FIG. 17B is a front view of a top portion of the accessory clip of FIG. 17A.
Figure 17C:
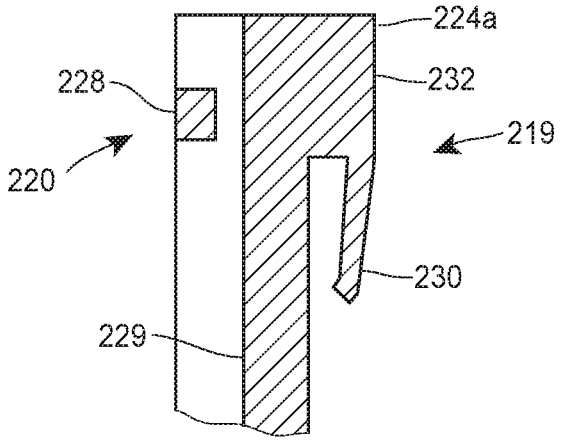
FIG. 17C is a partial cross-sectional view of the embodiment of the accessory clip of FIG. 17B taken along section line 17C-17C of FIG. 17B.

In some embodiments of the accessory clip 218, the first accessory clip securement feature 220 may include a first bar portion 228 that may be identical or substantially identical to the first bar portion 44*a* of the main portion 12. As illustrated in the front view of a top portion of the accessory clip 218 of FIG. 17B and the sectional view of FIG. 17C taken along section line 17C-17C of FIG. 17B, the first bar portion 228 (i.e., an inside surface of the first bar portion 228) may be offset from a portion of a front surface 229 of the accessory clip body 222, and the first bar portion 228 may extend normal to the longitudinal axis 223. The first bar portion 228 may be coupled to, formed with, or secured to the accessory clip body 222 in any suitable manner. For example, the first bar portion 228 may extend between the first lateral ridge 226*a* and the second lateral ridge 226*b*, and the first bar portion 228 may be integrally formed with or coupled to the first lateral ridge 226*a* and/or the second lateral ridge 226*b*. In embodiments without the first lateral ridge 226*a* and/or the second lateral ridge 226*b*, a first extension portion of the first bar portion 228 may extend outwardly from a first portion of the front surface 229 of the accessory clip body 222 and a second extension portion of the first bar portion 228 may extend outwardly from a second portion of the front surface 229 of the accessory clip body 222.

As previously explained, the first attachment securement feature 219 may be identical or substantially identical to the first attachment securement feature 32*a* previously described. That is, the first attachment securement feature 219 may include a first retaining arm 230 (illustrated in the cross-sectional view of FIG. 17C) that may be cantilevered from an arm base 232. The first retaining arm 230 and the arm base 232 may be identical or substantially identical to the first retaining arm 82*a* and the arm base 87*a*, respectively, of the first attachment securement feature 32*a* illustrated in FIGS. 4C and 4D. The first attachment securement feature 219 may also include a second retaining arm (not shown) that may be cantilevered from the arm base 232. The second retaining arm may be identical or substantially identical to the second retaining arm 89*a* illustrated in FIGS. 4C and 4E.

The accessory clip 218 may also include an accessory portion 234 coupled to or integrally formed with the accessory clip body 222. The accessory portion 234 may include any feature of combination of features that could be removably coupled to the main portion 12 (or the cover portion 22) of the cooler assembly 10. For example, as illustrated in FIG. 17A, the accessory portion 234 may include a ring portion 235 that is adapted to receive a portion of a carabineer (not shown), and an accessory may be attached to the carabineer. As an example of an accessory, a wireless speaker (not shown) may be attached to the carabineer that is itself attached to the ring portion 235. In some embodiments, the ring portion 235 may be disposed between the first bar portion 228 and the second end 224*b* of the accessory clip body 222. In other embodiments, the accessory portion 234 may include a wheel or portion of a wheel assembly (not shown) that is adapted to extend beyond the one or more bottom walls 42 (see FIG. 2A) to allow the cooler assembly 10 to be rolled. Such a wheel assembly may include two or more accessory clips 218 that are each adapted to be coupled to a corresponding first main portion securement feature 26 or second main portion securement feature 28 of the main portion 12 and/or cover portion 22 of the cooler portion 11. In some embodiments, a wheel assembly may include four accessory clips 218 and a support frame (not shown) that is adapted to support the main portion 12 of the cooler portion 11.

One having ordinary skill in the art would recognize that the disclosed accessory clips 218 allow a user to attach a first feature to the main portion 12 (or the cover portion 22) of the cooler assembly 10 and still have access to the first accessory clip securement feature 220 that can removably receive a first attachment securement feature 32*a* of an additional first attachment assembly 30*a* (or even an additional first attachment securement feature 219 of a further accessory clip 218).

Figure 18A:
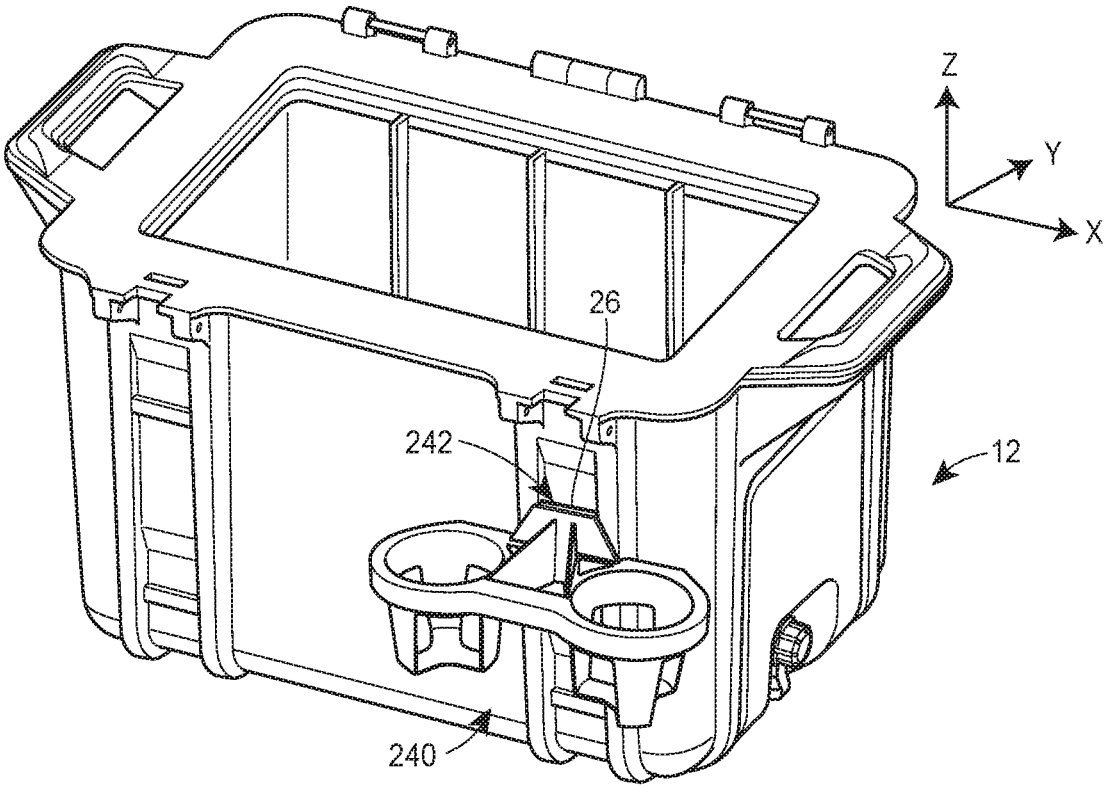
FIG. 18A is a perspective view of an embodiment of a cup holder assembly secured to the main portion.

In other embodiments, the first attachment assembly 30*a* may be a cup holder assembly 240, and an exemplary cup holder assembly 240 is illustrated as secured to the main portion 12 in the front perspective view of FIG. 18A. The cup holder assembly 240 may have a first attachment securement feature 242 that may be identical or substantially identical to the first attachment securement feature 32*a* previously described, and the first attachment securement feature 242 releaseably engages (or is adapted to releaseably engage) the first main portion securement feature 26 or the second main portion securement feature 28 to removably secure the cup holder assembly 240 to one or more exterior surfaces 18 of the main portion 12 of the cooler portion 11.

Figure 18B:
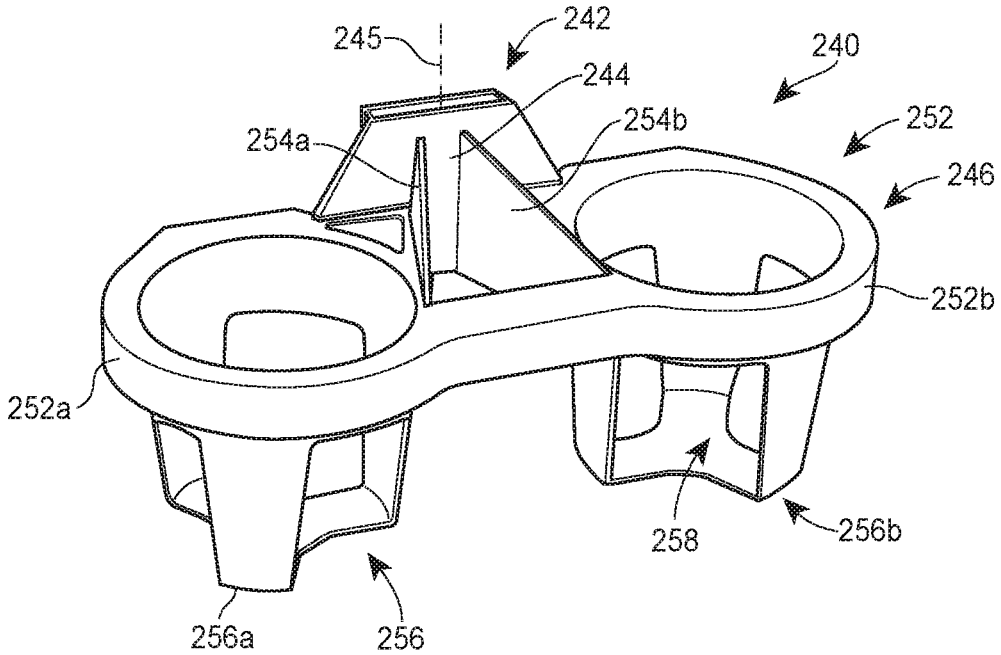
FIG. 18B is a perspective view of the cup holder assembly of FIG. 18A.

As illustrated in FIG. 18B, which illustrates a perspective view of the cup holder assembly 240, the cup holder assembly 240 may have a fixture portion 244, and the first attachment securement feature 242 may be coupled to or integrally formed with the fixture portion 244. The fixture portion 244 may extend along a fixture axis 245 that may be parallel to the Z-axis of the Reference Coordinate System of FIG. 18A when the cup holder assembly 240 is secured to the main portion 12. The fixture portion 244 may be planar or partially planar, and the first attachment securement feature 242 may be coupled to an end portion of the fixture portion 244.

Figure 18C:
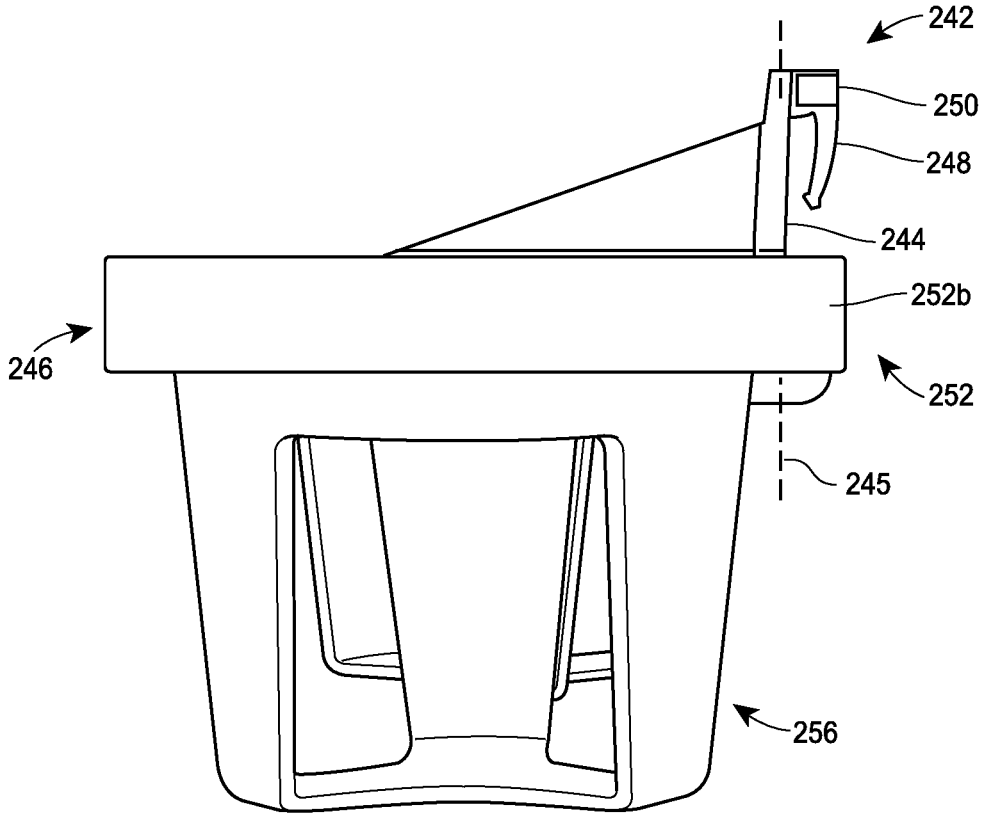
FIG. 18C is a side view of the cup holder assembly of FIG. 18A.

As previously explained, the first attachment securement feature 242 may be identical or substantially identical to the first attachment securement feature 32*a* previously described. That is, the first attachment securement feature 242 may include a first retaining arm 248 (illustrated in the side view of the cup holder assembly 240 of FIG. 18C) that may be cantilevered from an arm base 250. The arm base 250 may be disposed at or adjacent to an end portion of the fixture portion 244. The first retaining arm 248 and the arm base 250 may be identical or substantially identical to the first retaining arm 82*a* and the arm base 87*a*, respectively, of the first attachment securement feature 32*a* illustrated in FIGS. 4C and 4D. The first attachment securement feature 242 may also include a second retaining arm (not shown) that may be cantilevered from the arm base 250. The second retaining arm may be identical or substantially identical to the second retaining arm 89*a* illustrated in FIGS. 4C and 4E. When the first attachment securement feature 242 releaseably engages the first main portion securement feature 26 or the second main portion securement feature 28, a back portion of the fixture portion 244 may contact or be adjacent to a portion of each of the first lateral ridge 50 and the second lateral ridge 52 of the main portion 12 to provide support for the cup holder assembly 240.

As illustrated in FIG. 18B, the cup holder assembly 240 may also include cup support portion 246 that may be coupled to or integrally formed with the fixture portion 244 and/or a portion of the first attachment securement feature 242. The cup support portion 246 may have one or more circumferential supports 252 that are adapted to receive a bottom portion of a cup, can, or any suitable container for a beverage. In some embodiments, each of the one or more circumferential supports 252 defines a circle or a portion of a circle that is dimensioned and configured to receive a standard 12 oz. can or a beverage container having a circumference that that is larger (e.g., slightly larger) than a standard 12 oz. can. In some embodiments, a first circumferential support 252*a* may be disposed opposite a second circumferential support 252*a*. A first support rib 254*a* may extend from an inner portion of the first circumferential support 252*a* and a first portion of the fixture portion 244. A second support rib 254*b* may extend from an inner portion of the second circumferential support 252*b* and a second portion of the fixture portion 244. A cage portion 256 may be coupled to each of the one or more circumferential supports 252, and the cage portion 256 may be adapted to support a bottom of the beverage container when the beverage container is disposed in the cup holder assembly 240. In some embodiments, a first cage portion 256*a* may downwardly extend from the first circumferential support 252*a* and the second cage portion 256*b* may downwardly extend from the second circumferential support 252*b*. Each of the one or more cage portions 256 (e.g., the first cage portion 256*a* and the second cage portion 256*b*) may include two or more elongated gaps or apertures 258.

Figure 19A:
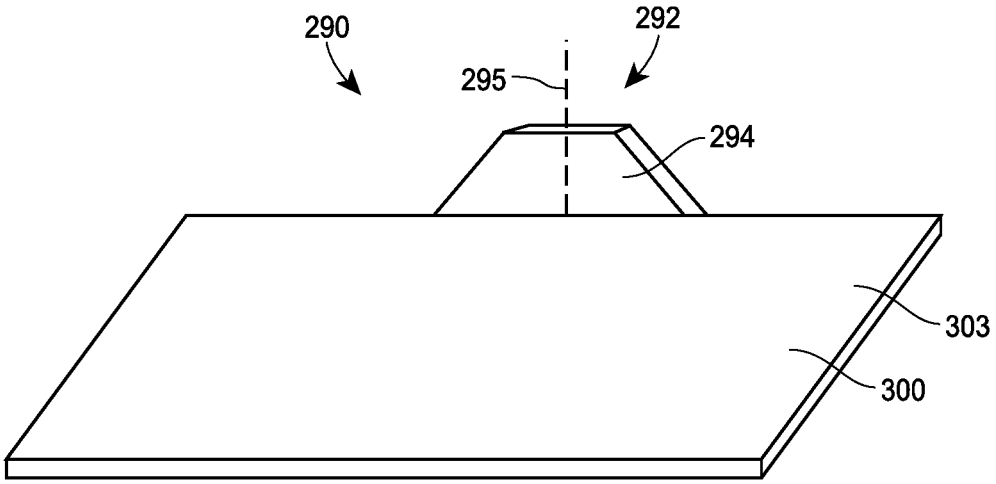
FIG. 19A is a perspective view of an embodiment of a side table portion.

In some embodiments, the first attachment assembly 30*a* may be a side table portion 290, and an embodiment of such a side table portion 290 is illustrated in the perspective view of FIG. 19A. The side table portion 290 may have a first attachment securement feature 292 that may be identical or substantially identical to the first attachment securement feature 32*a* previously described, and the first attachment securement feature 292 releaseably engages (or is adapted to releaseably engage) the first main portion securement feature 26 or the second main portion securement feature 28 to removably secure the side table portion 290 to one or more exterior surfaces 18 of the main portion 12 of the cooler portion 11 in a manner identical to that of the cup holder assembly 240 that was previously described.

Figure 19B:
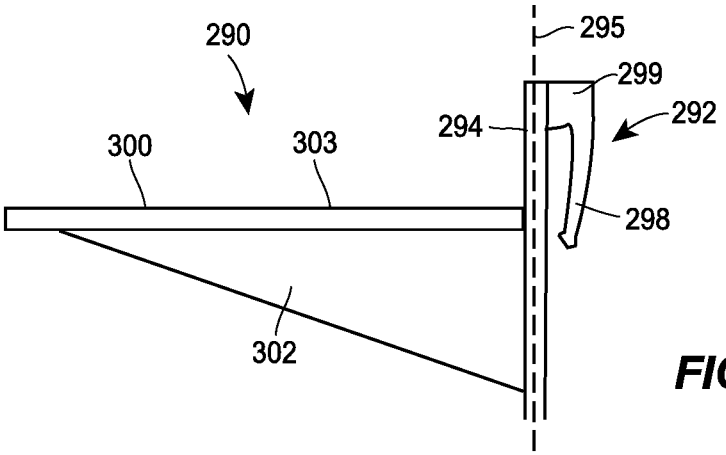
FIG. 19B is a side view of the embodiment of the side table portion of FIG. 19A.

The side table portion 290 may have a fixture portion 294, and the first attachment securement feature 292 may be coupled to or integrally formed with the fixture portion 294. As illustrated in FIG. 19B, which shows a side view of the side table portion 290, the fixture portion 294 may extend along a fixture axis 295 that may be parallel to the Z-axis of the Reference Coordinate System of FIG. 18A when the side table portion 290 is secured to the main portion 12. The fixture portion 294 may be planar or partially planar, and the first attachment securement feature 292 may be coupled to an end portion of the fixture portion 294.

As previously explained, the first attachment securement feature 292 may be identical or substantially identical to the first attachment securement feature 32*a* previously described. That is, as illustrated in FIG. 19B, the first attachment securement feature 292 may include a first retaining arm 298 that may be cantilevered from an arm base 299. The arm base 299 may be disposed at or adjacent to an end portion of the fixture portion 294. The first retaining arm 298 and the arm base 299 may be identical or substantially identical to the first retaining arm 82*a* and the arm base 87*a*, respectively, of the first attachment securement feature 32*a* illustrated in FIGS. 4C and 4D. The first attachment securement feature 292 may also include a second retaining arm (not shown) that may be cantilevered from the arm base 299. The second retaining arm may be identical or substantially identical to the second retaining arm 89*a* illustrated in FIGS. 4C and 4E. When the first attachment securement feature 292 releaseably engages the first main portion securement feature 26 or the second main portion securement feature 28, a back portion of the fixture portion 294 may contact or be adjacent to a portion of each of the first lateral ridge 50 and the second lateral ridge 52 of the main portion 12 to provide support for the side table portion 290.

Figure 19C:
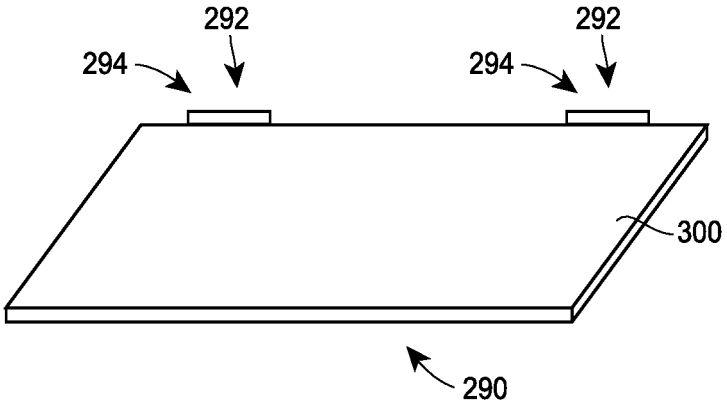
FIG. 19C is a perspective view of a further embodiment of a side table portion.

As illustrated in FIG. 19A, the side table portion 290 may also include a table portion 300 that may be coupled to or integrally formed with the fixture portion 294 and/or a portion of the first attachment securement feature 292. The table portion 300 may have a top surface portion 303 that may be planar or substantially planar. The table portion 300 may extend from the fixture portion 294 in a direction normal or substantially normal to the fixture axis 295. The table portion 300 may have any suitable shape or combination of shapes to provide a relatively flat surface for any suitable use or activity desired by a user, such as for preparing food or for use as a cutting board, for example. In some embodiments, the table portion 300 may have a square or rectangular shape, for example. In some embodiments, one or more support ribs 302 may extend between a bottom portion of the table portion 300 and corresponding portions of the fixture portion 294. In some embodiments, such as that illustrated in the perspective view of FIG. 19C, two fixture portions 294 may be coupled to the table portion 300 to provide a larger working space for a user, and the first attachment securement feature 292 of each fixture portion 294 may be adapted to be secured to a corresponding first main portion securement feature 26 or second main portion securement feature 28 of the main portion 12 (and/or cover portion 22).

Figure 19D:
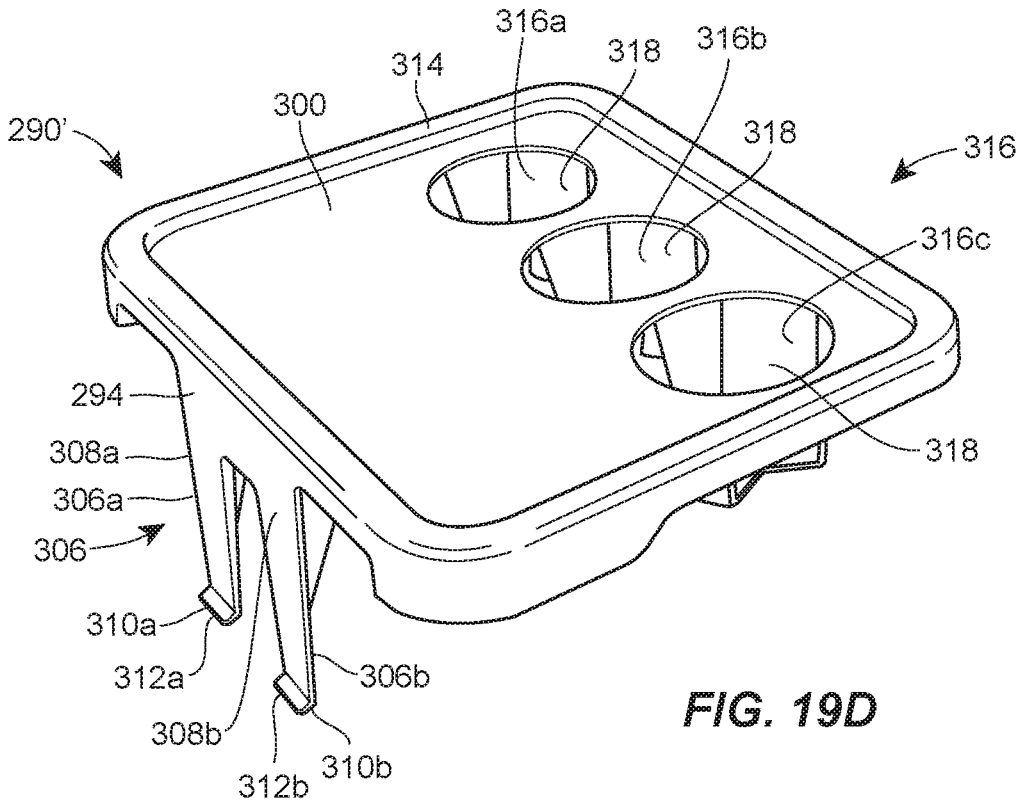
FIG. 19D is a perspective view of a further embodiment of a side table portion.

A further embodiment of a side table portion 290' is illustrated in the perspective view of FIG. 19D. Instead of the first attachment securement feature 292 previously described, the fixture portion 294 of the side table portion 290' may include one or more elongated support arms 306 that are adapted to be received through the aperture 51*a*, 51*b* (see FIG. 2A) of either of the first handle portion 48*a* or the second handle portion 48*b* of the main portion 12. In some embodiments, the side table portion 290' may include a first support arm 306*a* that extends from the fixture portion 284 from a first end 308*a* to a second end 310*a* along an axis that may be parallel or generally parallel to the fixture axis 295 (illustrated in FIG. 19A) of the fixture portion 294 and/or the Z-axis of the Reference Coordinate System of FIG. 18A when the side table portion 290' is secured to the main portion 12. The side table portion 290' may also include a second support arm 306*b* that extends from the fixture portion 284 from a first end 308*b* to a second end 310*b* along an axis that may be parallel or generally parallel to the fixture axis 295 (illustrated in FIG. 19A) of the fixture portion 294 and/or the Z-axis of the Reference Coordinate System of FIG. 18A when the side table portion 290' is secured to the main portion 12. The second end 310*a*, 310*b* of each of the first support arm 306*b* and the second support arm 306*b* may include a lip portion 312*a*, 312*b* adapted to engage a slot (e.g., the slot 183 of the main portion 12 illustrated in FIG. 5) formed in a corresponding one of the first side wall 40*a*, the second side wall 40*b*, the third side wall 40*c*, or the fourth side wall 40*d* of the main portion 12.

As illustrated in FIG. 19D, the side table portion 290' may also include the table portion 300 that may be coupled to or integrally formed with the fixture portion 294 and/or a portion of the first support arm 306*a* and/or the second support arm 306*b*. As previously explained, the table portion 300 may have any suitable shape or combination of shapes to provide a relatively flat surface for any suitable use or activity desired by a user, such as for preparing food or for use as a cutting board, for example. A raised perimeter ridge 314 may extend along all or a portion of the perimeter of the table portion 300. In some embodiments, one or more support ribs 302 may extend between a bottom portion of the table portion 300 and corresponding portions of the fixture portion 294 and/or the first support arm 306*a* and/or the second support arm 306*b*.

Figure 19E:
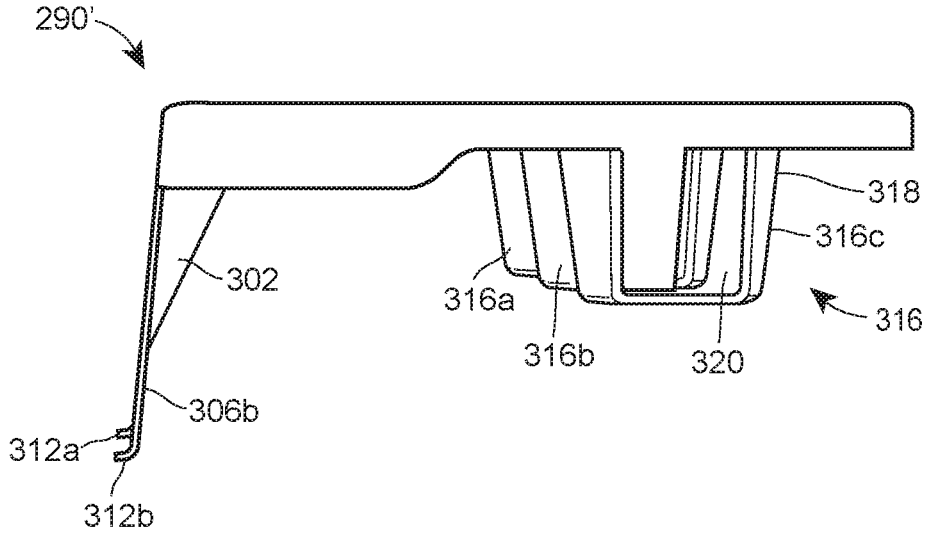
FIG. 19E is a side view of the embodiment of the side table portion of FIG. 19D.

Referring to the side view of the side table portion 290' of FIG. 19E, the side table portion 290' may have one or more cup holder portions 316 that may extend downward from the table portion 300 (e.g., downward from a top surface of the table portion 300). For example, the side table portion 290' may include a first cup holder portion 316*a*, a second cup holder portion 316*b*, and a third cup holder portion 316*c*. Each of the first cup holder portion 316*a*, the second cup holder portion 316*b*, and the third cup holder portion 316*c* may include a cage portion 318 may be coupled to a portion of the table portion 300, and each cage portion 318 may be adapted to support a bottom of the beverage container when the beverage container is disposed in the corresponding one of the first cup holder portion 316*a*, the second cup holder portion 316*b*, or the third cup holder portion 316*c*. As illustrated in FIG. 19E, each of the one or more cage portions 318 may include two or more elongated gaps or apertures 320.

Figure 10:
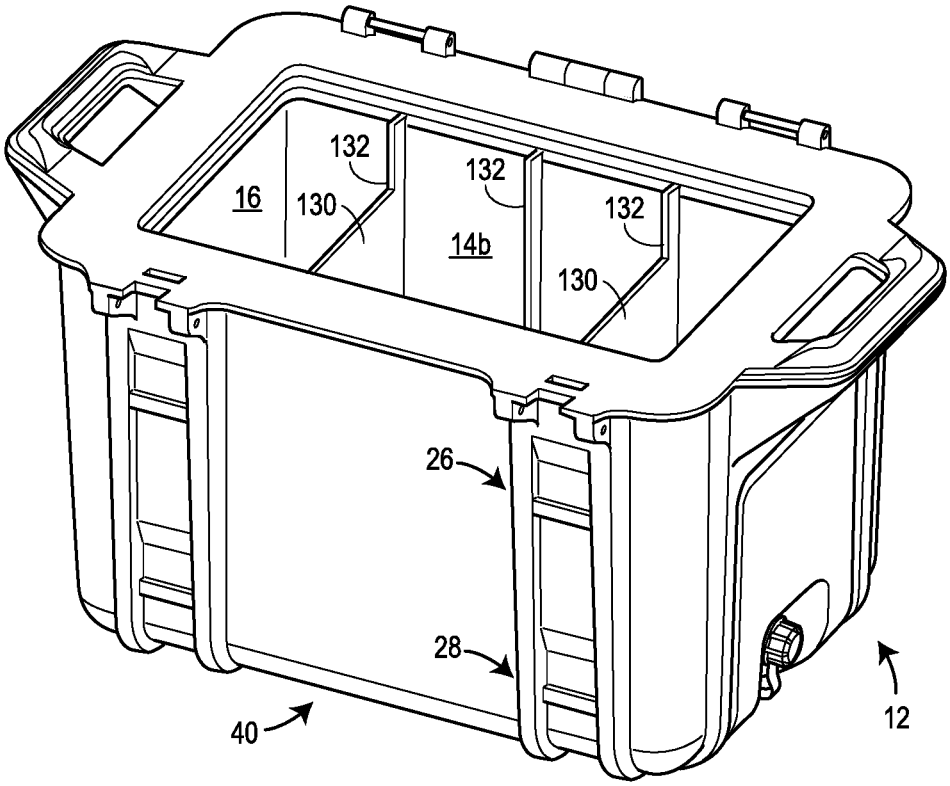
FIG. 10 is a perspective view of an embodiment of the main portion of the cooler portion including two partition members.

As illustrated in FIG. 10, which is a perspective view of an embodiment of the main portion 12, the cooler assembly 10 may additionally include one or more partition members 130 adapted to be slidingly received in one or more partition grooves 132 formed on or in one or more interior surfaces 14 of the main portion 12 of the cooler portion 11. As illustrated in FIG. 2E, which is a cross-sectional view of the main portion 12 taken along section line 2E-2E of FIG. 2B, each of the one or more partition grooves 132 may extend from a top end at or adjacent to the first end 36 of the main portion 12 to a bottom end adjacent to the second end 38 of the main portion 12 and/or at or adjacent to the interior surface 43 of the bottom wall 42. Each of the one or more partition grooves 132 may have any suitable geometry (e.g., depth or width) to allow an edge portion of the partition members 130 to be removably received into the partition grooves 132.

The main portion 12 may include any suitable number of partition grooves 132, such as a single pair of opposing partition grooves 132, two pairs of opposing partition grooves 132, three pairs of opposing partition grooves 132, or more. In some embodiments, and as illustrated in FIG. 2B, a first pair of partition grooves 132*a*, 132*b* may be formed in each of the first side wall interior surface 14*a* and the second side wall interior surface 14*b* and each of the first pair of partition grooves 132*a*, 132*b* may be aligned along a first Y-Z plane 133*a* (of the reference coordinate system of FIG. 2B). A second pair of partition grooves 132*c*, 132*c* may be formed in each of the first side wall interior surface 14*a* and the second side wall interior surface 14*b* and each may be aligned along a second Y-Z plane 133*b* that is offset from the first Y-Z plane 133*a* along the X-axis. A third pair of partition grooves 132*e*, 132*f* may be formed in each of the first side wall interior surface 14*a* and the second side wall interior surface 14*b* and each may be aligned along a third Y-Z plane 133*c* that is offset from the first Y-Z plane 133*a* and second Y-Z plane 133*b* along the X-axis. In some embodiments, any or all of the pairs of opposing partition grooves 132 may have any other orientation, such as aligned along an X-Z plane or in a plane angled relative to both the X-Z plane and the Y-Z plane. In some embodiments, any or all of the partition grooves 132 may not have an opposing partition groove 132.

Figure 11:
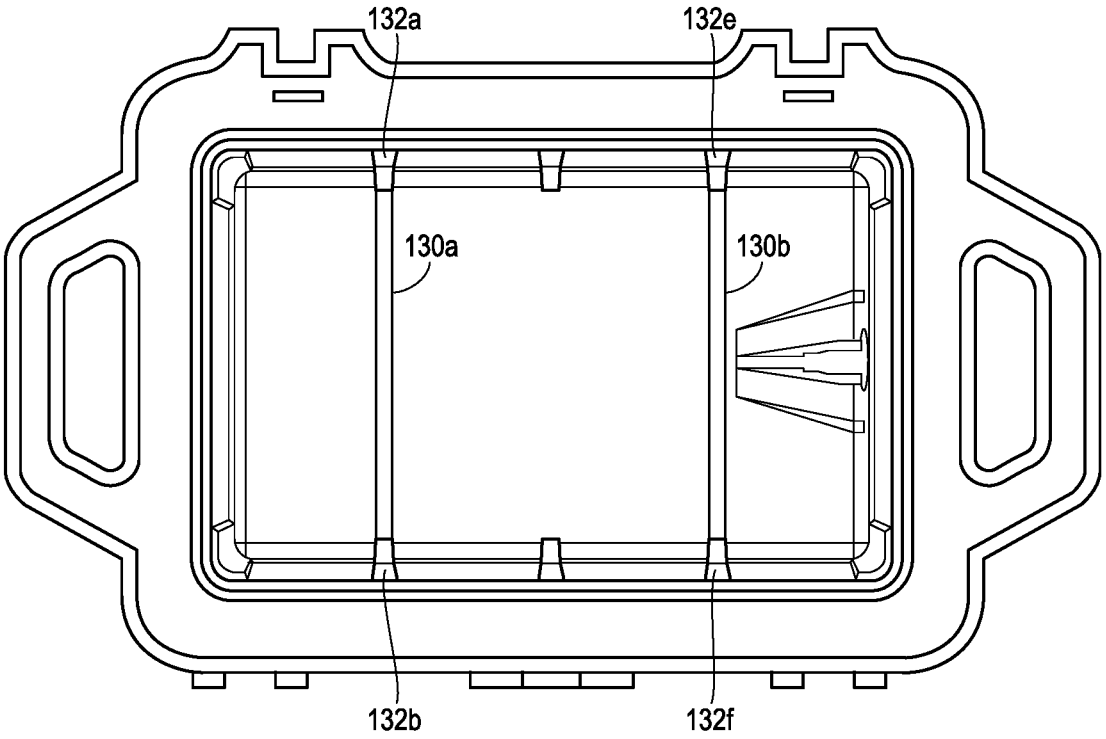
FIG. 11 is a top view of the embodiment of the main portion of FIG. 10.

As illustrated in FIG. 10, the one or more partition members 130 may be received (e.g., slidingly received) into any of the pairs of opposing partition grooves 132 to secure the partition member 130 to the main portion 12. Each partition member 130 may have any suitable size or shape such that at least one edge portion is received in a corresponding partition groove 130. In some embodiments, as illustrated in the top view of an embodiment of the main portion 12 provided in FIG. 11, a first partition member 130*a* may be planar or substantially planar and may extend between the first pair of partition grooves 132*a*, 132*b* such that a first end portion of the first partition member 130*a* may be disposed in one of the first pair of partition grooves 132*a* and a second end portion of the first partition member 130*a* may be disposed in the other of the first pair of partition grooves 132*a*, 132*b*. A second partition member 130*b* may be planar or substantially planar and may extend between the third pair of partition grooves 132*e*, 132*f* such that a first end portion of the second partition member 130*b* may be disposed in one of the third pair of partition grooves 132*e* and a second end portion of the third partition member 130*f* may be disposed in the other of the third pair of partition grooves 132*e*, 132*f*. A third partition member (not shown) may be planar and may extend between the second pair of partition grooves 132*c*, 132*d* in the same manner as the first partition member 130*a* and the second partition member 130*b*, as may any additional partition members 130 in additional partition grooves 132. Partition members may extend (along the Z-axis) from a bottom end disposed at or adjacent to a bottom end of the partition groove 132 to a top end that may be disposed at or the top end of the partition groove 132. In some embodiments, including that illustrated in FIG. 10, the top end of the partition member 130 may be disposed between the top end of the partition groove 132 and the bottom end of the partition groove 132. In some embodiments, the top end of the partition member 130 may be disposed beyond the top end of the partition groove 132.

To insert the partition member 130 in the partition grooves 132 (for example, to insert the first partition member 130*a* in the first pair of partition grooves 132*a*, 132*b*), the first end portion of the first partition member 130*a* may be aligned with one of the first pair of partition grooves 132*a* and the second end portion of the first partition member 130*a* may be aligned with the other of the first pair of partition grooves 132*a*, 132*b*. So positioned, the first partition member 130*a* may be downwardly displaced into the first pair of partition grooves 132*a* such that the bottom end of the first partition member 130*a* is disposed at or adjacent to a bottom end of the partition groove 132. The process is reversed to remove the first partition member 130 from the main portion 12.

With a desired number of partition members 130 disposed in the main portion 12, any suitable number of compartments may be created in the interior portion 16. For example, alcoholic beverages may be disposed in a first compartment, carbonated beverages may be disposed in a second compartment, and food may be disposed in a third compartment. The user can then easily find a desired item without searching within a pool of ice water for the item. In addition, the first end portion of the first partition member 130*a* may sealingly engage one of the first pair of partition grooves 132*a* and the second end portion of the first partition member 130*a* may sealingly engage the other of the first pair of partition grooves 132*a*, 132*b* to create a sealed compartment such that ice water may be disposed in the sealed compartment (for alcoholic beverages for example) and ice packs may be disposed in a dry compartment (for bread and lunchmeat, for example), thereby efficiently consolidating space for multiple types of stored items.

Figure 12A:
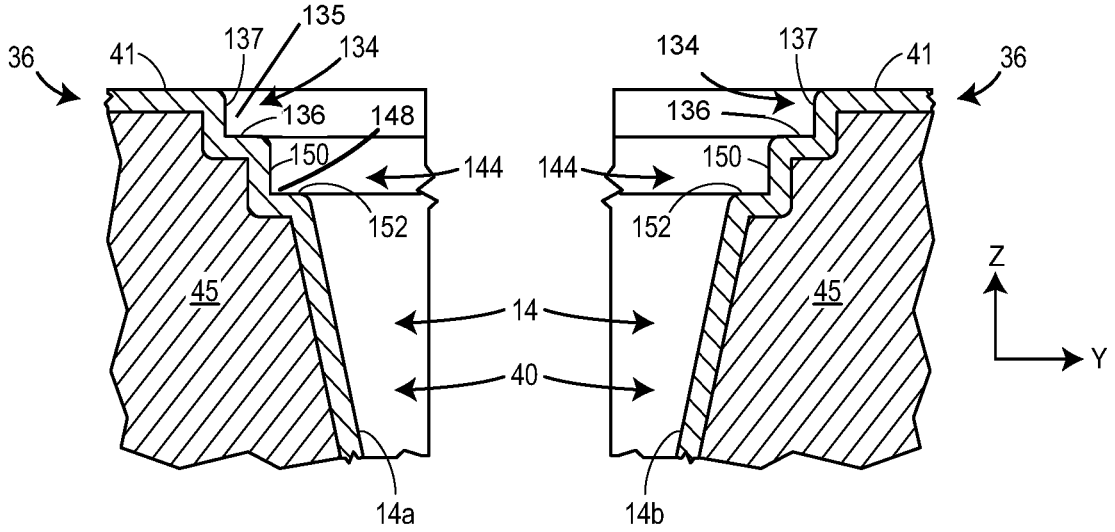
FIG. 12A is a partial cross-sectional view of an embodiment of the main portion having a first tray recess and a second tray recess.
Figure 12B:
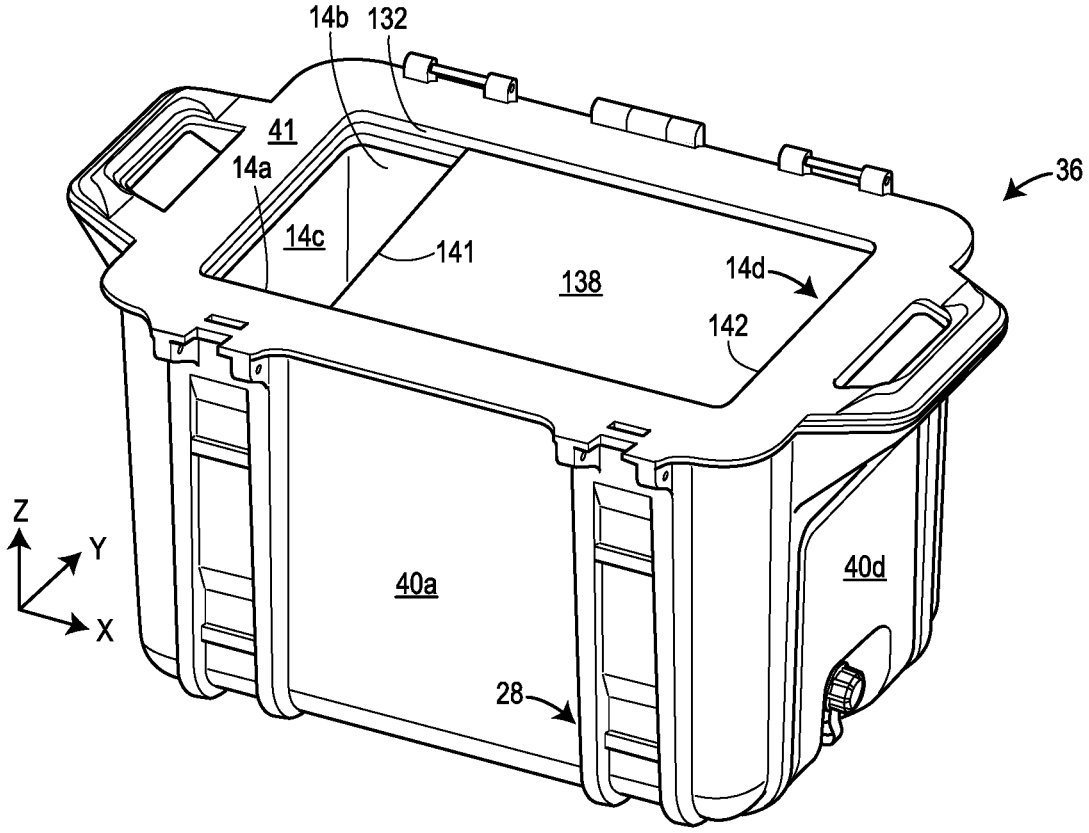
FIG. 12B is a perspective view of an embodiment of the main portion of FIG. 12A having a first tray in the first tray recess.

As illustrated in FIG. 2A, the main portion 12 may also include a first tray recess 134 around a perimeter portion of the one or more interior surfaces 14 of the one or more side walls 40 at or adjacent to the open first end 36 of the main portion 12. As illustrated in FIG. 12A, which is a partial cross-sectional view of an embodiment of the main portion 12, the first tray recess 134 may include a first shoulder portion 135 formed by a first outer wall 137 and a first ledge 136 that extends away from the first outer wall 137. The first tray recess 134 may extend around an entire perimeter of the one or more side walls 40 at or adjacent to the open first end 36. The first ledge 136 may provide a support for a first tray 138, which is illustrated in the perspective view of an embodiment of the main portion 12 of FIG. 12B. The first tray 138 may be planar or substantially planar and may have a dimension that allows opposing end portions to rest on opposing portions of the first ledge 136, as illustrated in FIG. 12B. For example, the first tray 138 may have a width dimension (e.g., a dimension along the Y-axis of the reference coordinate system of FIG. 12B) such that a first lateral end portion 139 is supported by a portion of the first ledge 136 extending along the first side wall interior surface 14*a* and a second lateral end portion 140 is supported by a portion of the first ledge 136 extending along the second side wall interior surface 14*b*. As illustrated in FIG. 12B, the first tray 138 may have a length dimension (e.g., a dimension along the X-axis of the reference coordinate system of FIG. 12B) such that a distance between a first main end portion 141 and a second main end portion 142 is less that (e.g., 20% to 80% less than) a distance between the third side wall interior surface 14*c* and the fourth side wall interior surface 14*d* taken at the first end 36 of the main portion 12 along the X-axis of the reference coordinate system of FIG. 12B. So configured, the first tray 138 may slide along the first tray recess 134 to a desired position.

In other embodiments, the first tray 138 may have a length dimension such that a distance between the first main end portion 141 and the second main end portion 142 is slightly less than (e.g., 2% to 5% less than) the distance between the third side wall interior surface 14*c* and the fourth side wall interior surface 14*d* taken at the first end 36 of the main portion 12 along the X-axis of the reference coordinate system of FIG. 12B. So configured, the first tray 138 may cover the entire open first end 36 of the main portion 12. That is, the first lateral end portion 139 may be supported by a portion of the first ledge 136 extending along the first side wall interior surface 14*a*, the second lateral end portion 140 may be supported by a portion of the first ledge 136 extending along the second side wall interior surface 14*b*, the first main end portion 141 may be supported by a portion of the first ledge 136 extending along the third side wall interior surface 14*c*, and the second main end portion 142 may be supported by a portion of the first ledge 136 extending along the fourth side wall interior surface 14*d*.

Figure 12C:
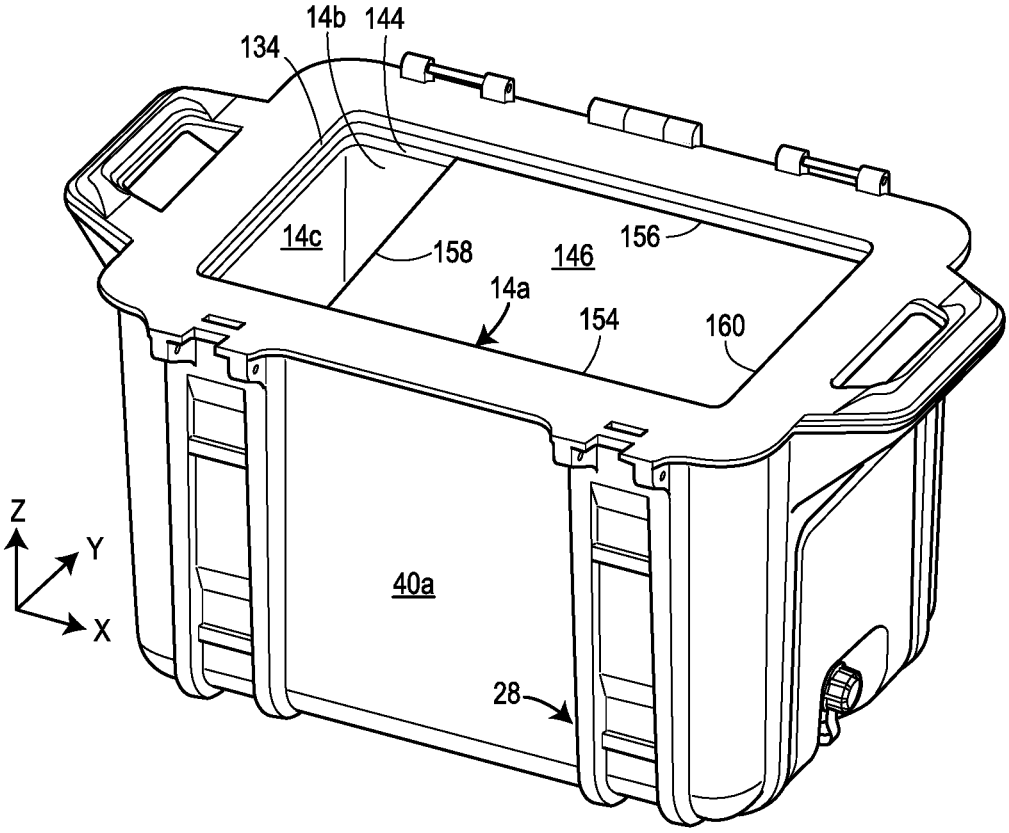
FIG. 12C is a perspective view of an embodiment of the main portion of FIG. 12A having a second tray in the second tray recess.

As illustrated in FIG. 2A, the main portion 12 may additionally include a second tray recess 144 around a perimeter portion of the one or more interior surfaces 14 of the one or more side walls 40 at or adjacent to the open first end 36 of the main portion 12. As illustrated in FIG. 12A, the second tray recess 144 may include a second shoulder portion 148 formed by a second outer wall 150 and a second ledge 152 that extends away from the second outer wall 150. The second tray recess 144 may extend around an entire perimeter of the one or more side walls 40 at or adjacent to the open first end 36. The second ledge 152 may provide a support for a second tray 146, which is illustrated in the perspective view of an embodiment of the main portion 12 of FIG. 12C. The second tray 146 may be planar or substantially planar and may have a dimension that allows opposing end portions to rest on opposing portions of the second ledge 152, as illustrated in FIG. 12C. For example, the second tray 146 may have a width dimension (e.g., a dimension along the Y-axis of the reference coordinate system of FIG. 12B) such that a first lateral end portion 154 is supported by a portion of the second ledge 152 extending along the first side wall interior surface 14*a* and a second lateral end portion 156 is supported by a portion of the second ledge 152 extending along the second side wall interior surface 14*b*. As illustrated in FIG. 12C, the second tray 146 may have a length dimension (e.g., a dimension along the X-axis of the reference coordinate system of FIG. 12B) such that a distance between a first main end portion 158 and a second main end portion 160 is less that (e.g., 20% to 80% less than) a distance between the third side wall interior surface 14*c* and the fourth side wall interior surface 14*d* taken at the first end 36 of the main portion 12 along the X-axis of the reference coordinate system of FIG. 12B. So configured, the second tray 146 may slide along the second tray recess 144 to a desired position.

In other embodiments, the second tray 146 may have a length dimension such that a distance between the first main end portion 158 and the second main end portion 160 is slightly less than (e.g., 2% to 5% less than) the distance between the third side wall interior surface 14*c* and the fourth side wall interior surface 14*d* taken at the first end 36 of the main portion 12 along the X-axis of the reference coordinate system of FIG. 12B. So configured, the second tray 146 may cover the entire open first end 36 of the main portion 12. That is, the first lateral end portion 154 may be supported by a portion of the second ledge 152 extending along the first side wall interior surface 14*a*, the second lateral end portion 156 may be supported by a portion of the second ledge 152 extending along the second side wall interior surface 14*b*, the first main end portion 158 may be supported by a portion of the second ledge 152 extending along the third side wall interior surface 14*c*, and the second main end portion 160 may be supported by a portion of the second ledge 152 extending along the fourth side wall interior surface 14*d*.

The first tray 138 and the second tray 146 may have any suitable thickness. In some embodiments, the first tray 138 may have a thickness such that a top surface of the first tray 138 is coplanar or substantially coplanar with the upper surface 41 of the main portion 12 to maximize a working surface provided by the top surface of the first tray 138 and the upper surface 41 of the main portion 12. In some embodiments, the second tray 146 may have a thickness such that the second tray 146 may be disposed in the second tray recess 144 while the first tray 138 is disposed in the first tray recess 134 for storage. In some embodiments, one or more of the partition members 130 may also be used as the first tray 138 and/or the second tray 146 (and vice versa).

So configured, the first tray 138 and/or the second tray 146 may provide a convenient working surface when preparing food or beverages while using the cooler assembly 10. For example, the first tray 138 and/or the second tray 146 may act as a cutting board for the chopping of food or may act as a table or support In some examples, the cooler assembly 10 may include one or more temperature sensors and/or temperature indication devices. A temperature sensor may measure a temperature at one or more locations internal to cooler assembly 10 and provide information about the measured temperature(s), thereby enabling a user to get information about the temperature(s) without necessarily having to open the cooler portion 11. The temperature information may be transferred or transmitted to a temperature indication device that is on an outside surface of the cooler portion 11. The temperature information may be transferred through a wired, wireless, fluidic, and/or mechanical connection. In other examples, the temperature information may be transferred to a remote device, such as to a smartphone or another computing device. In one specific example, the temperature information may be transferred through a BLUETOOTH connection, or through a similar wireless connection, to a software application running on a smartphone. In other examples, the information may be transferred to a remote computing device over a cellular network and/or over the Internet.

While various embodiments have been described above, this disclosure is not intended to be limited thereto. Variations can be made to the disclosed embodiments that are still within the scope of the appended claims.

What is claimed is:

1. A cooler assembly for the storage of one or more objects, the cooler assembly comprising:

a cooler portion, the cooler portion comprising:

a main portion having one or more side walls having one or more interior surfaces that at least partially define an interior portion that is adapted to receive the one or more objects, wherein one or more exterior surfaces of the one or more side walls of the main portion define an exterior portion of the cooler portion, wherein the main portion includes a bottom wall having a gate feature, the gate feature being surrounded by a gate groove;

a cover portion at least one of pivotably coupled to or removably secured to the main portion, wherein when the cover portion is in a closed position relative to the main portion, one or more interior surfaces of the cover portion at least partially define the interior portion, wherein the cover portion includes a contact area that extends along a portion of one or more exterior surfaces of the cover portion;

a label extending over all or a portion of the contact area of the cover portion and inmolded with all or a portion of the contact area of the cover portion;

a first main portion securement feature disposed at a first location on at least one of the one or more side walls of the main portion; and a second main portion securement feature disposed at a second location on at least one of the one or more side walls of the main portion.

2. The cooler assembly of claim 1, wherein the cover portion includes a first cover ridge and a second cover ridge and wherein the contact area extends between the first cover ridge and the second cover ridge.

3. The cooler assembly of claim 1, further comprising:

a cover attachment portion removably secured to one or more portions of the cover portion, the cover attachment portion including a support portion extending from a first end to a second end, and a cushion portion coupled to the support portion, wherein the support portion of the cover attachment portion includes a first body arm and a second body arm, the first body arm having a first lip adapted to removably engage a first slot formed in a first portion of the cover portion and the second body arm having a second lip adapted to removably engage a second slot formed in a second portion of the cover portion.

4. The cooler assembly of claim 1, wherein the cover portion includes a top cover component coupled to a bottom cover component, the bottom cover component including an outer bottom component perimeter wall and an inner bottom component perimeter wall, and the top cover component including an outer top component perimeter wall and an inner top component perimeter wall, and an adhesive is disposed between the outer bottom component perimeter wall and the inner bottom component perimeter wall.

5. The cooler assembly of claim 1, further comprising a seal removably secured within a channel formed in a surface of the cover portion, the seal adapted to sealingly engage a surface of the main portion when the cover portion is in the closed position.

6. The cooler assembly of claim 1, further comprising:

a first attachment assembly, the first attachment assembly having a first attachment securement feature adapted to releaseably engage the first main portion securement feature or the second main portion securement feature of the cooler portion to removably secure the first attachment assembly to at least one of the one or more side walls of the main portion.

7. The cooler assembly of claim 6, wherein the first attachment assembly is an accessory clip having a ring portion, the accessory clip having a first accessory clip securement feature adapted to releasably engage a second attachment securement feature of a second attachment assembly.

8. The cooler assembly of claim 6, wherein the first attachment assembly is a cup holder assembly including a cup support portion and a cage portion coupled to the cup support portion.

9. The cooler assembly of claim 6, wherein the first attachment assembly is a side table portion including a table portion having a planar top surface portion.

10. A cooler assembly for the storage of one or more objects, the cooler assembly comprising:

a cooler portion, the cooler portion comprising:

a main portion having one or more side walls having one or more interior surfaces that at least partially define an interior portion that is adapted to receive the one or more objects, wherein one or more exterior surfaces of the one or more side walls of the main portion define an exterior portion of the cooler portion;

a cover portion at least one of pivotably coupled to or removably secured to the main portion, wherein when the cover portion is in a closed position relative to the main portion, one or more interior surfaces of the cover portion at least partially define the interior portion, wherein the cover portion includes a top cover component coupled to a bottom cover component, the bottom cover component including an outer bottom component perimeter wall and an inner bottom component perimeter wall, and the top cover component including an outer top component perimeter wall and an inner top component perimeter wall, and an adhesive is disposed between the outer bottom component perimeter wall and an inner bottom component perimeter wall;

a cover attachment portion removably secured to one or more portions of the cover portion, the cover attachment portion including a support portion extending from a first end to a second end, and a cushion portion coupled to the support portion;

a first main portion securement feature disposed at a first location on at least one of the one or more side walls of the main portion; and a second main portion securement feature disposed at a second location on at least one of the one or more side walls of the main portion.

11. The cooler assembly of claim 10, wherein the support portion of the cover attachment portion includes a first body arm and a second body arm, the first body arm having a first lip adapted to removably engage a first portion of the cover portion and the second body arm having a second lip adapted to removably engage a second portion of the cover portion.

12. The cooler assembly of claim 10, further comprising a seal removably secured within a channel formed in a surface of the cover portion, the seal adapted to sealingly engage a surface of the main portion when the cover portion is in the closed position.

13. The cooler assembly of claim 10, wherein the main portion includes a bottom wall having a gate feature, the gate being surrounded by a gate groove.

14. The cooler assembly of claim 10, further comprising:

a first attachment assembly, the first attachment assembly having a first attachment securement feature adapted to releaseably engage the first main portion securement feature or the second main portion securement feature to removably secure the first attachment assembly to at least one of the one or more side walls of the main portion.

15. The cooler assembly of claim 14, wherein the first attachment assembly is an accessory clip having a ring portion, the accessory clip having a first accessory clip securement feature adapted to releasably engage a second attachment securement feature of a second attachment assembly.

16. The cooler assembly of claim 14, wherein the first attachment assembly is a cup holder assembly including a cup support portion and a cage portion coupled to the cup support portion.

17. The cooler assembly of claim 14, wherein the first attachment assembly is a side table portion including a table portion having a planar top surface portion.

18. The cooler assembly of claim 10, wherein the first main portion securement feature includes a first bar portion that is offset from a first portion of one or more of the exterior surfaces of the one or more side walls, and wherein the second main portion securement feature includes a second bar portion that is offset from a second portion of one or more of the exterior surfaces of the one or more side walls.

19. A cooler assembly for the storage of one or more objects, the cooler assembly comprising:

a cooler portion, the cooler portion comprising:

a main portion having one or more side walls having one or more interior surfaces that at least partially define an interior portion that is adapted to receive the one or more objects, wherein one or more exterior surfaces of the one or more side walls of the main portion define an exterior portion of the cooler portion;

a cover portion at least one of pivotably coupled to or removably secured to the main portion, wherein when the cover portion is in a closed position relative to the main portion, one or more interior surfaces of the cover portion at least partially define the interior portion, wherein the cover portion includes a contact area that extends along a portion of one or more exterior surfaces of the cover portion;

a cover attachment portion removably secured to one or more portions of the cover portion, the cover attachment portion including a support portion extending from a first end to a second end, and a cushion portion coupled to the support portion, wherein the support portion of the cover attachment portion includes a first body arm and a second body arm, the first body arm having a first lip adapted to removably engage a first slot formed in a first portion of the cover portion and the second body arm having a second lip adapted to removably engage a second slot formed in a second portion of the cover portion;

a label extending over all or a portion of the contact area of the cover portion and inmolded with all or a portion of the contact area of the cover portion;

a first main portion securement feature disposed at a first location on at least one of the one or more side walls of the main portion; and a second main portion securement feature disposed at a second location on at least one of the one or more side walls of the main portion.

20. The cooler assembly of claim 19, further comprising:

a first attachment assembly, the first attachment assembly having a first attachment securement feature adapted to releaseably engage the first main portion securement feature or the second main portion securement feature of the cooler portion to removably secure the first attachment assembly to at least one of the one or more side walls of the main portion.

* * * * *